US007167665B2

(12) United States Patent
Tomita et al.

(10) Patent No.: US 7,167,665 B2
(45) Date of Patent: Jan. 23, 2007

(54) FOREIGN MATERIAL REMOVING SYSTEM, METHOD OF REMOVING FOREIGN MATERIAL, PRINTING APPARATUS AND PRINTING METHOD

(75) Inventors: Syohji Tomita, Yao (JP); Atsuyuki Katoh, Tenri (JP); Hiroshi Onda, Yamatokoriyama (JP); Takashi Mukai, Yamatokoriyama (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 2 days.

(21) Appl. No.: 10/670,059

(22) Filed: Sep. 25, 2003

(65) Prior Publication Data

US 2004/0228658 A1 Nov. 18, 2004

(30) Foreign Application Priority Data

Sep. 25, 2002 (JP) ..... 2002-279990
Oct. 29, 2002 (JP) ..... 2002-314097
Dec. 10, 2002 (JP) ..... 2002-358406

(51) Int. Cl.
*G03G 15/02* (2006.01)

(52) U.S. Cl. ..... 399/168; 399/149

(58) Field of Classification Search ..... 399/353, 399/354, 174–176, 168, 149, 150
See application file for complete search history.

(56) References Cited

U.S. PATENT DOCUMENTS 4,755,853 A * 7/1988 Shimizu et al. ..... 399/354
5,438,397 A * 8/1995 Okano et al. ..... 399/354
5,937,245 A * 8/1999 Inoue et al. ..... 399/175
5,970,285 A * 10/1999 Ito et al. ..... 399/149
5,974,277 A * 10/1999 Yamane et al. ..... 399/174
6,029,029 A * 2/2000 Danzuka ..... 399/176
6,421,512 B1 * 7/2002 Watanabe et al. ..... 399/149
6,427,055 B1 * 7/2002 Sawada ..... 399/176
2002/0106210 A1 * 8/2002 Oki
2002/0127025 A1 * 9/2002 Sasai ..... 399/149

FOREIGN PATENT DOCUMENTS

JP 05-307279 A 11/1993
JP 06-050416 B2 6/1994
JP 07-036322 A 2/1995

(Continued)

OTHER PUBLICATIONS

Japan Society of Mechanical Engineers, Handbook on Mechanical Engineering, fifth ed., pub. Aug. 10, 1974 (English translation of relevant pages).

*Primary Examiner*—Susan Lee
(74) *Attorney, Agent, or Firm*—Birch, Stewart, Kolasch & Birch, LLP

(57) ABSTRACT

The present removing system has a feature to remove a left-over toner that is accumulated on a brush that touches a left-over toner on a photoreceptor. More specifically, the present removing system is so arranged that an alternating voltage (superimposing voltage) on which a positive direct current voltage is superimposed is applied onto a conductive brush in accordance with a user's instruction. With this arrangement, even if a positively electrified left-over toner is accumulated on the conductive brush, it is possible to remove the positively electrified left-over toner accumulated on the conductive brush, because a voltage value (positive) applied on the conductive brush in a moment is large. Moreover, because a voltage of the conductive brush becomes negative in a moment, it is possible to remove a negatively electrified left-over toner attached on the conductive brush.

31 Claims, 15 Drawing Sheets

FOREIGN PATENT DOCUMENTS

| | | | |
|---|---|---|---|
| JP | 07-301973 A | | 11/1995 |
| JP | 8-194418 | * | 7/1996 |
| JP | 08-248849 | * | 9/1996 |
| JP | 10-254224 A | | 9/1998 |
| JP | 2000-276020 | * | 10/2000 |
| JP | 2001-188403 A | | 7/2001 |
| JP | 2001-209239 A | | 8/2001 |
| JP | 2002-149026 | * | 5/2002 |

* cited by examiner

10 SHEET

20 SHEET

30 SHEET

40 SHEET

50 SHEET

60 SHEET

70 SHEET

80 SHEET

FOREIGN MATERIAL REMOVING SYSTEM, METHOD OF REMOVING FOREIGN MATERIAL, PRINTING APPARATUS AND PRINTING METHOD

This application claims priority of Application No(s). 2002-279990 filed in Japan on Sep. 25, 2002; 2002-314097 filed in Japan on Oct. 29, 2002; and 2002-358406 filed in Japan on Dec. 10, 2002 under 35 U.S.C. § 119, the entire contents of which are incorporated herein by reference.

FIELD OF THE INVENTION

The present invention relates to (a) a foreign material removing system for removing foreign material left over on an image holding body in a printing apparatus of an electronic photography type, (b) a printing apparatus provided with the foreign material removing system, and (b) a method of removing the foreign material, the method being for use in the foreign material removing system.

BACKGROUND OF THE INVENTION

In a printing apparatus (image forming apparatus) of electronic photography type, it is general that: an electrostatic latent image is formed by performing electrification and exposure with respect to a photoreceptor drum (image holding body), the electrostatic latent image is developed, thereby forming a toner image. After that, the toner image is transcribed to a sheet (transcription material) so as to perform printing.

As a developer used in such a printing apparatus, there are a one-component developer and a two-component developer in general classification.

The two-component developer contains not only a toner but also a carrier made of magnetic material such as Fe (iron) and ferrite, and an electrification property of the two-component developer can be adjusted by varying a mixture ratio of the carrier and the toner. Further, the two-component developer is superior in (a) a development property of a thin line and a solid image and (b) reproducibility of a gray scale, and is suitable for forming a color image.

While, the one-component developer is made only of the toner. In case of using such a developer, it is not necessary to mix and agitate the toner with the carrier, and there is such an advantage that it is not necessary to control density of the toner and it is not necessary to replace the toner with new one.

Incidentally, there is a printing apparatus of electronic photography type which performs corona discharge so as to electrify a photoreceptor drum (a member to be electrified) (for example, see Document 1: Japanese Published Unexamined Patent Application 6-50416 (Tokukohei 50416/1994, published on Jun. 29, 1994).

Note that, in the printing apparatus, a development apparatus has a function for cleaning the photoreceptor drum, thereby making the printing apparatus smaller.

However, when electrification is performed by using a corona discharger, the apparatus is susceptible to environmental influences such as humidity and dusts. Further, the foregoing arrangement brings about problems such as (a) smell caused by ozone emitted upon performing the corona discharge and (b) harmful effects exerted on a human body.

Then, as a method for avoiding such problems, the following method is known: an electrification member (conductive member), such as an electrification roller, to which a superimposing voltage has been applied, is made into contact with a surface of the photoreceptor drum so as to electrify the surface of the photoreceptor drum. Here, the superimposing voltage means a voltage prepared by superimposing an alternating current voltage on a direct current voltage.

However, such a contact electrification method brings about the following problem. That is, upon performing the printing, a relatively hard foreign material such as the carrier sometimes adheres to a surface of the photoreceptor drum or a surface of the electrification roller. At this time, in the contact electrification method, the electrification roller is in contact with the photoreceptor drum with the foreign material thereon. Thus, this condition brings about such a problem that the foreign material damages the surface of the photoreceptor drum or the electrification roller.

Then, in order to solve such problem of the contact electrification method and to achieve a no-ozone condition which is the most advantageous point, the following close electrification method has been proposed recently: the electrification roller is located close to (without touching) the photoreceptor drum.

A printing apparatus using such an electrification method is disclosed, for example, in Document 2: Japanese Published Unexamined Patent Application 2001-188403 (Tokukai 188403/2001, published on Jul. 10, 2001). The apparatus disclosed in Document 2 includes a development apparatus of two-component development type. Further, a narrowest gap (electrification gap) between a discharge surface of the electrification roller and the photoreceptor drum is set to be greater than a diameter of the carrier of the developer.

Further, in an electrification method recited in Document 3: Japanese Published Unexamined Patent Application 5-307279 (Tokukaihei 307279/1993, published on Nov. 19, 1993), the electrification gap (air gap) is set to not more than 120 μm, and a superimposing voltage (alternating voltage prepared by superimposing a low frequency alternating current voltage on a direct current voltage) is applied between the electrification roller and the photoreceptor drum.

Further, Document 4: Japanese Published Unexamined Patent Application 7-301973 (Tokukai 301973/1995, published on Nov. 14, 1995) proposes such a method that: the electrification gap (air gap) is set to 30 μm to 240 μm, and an electrode bias of a direct current component is applied to the electrification roller, so as to electrify the photoreceptor drum.

The printing apparatus of Document 2 is arranged so that the electrification gap is set to be greater than the diameter of the carrier of the developer, so that this arrangement does not bring about such a problem that the carrier and the toner adhering to the carrier are involved between the photoreceptor drum and the electrification roller. Thus, the carrier does not damage the photoreceptor drum and the electrification roller.

However, the foregoing arrangement brings about such a problem that the greater electrification gap requires a greater voltage so as to electrify the photoreceptor. Moreover, a condition under which the photoreceptor is electrified tends to be less stable as the electrification gap increases. Thus, the greater electrification gap causes lower image quality.

Further, when the electrification gap is made smaller so as to avoid such a problem (specifically, when the electrification gap is made smaller than the foreign material (such as a carrier particle of the developer), it is necessary to perform the cleaning, in upstream of the electrification roller, with respect to the photoreceptor drum, so as to prevent the photoreceptor drum and the electrification roller from being damaged or tainted (getting dirty).

Further, the foreign material (left-over material) that is on the photoreceptor drum causes deterioration of the image. A relationship between the left-over material on the photoreceptor drum and the image deterioration is described as follows.

In the printing apparatus of electronic photography type, when the toner image is transcribed onto the sheet, the toner image is not completely transcribed, so that the toner is sometimes left over on the photoreceptor drum. Further, such left-over toner causes the image deterioration such as "toner image memory" (the previous toner image remains in the following toner image). Thus, conventionally, an agitating brush for agitating the left-over toner image is used to prevent the toner image memory. However, when the agitating brush becomes dirty with the toner deposited thereon, the toner adheres to and is deposited on the electrification roller which electrifies the photoreceptor drum.

Further, when the left-over toner is deposited on the electrification roller, the electrification property of the electrification roller is deteriorated, so that this condition brings about irregular discharge. Further, the irregular discharge brings about uneven electrification of the photoreceptor drum and image fogging (black points which occur in an unexposed portion (a portion which should remain white)).

FIGS. 16(*a*) and 16(*b*) show a case where a printing apparatus which does not remove the left-over toner on the electrification roller by cleaning makes a copy of a document. Here, FIG. 16(*a*) is an explanatory view which shows a document image, and FIG. 16(*b*) is an explanatory view which shows an image generated by performing a copying operation.

As shown in these figures, when the left-over toner on the electrification roller is not removed, black points occur in a white background portion of the image, and influence exerted by the black points increases as the printing apparatus is used more frequently.

Further, FIGS. 17(*a*) to 17(*h*) are explanatory views each of which shows a condition under which the black points occur corresponding to frequency in use (the number of copied sheets) in the case where the left-over toner on the electrification roller is not removed. As shown in these figures, as the number of copied sheets increases, the black points become more influential.

Table 4 is a table which shows a relationship between the number of printed sheets (P) and a fogging value K in terms of both the case where the left-over toner on the electrification roller is removed by cleaning and the case where the left-over toner is not removed. FIG. 18 shows value of the table as a graph.

Note that, the fogging value K is calculated from an such an expression that: "$K=1-U/U_0$, U: brightness, $U_0$: initial brightness".

TABLE 4

| | Image fogging caused by the left-over toner on the electrification roller | | | | |
|---|---|---|---|---|---|
| NUMBER OF | NO CLEANING | | | CLEANING | |
| SHEETS P | BRIGHTNESS U | FOGGING K | APPROXIMATION | BRIGHTNESS U | FOGGING K |
| 0 | 242 | 0.00 | 0.000 | 242 | 0.00 |
| 10 | 240 | 0.01 | 0.000 | 242 | 0.00 |
| 20 | 240 | 0.01 | 0.000 | 242 | 0.00 |
| 30 | 233 | 0.04 | 0.073 | 242 | 0.00 |
| 40 | 218 | 0.10 | 0.110 | 243 | 0.00 |
| 50 | 211 | 0.13 | 0.130 | 242 | 0.00 |
| 60 | 208 | 0.14 | 0.140 | 242 | 0.00 |
| 70 | 207 | 0.15 | 0.145 | 243 | 0.00 |
| 80 | 204 | 0.16 | 0.147 | 243 | 0.00 |
| 90 | 205 | 0.15 | 0.149 | — | — |
| 100 | 220 | 0.09 | 0.149 | — | — |

In order to prevent such image fogging, Document 5: Japanese Published Unexamined Patent Application 7-36322 (Tokukaihei 36322/1995, published on Feb. 7, 1995) discloses a technique in which the left-over toner on the photoreceptor is removed by using a fur brush so as to prevent the toner from adhering to the electrification roller.

Note that, in the technique, when a large amount of toner is deposited on the fur brush, electrification failure and exposure failure cause deterioration of the image quality. Then, in order to prevent such deterioration of the image quality, a toner removing roller is provided so as to touch the fur brush. The toner adhering to the fur brush is removed by means of the toner removing roller.

However, in the technique of Document 5, it is necessary to use the toner removing roller so as to remove the toner adhering to the fur brush.

Thus, a structure of the printing apparatus is complicate, which brings about such a problem that the manufacturing cost increases.

Further, in order to prevent the image fogging, another conventional apparatus is arranged so that: a cleaning blade is made into contact with the photoreceptor drum, which scratches and removes the left-over toner from the photoreceptor drum before the left-over toner adheres to the electrification roller.

However, when the left-over toner is scratched and removed by such a blade, a slight amount of toner remains. Thus, this results in such a condition that: the more sheets are printed, the more left-over toner is deposited on the electrification roller.

In order to solve the fogging caused by the left-over toner deposited on the electrification roller, for example, Document 6: Japanese Published Unexamined Patent Application 10-254224 (Tokukaihei 254224/1998, published on Sep. 25, 1998) discloses a technique in which there is provided an air blow generating apparatus for generating air blow in the vicinity of a narrowest gap between the electrification roller (non-contact type) and the photoreceptor drum.

Further, in the technique, when the electrification roller is tainted with the left-over toner, the left-over toner on the electrification roller is removed by air blow so as to be returned to the photoreceptor drum.

Further, Document 7: Japanese Published Unexamined Patent Application 2001-209239 (Tokukai 209239/2001, published on Aug. 3, 2001) discloses a technique in which a cleaning member for electrically attract the toner is made into contact with the electrification roller (contact type) so as to remove the left-over toner on the electrification roller.

However, in the technique, it is necessary to provide the air blow generating apparatus, which brings about such a problem that the manufacturing cost increases.

Further, the technique of Document 7 is arranged so that the electrification roller rotates in a direction opposite to a rotation direction of the photoreceptor drum (with rotation). Thus, this arrangement brings about such a problem that the foreign material tends to be involved between the electrification roller and the photoreceptor drum.

SUMMARY OF THE INVENTION

The present invention solves the aforementioned conventional problems. A first feature of the present invention is to provide a foreign material removing system that is capable of easily removing a left-over toner that is accumulated on a brush. The brush touches a left-over toner located on the photoreceptor.

A second feature of the present invention is to provide a foreign material removing system for a printing apparatus, the foreign material removing system being capable of avoiding an effect of foreign material accumulated on an electrification roller, and preventing the foreign material from entering into a gap between the electrification roller and the photoreceptor.

In order to attain the first feature, a first foreign material removing system (first removing system) of the present invention for removing foreign material left over on an image holding body of an electronic photography type printing apparatus, is so arranged as to include: a power source; an agitating member for agitating the foreign material that is on the image holding body; and an attracting section for attracting the agitated foreign material by an attraction bias, the agitating member being electrified in accordance with a voltage applied thereon from the power source, and the power source alternately switching polarity of the electrified agitating member.

The first removing system is used for an electronic photography type printing apparatus adopted as a photocopy machine, a printer, a facsimile machine, and the like.

In such printing apparatus, the surface of the image holding body being rotating is electrified and exposed so as to form an electrostatic latent image, and the latent image is developed by using a developer (such as the toner or the like) so as to form a visible image (such as the toner image). The visible image is transcribed onto the sheet (such as recording paper or the like).

Further, the first removing system is used for removing the foreign material (left-over foreign material; mainly the developer) left over on the image holding body after the transcription of the visible image.

As described above, the first removing system is provided with the agitating member, the attracting section, and the power source.

The attracting section removes (attracts) the foreign material from the image holding body by the attraction bias.

In the electronic photography type printing apparatus, the image (image formed with the developer) on the image holding body is electrostatically transcribed onto the sheet. Thus, the left-over foreign material has an electrification status in accordance with the transcription voltage (the left-over foreign material is electrified in accordance with the transcription voltage). The first removing system electrostatically removes such left-over foreign material from the image holding body by using the attraction bias of the attracting section.

Moreover, the agitating member agitates (stirs) the aggregation cluster (foreign material cluster) of the left-over foreign material located on the image holding body. This arrangement crumbles the foreign material cluster located on the image holding body so as to make it easier to attract the left-over foreign material.

Moreover, the power source applied the voltage (agitating voltage) onto the agitating member, so as to cause the agitating member to be in the electrification status in accordance with the agitating voltage.

In the first removing system having this arrangement, it is possible to adjust the electrification status of the left-over foreign material by using the agitating member. Note that, as such agitating member, a conductive brush may be used, for example.

Incidentally, in some case, electrostatic force, intermolecular force, adhesive force and the like cause the left-over foreign material to be adhered and accumulated on the agitating member for agitating the foreign material located on the image holding body.

For removing such left-over foreign material from the agitating member, the first removing system is so arranged that the power source changes the polarity of the agitating voltage so as to alternately switch over the electrification polarity of the agitating member.

In other words, it is possible to remove the positively electrified left-over foreign material from the agitating member, by applying the positive agitating voltage onto the agitating member. Meanwhile, it is possible to remove the negatively electrified left-over foreign material from the agitating member, by applying the negative agitating voltage onto the agitating member.

In the first removing system having this arrangement, it is possible to remove the left-over foreign material from the agitating member regardless of whether the left-over foreign material is positively or negatively electrified.

Moreover, the arrangement in which the electrification polarity of the agitating member is alternately switched over, prevents excess attraction of the left-over foreign material electrified in one of the polarities.

Moreover, by adjusting, depending on electrification characteristics of the left-over toner, a length of time in which the agitating voltage is positive, and a length of time in which the agitating voltage is negative (by arranging such that the length of time in which the agitating voltage is in the same polarity as the average polarity of the left-over toner), it is possible to attain efficient control of the attraction of the left-over toner.

Moreover, the first removing system may be so arranged that the power source applies an alternating voltage onto the agitating member, in order to switch over the electrification polarity of the agitating member mentioned above.

This arrangement attains easy switchover of the electrification polarity of the agitating member.

Further, with the arrangement in which the power source applies an alternating voltage onto the agitating member, it is possible to fluctuate (vary, change) the electrostatic force that is applied onto both of the positively and negatively electrified left-over foreign material attached on the agitating member.

Because of this, the left-over foreign material is agitated by the electrostatic force. Therefore, it is possible to remove, from the agitating member, the left-over foreign material attached on the agitating member by the intermolecular force and the adhesive force.

As described above, the first removing system is so arranged as to be capable of easily removing the left-over foreign material attached on the agitating member.

Moreover, the printing apparatus provided with the first removing system having the above-mentioned arrangement is capable of printing without much image quality deterioration (with the image quality deterioration (effectively) inhibited).

Moreover, in order to attain the secondfeature, a second foreign material removing system (second removing system) is a foreign material removing system for removing foreign material left over on an image holding body of an electronic photography type printing apparatus, is so arranged as to include: an electrification roller for (i) performing against rotation with respect to the image holding body, (ii) electrifying the image holding body by an electrification bias, and (iii) attracting the foreign material that is on the image holding body; and a cleaning section for cleaning a surface of the electrification roller by removing the foreign material thus attracted onto the electrification roller.

The second removing system is used for an electronic photography type printing apparatus adopted as a photocopy machine, a printer, a facsimile machine, and the like.

In such printing apparatus, the surface of the image holding body being rotating is electrified and exposed so as to form an electrostatic latent image, and the latent image is developed by using a developer (such as the toner or the like) so as to form a visible image (such as the toner image). The visible image is transcribed onto the sheet (such as recording paper or the like).

Further, the second removing system is used for removing the foreign material (mainly the developer) left over on the image holding body after the transcription of the visible image.

As described above, the second removing system is provided with the electrification roller of the printing apparatus and the foreign material removing system.

The electrification roller is so provided as to face the image holding body. There is a predetermined gap (electrification gap) between the electrification roller and the image holding body. A predetermined electrification bias is applied on the electrification roller. As a primary function, during the printing operation of the printing apparatus, by using an electrification bias, the electrification roller electrifies the surface of the image holding body, the surface being in the electrification region.

Note that the electrification region is a region in which in aerial electric discharge occurs between the electrification roller and the image holding body (for example, the region is worked out by substitution of a maximum value of the voltage to be applied on the electrification roller, in "Paschen's experimental formula").

Moreover, the second removing system is so arranged that the foreign material on the image holding body (foreign material electrified oppositely (inversely) to the electrification bias) is attracted to the electrification roller by using the electrification bias of the electrification roller.

In short, in the second removing system, the electrification roller has not only the function of electrifying but also the function of removing the foreign material. For this reason, there is no need of providing a special member (such as the cleaning blade) for removing the foreign material from the image holding body. This reduces a manufacturing cost.

The electrification bias, the electrification polarity and the electrification amount of the foreign material and the image holding body determine which kind of the foreign material can be removed by the electrification bias.

For the foreign material that can be removed by the electrification bias, an attraction force to attract the foreign material to the electrification roller is greater than an attraction force to attract the foreign material to the image holding body, when the electrification bias is applied on the foreign material.

Moreover, especially, the second removing system is so arranged that the electrification roller performs against rotation with respect to the image holding body.

Here, "the electrification roller performs against rotation" indicates that the electrification roller rotates in the same direction as the image holding body. In this case, the facing surface of the electrification roller and the facing surface of the image holding body, which face against each other, move in the opposite directions in the electrification region (that is, the surface of the electrification roller and the surface of the image holding body, which face against each other, pass by each other).

Therefore, in the second removing system, the foreign material located on the image holding body is attracted onto the electrification roller in an entering position for the electrification region. Then, the foreign material is transferred away from the electrification region in accordance with the rotation of the electrification roller.

With the second removing system having this arrangement, it is possible to prevent the foreign material on the image holding body from passing through the electrification region (electrification gap), and from being stuck between the electrification gap (and damaging the image holding body and the electrification roller).

Moreover, because no foreign material left in the electrification region, the electrification will not be hindered by the foreign material. Therefore, it is possible to prevent occurrence of non-electrified part of the image holding body due to the existence of the foreign material.

Moreover, because it is possible to prevent the foreign material from entering the electrification gap, it is unnecessary to have a wide electrification gap in accordance with a large-sized foreign material. Thus, it is possible to have such arrangement that the electrification gap is narrow. With the arrangement in which the electrification gap is narrow, it is possible to have such arrangement that the electrification bias is low, as understood from "Paschen's experimental formula" which finds the break-down voltage of aerial electric discharge. Further, the arrangement enables miniaturization of the second removing system and the printing apparatus.

Note that, in case where the electrification roller and the image holding body perform with rotation with respect to each other, (rotate in the opposite directions), the electrification roller passes the electrification region with the foreign material attached on the electrification roller. However, in the downstream of the electrification region (the downstream with respect to the image holding body), the surface potential of the image holding body is electrified to have the substantially same potential as the (direct current) electrification bias. Therefore, the image holding body has the substantially same foreign material attracting force as the electrification roller. Thus, in case of the with rotation, significantly reduced is the capacity of electrostatically recovering (recollecting) the left-over foreign material from the image holding body.

In the second removing system, on the other hand, the against rotation is performed. Thus, where the electrification roller removes the left-over foreign material from the image holding body is the upstream of the electrification region (from which the left-over foreign material on the image holding body enters the electrification region). Thus, according to the first removing system, it is possible to avoid the effect of the attraction force of the image holding body.

Moreover, according to the second removing system, it is possible to extend the relative travel distance between the surface (electrification surface) of the electrification roller and the surface (the surface to be electrified) of the image holding body, because the electrification roller performs the against rotation with respect to the image holding body.

This prevents electrification fluctuation due to the local change in the resistance of the electrification roller (the resistance of part of the electrification roller changes). Thus, it is possible to improve the electrification property (evenness in the electrification) of the image holding body.

Moreover, in the second removing system, the surface to be electrified next, of the electrification roller enters the electrification from the downstream of the electrification, because the electrification roller performs the against rotation with respect to the image holding body.

Therefore, even in case of internal voltage drop of the electrification roller, it is possible to alleviate the decrease of the electrification potential of the image holding body due to the internal voltage drop. In the internal voltage drop, the voltage inside the electrification roller is reduced due to electrification of a capacitor component as a result of the electrification of the image holding body.

Moreover, in the downstream of the electrification region, the surface potential of the image holding body increases as the electrification proceeds. Because of this, an electrification current density (per area) is also reduced, as the surface potential increases. This alleviates the electrification potential reduction of the image holding body due to the voltage drop caused by a resistance component inside of the electrification roller.

Note that this effect becomes especially remarkable when the resistance of the electrification roller is high. That is, when the electrification roller has a high resistance, the voltage drop caused by electrification of the capacitance component and the voltage drop caused by the resistance component become remarkable, whereby it becomes difficult to increase the electrification potential of the image holding body to the regular value.

Moreover, especially, the second removing system is provided with a cleaning section for cleaning a surface of the electrification roller by removing the foreign material thus attracted onto the electrification roller.

With this arrangement, it is possible to prevent the foreign material from accumulating on the electrification roller. Therefore, it is possible to prevent (i) the deterioration of the electrification roller due to the accumulation of the foreign material, and (ii) the abnormal electrical discharge due to the accumulation of the foreign material. Therefore, it is possible to avoid occurrence of the image quality deterioration such as image fogging.

Moreover, because it is possible to prevent, from being returned to the image holding body, the foreign material that has been once removed by the electrification, it is possible to prevent image deterioration caused by such foreign material that is returned from the electrification roller to the image holding body.

Moreover, by arranging a printing apparatus to have the second removing system, developer tank, it is possible to perform printing without much image quality deterioration (with the image quality deterioration (effectively) inhibited).

For a fuller understanding of the nature and advantages of the invention, reference should be made to the ensuing detailed description taken in conjunction with the accompanying drawings.

DETAILED DESCRIPTION

First Embodiment

One embodiment of the present invention is described below.

A printing apparatus (present printing apparatus) of the present embodiment is an electronic photography type printing apparatus in which an image in accordance with image data is printed on a sheet (printing paper) by using a two-component developer (developing agent) containing a toner and a carrier. Moreover, a development method of the present printing apparatus is reversal development.

Figure 1:
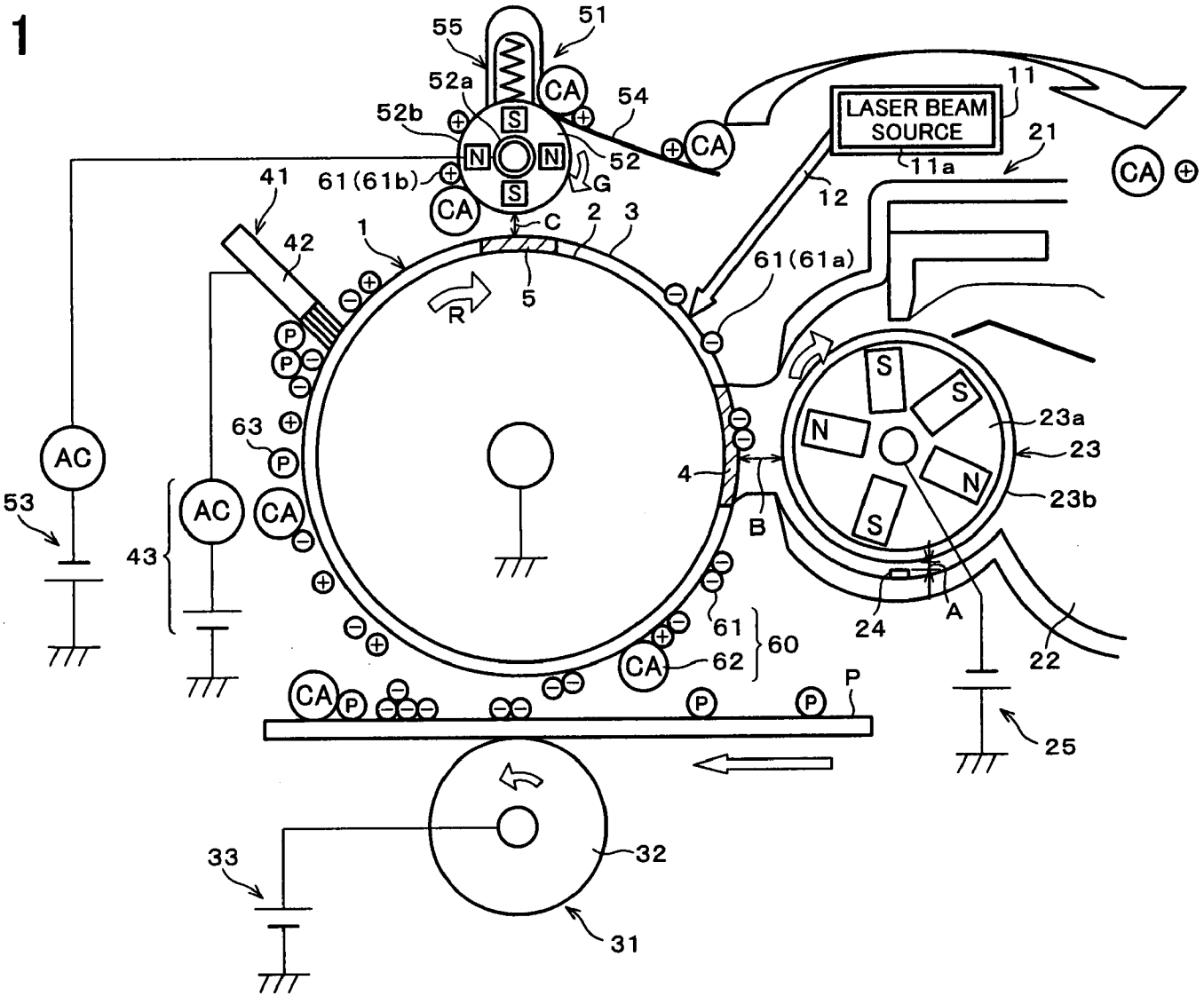
FIG. 1 is an explanatory view for illustrating a printing apparatus according to one embodiment of the present invention.

FIG. 1 is an explanatory view illustrating an arrangement of the present printing apparatus.

As shown in FIG. 1, the present printing apparatus is provided with an LSU (laser beam scanner unit) 11, a development apparatus 21, a transcription apparatus 31, foreign material agitating apparatus 41, an electrification apparatus 51, and a photoreceptor 1. The LSU 11, the development apparatus 21, the transcription apparatus 31, the foreign material agitating apparatus 41, and the electrification apparatus 51 are provided around the photoreceptor 1 in this order from an exposing position (from which the LSU 11 emits a laser beam 12).

The photoreceptor (image holding body) 1 is a photoreception drum rotated in the arrow R (clockwise) (at a process speed of 130 mm/s).

The photoreceptor 1 is provided with, on a conductive drum 2, a film 3 including a charge generating layer (CGL) a charge transport layer, and the like. the conductive drum 2 is grounded. On a surface of the photoreceptor 1, an electrostatic latent image (latent image) is formed by giving an electric charge to the surface by electrification, and a toner image is formed by developing the electrostatic latent image.

In an electrification region 5, the electrification apparatus 51 performs negative electrification (at −600V) of the surface of the photoreceptor 1 to a predetermined potential. The electrification region 5 is that portion of the photoreceptor 1, which is closest to the electrification apparatus 51. In the electrification region 5, aerial electric discharge (aerial discharge) is caused in a gap between an electrification roller 52 and the photoreceptor 1 (for example, the region is found by calculation in which a maximum value of a voltage to be applied on the electrification roller 52 is substituted in the "Paschen's experimental formula").

As shown in FIG. 1, the electrification apparatus 51 is provided with the electrification roller 52, an electrification bias power source 53, a cleaning film 54, and a spring 55.

By using a spring force (elastic force) thereof, the spring 55 locates the electrification roller 52 so that the electrification roller 52 is in vicinity of the photoreceptor 1 but does not touch the photoreceptor 1.

That is, the spring 55 controls, to be a suitable value, a gap (electrification gap C) between an electric discharging surface of the electrification roller 52 and the surface of the photoreceptor 1 which faces against the electric discharging surface.

The electrification roller 52 is a magnet roller provided with a conductive drum 52*a* and a resistance layer 52*b*, which covers a surface of the conductive drum 52*a*. The electrification roller 52 has a function to electrify (at −600V) of the surface of the photoreceptor 1 via the resistance layer 52*b* by using electrification bias applied from the electrification bias power source 53 onto the conductive drum 52*a*.

Moreover, the electrification apparatus 51 also has a function (function as foreign material removing system) of removing, in the electrification region 5, foreign material (that is positively charged) attached on the photoreceptor 1. This function (and the cleaning film 54) will be described later.

The LSU (laser beam scanner unit: exposure apparatus, latent image forming means (exposure means)) 11 is located a position downstream of the electrification apparatus 51 along the direction of Arrow R, and far from the photoreceptor 1. Further, as shown in FIG. 1, the LSU 11, which is provided with a laser beam source 11*a*, has a function of exposing (scanning) the electrified surface of the photoreceptor 1 by the laser beam 12 that is modulated in accordance with the image data. In this way, the LSU 11 selectively removes the (negative) electrification charge on the surface of the photoreceptor 1 so as to form the electrostatic latent image that is in accordance with the image data.

Note that the image data is digital data (image signal) indicative of (i) image information inputted by a scanner section (document reading apparatus; not shown) or a host computer (not shown) that is connected to outside, or (ii) image information such as fax information and the like, which is sent by transmission or the like.

In a development region 4, the development apparatus 21 performs reversal development of the electrostatic latent image on the photoreceptor 1 by using toner 61, and forms a toner image on the photoreceptor 1. The development region 4 is a portion of the photoreceptor 1 that is closest to the development apparatus 21.

Here, the reversal development is a developing method in which toner is caused to be attracted on that portion (charge-removed portion; exposed portion) of the electrostatic latent image on the photoreceptor 1 from which charge is removed. Moreover, in the reversal development, the toner 61 has a negative main electrification polarity (electrification polarity of the majority of the toner 61) when the photoreceptor 1 has a negative electrification polarity (polarity of the electrification thereof).

As shown in FIG. 1, the development apparatus 21 is provided with a developer tank 22, a development roller 23 and a layer thickness regulating member 24, and a development bias power source 25. The developer tank 22 contains developer 60 containing two components, namely, a toner 61 and a carrier 62. The development roller 23 and the layer thickness regulating member 24 are located inside the developer tank 22. The development bias power source 25 applies a development bias on the development roller 23.

The developer tank 22 is not only for containing the developer 60, but also for agitating the developer 60 by using an agitating roller (not shown) provided inside of the developer tank 22, so as to electrify the developer 60 to have a predetermined (negative) potential.

The developer 60 is a developer having two components, which are the toner 61 and the carrier 62. The toner 61 is a toner made of styrene acryl, for example. The carrier 62 (toner carrier; the carrier 62 is indicated by the reference character "CA" in FIG. 1), is made of an inorganic magnetic material such as magnetite, ferrite or the like.

The development roller (attracting section) 23 is a roller located so as to face against the photoreceptor 1 via a development gap B (having a thickness of 2 mm, for example).

Further, by using a predetermined bias (−400V) applied from the development power source (voltage (development bias) applying means) 25, the development roller (development supplying means) 23 attracts the toner 61 around itself in a form of an electromagnetic brush. The toner 61 thus negatively electrified is attracted onto the charge-removed portion of the electrostatic latent image on the photoreceptor 1, thereby visualizing the electrostatic latent image (converting the electrostatic latent image into a toner image).

Moreover, the layer thickness regulating member 24 regulates not only a gap (doctor gap A, which is 1.5 mm for example) between itself and the photoreceptor 1, but also a thickness of a layer of the toner 61 adhered on the development roller 23, by using a predetermined bias from a power source (not shown). This regulation controls an amount of the toner 61 to be supplied on the photoreceptor 1.

Moreover, the development apparatus 21 also has a function (function as the foreign material removing system) of removing, in the development region 4, foreign material on the photoreceptor 1. This function will be explained later.

The transcription apparatus (transcription section) 31 transcripts, onto a sheet (transcription material) P, the toner image formed on the photoreceptor 1. The transcription apparatus is provided with a transcription roller 32 and a transcription bias power source 33.

The transcription roller (transcription section) 32 rotates in accordance with rotation of the photoreceptor 1. The rotation of the transcription roller 32 transfers a sheet (paper) P to a nip section (transcription region) between the photoreceptor 1 and the transcription roller 32, and presses the sheet P onto the photoreceptor 1.

Then, by using a predetermined transcription bias (+2 kV) applied from the transcription bias power source 33, the transcription roller 32 attracts, toward the sheet P, the toner image (that is negatively electrified) formed on the photoreceptor 1, and transcribes the toner image on the sheet P.

This causes the toner 61, which is negatively electrified in the development region 4, to be slightly positively electrified by the transcription bias (+2 kV).

The foreign material agitating apparatus (electrification adjusting member) 41, together with the electrification apparatus 51 and the development apparatus 21, constitutes part of the foreign material removing system of the present printing apparatus. The foreign material agitating apparatus 41 will be described in arrangement and function later.

Next, the foreign material removing system (present removing system) of the present printing apparatus is explained below.

Generally, in a printing apparatus of the digital photographic method, part of a toner image is left over on a photoreceptor after the toner image is transcribed on the sheet. Moreover, in some case, paper powder derived from the sheet, a carrier contained in the developer, and the like are attached on the surface of the photoreceptor 1.

Then, the present removing system is used (i) to remove such left-over toner, paper powder, carrier and the like from the surface of the photoreceptor 1 by cleaning the surface of the photoreceptor 1, and (ii) to recover the recyclable (the toner and carrier) and send back to the development apparatus 21 (the developer tank 22).

The present removing system is, as described above, provided with the foreign material agitating apparatus 41, the electrification apparatus 51, and the development apparatus 21.

Here, the foreign material agitating apparatus 41 agitates (stirs) and crumbles a cluster of the foreign material due to agglomeration of the foreign material on the photoreceptor 1. Moreover, the electrification apparatus 51 removes (attracts) the foreign material that is positively electrified. Meanwhile, the development apparatus 21 removes (attracts) the foreign material that is negatively electrified.

The following explains arrangements of the members 41, 21, and 51 (mainly as the foreign material removing system).

Firstly, the arrangement of the foreign material agitating apparatus (electrification adjusting member) 41 is explained below.

As described above, the foreign material agitating apparatus 41 agitates (stirs) and crumbles the cluster of the foreign material on the photoreceptor 1, in order to increase an efficiency (attraction efficiency) in the attraction of the foreign material, which is performed by the electrification apparatus 51 (the electrification roller 52) and the development apparatus 21 (the development roller 23).

Here, the foreign material on the photoreceptor 1 is a left-over foreign material such as (i) toner that is not transcribed on the sheet P and left over on the photoreceptor 1 after the transcription step, (left-over toner; negatively electrified left-over toner 61*a* and positively electrified left-over toner 61*b* shown in FIG. 1), (ii) the carrier 62 (indicated by the reference character "CA" in FIG. 1), (iii) paper powder 63 (indicated by "P" in FIG. 1), or (iv) the like.

As shown in FIG. 1, the foreign material agitating apparatus 41 is located in upstream of the electrification apparatus 51 (upstream of the electrification region 5) along the direction of the arrow R. The foreign material agitating apparatus 41 is provided with a conductive brush 42 and an agitating voltage power source (agitating bias power source) 43.

The conductive brush (agitating member, electrification adjusting member) 42 is so located that a tip of the brush 42 touches the surface of the photoreceptor 1. The conductive brush 42 agitates the cluster of the foreign material on the photoreceptor 1.

The agitating voltage power source (power source) 43 applies, onto the conductive brush 42, a DC (Direct Current) agitating voltage (brush bias (agitation bias); +500V) that is in the same polarity (positive) as the transcription bias.

This arrangement enables the foreign material agitating apparatus 41 to adjust electric charge on the foreign material on the photoreceptor 1.

Specifically, in the present printing apparatus, the negatively electrified surface of the photoreceptor 1 is exposed so as to form the electrostatic latent image on the surface of the photoreceptor 1, and then the reversal development is performed in the charge-removed portion of the latent image. In the reversal development, the negatively electrified toner 61 is attracted onto the charge-removed portion by the development apparatus 21.

Therefore, almost all the toner 61 is negatively electrified in the upstream of the transcription region (before the toner 61 reaches the transcription region). Moreover, in case where the toner 61 is left over on the photoreceptor 1 in the downstream of the transcription region (after the toner 61 passes through the transcription region), the electrification of the toner 61 is broadly distributed in terms of electrification amount, due to the transcription bias of +2 kV. As a result, the overall (average) electrification of the toner 61 is positive.

Specifically, in the toner (left-over toner) that is left over in that part of the photoreceptor 1 which is right after the transcription region, a majority is the positively electrified left-over toner 61*b* while a slight amount of the negatively electrified left-over toner 61*a* also exists therein.

The foreign material agitating apparatus 41 applies a positive agitating voltage (direct current) onto the conductive brush 42 so as to cause positive electrification shift of the left-over toner so as to increase an amount of the positively electrified left-over toner 61*b* (with respect to the negatively electrified left-over toner 61*b*), whereby the later-described electrification roller attracts the foreign material with higher efficiency.

Moreover, the DC agitating voltage of the conductive brush 42 also positively electrifies the foreign material (for example, the paper powder 63 and carrier) other than toner.

Moreover, the present printing apparatus may be so arranged that an alternating current (AC) voltage is applied on the conductive brush 42 by using the agitating voltage power source 43. This arrangement will be described later.

Next, the electrification apparatus 51 is explained.

The electrification apparatus 51 has not only a function of evenly electrifying the photoreceptor 1 but also a function of removing the positively electrified ones of the foreign material left over on the photoreceptor 1 after the transcription.

Here, the positively electrified foreign material is the positively electrified left-over toner 61*b* (indicated by the reference symbol "+" shown in FIG. 1), the carrier 62 (indicated by the reference character "CA" in FIG. 1) and the paper powder 63 (indicated by the reference character "P" in FIG. 1).

That is, the electrification apparatus 51 removes the positively electrified foreign material (and a cluster thereof) from the surface of the photoreceptor 1 by attracting the positively electrified foreign material on a surface of the resistance layer 52*b*. In short, the electrification apparatus 51 is an apparatus for both electrification and cleaning.

As shown in FIG. 1, the electrification region 5 is provided with the cleaning film 54 in addition to the electrification roller 52, the electrification bias power source 53, and the spring 55.

The electrification roller (attracting section) 52 is so arranged that the electrification roller 52 rotates, by using a driving system (not shown), along the direction of the arrow G shown in FIG. 1, that is, in the same direction as the rotation direction (R) of the photoreceptor 1 (in short the electrification roller 52 performs against rotation with respect to the photoreceptor 1). That is, the electrification roller 52 and the photoreceptor 1 are so arranged that the electrification roller 52 and the photoreceptor 1 are respectively moved (driven) by different driving systems so that the surfaces of the electrification roller 52 and the photoreceptor 1 that face each other, move in opposite directions in the electrification region 5.

Moreover, the electrification roller 52 is, as described above, provided with the conductive drum 52*a* and the resistance layer 52*b*, which covers the surface of the conductive drum 52*a*. In addition, the electrification roller 52 is provided with a magnet below the resistance layer 52*b*. That is, the electrification roller 52 is a magnet roller.

The electrification roller 52 has a function of electrifying the surface of the photoreceptor 1 (at −600 v) via the resistance layer 5 by using an electrification bias applied from the electrification bias power source 53 onto the conductive drum 52*a*, and of adhering the foreign material left over on the photoreceptor 1 electrically and magnetically.

The electrification bias power source 53 applies the electrification bias onto the electrification roller 52. In the present printing apparatus, the electrification bias is a superimposing voltage (electrified superimposing voltage), which is produced by superimposing the AC voltage (having a peak-to-peak voltage of 1.8 KVpp, and a frequency of 900 Hz) on the DC voltage (−600V).

The cleaning film (cleaning section, recovering member 54 is so located as to touch the electrification roller 52. The cleaning film 54 cleans the surface of the electrification roller 52, by scratching off the foreign material adhered on the electrification roller 52.

Moreover, the cleaning film 54, which also has a function of conveying (recovering) the thus scratched-off foreign material into the developer tank 22 of the development apparatus 21, is provided with a cleaning blade and a toner conveying screw.

Note that, the cleaning film 54 may be made of polyethylene phthalate, for example.

Next, the development apparatus 21 is described below.

In addition to the function of developing the electrostatic latent image so as to form the toner image, the development apparatus 21 has a function of removing and recovering the negatively electrified ones of the foreign material left over on the photoreceptor 1 after the transcription.

Here, the negatively electrified foreign material is, for example, the negatively electrified left-over toner 61*a* (indicated by the reference symbol "−" in FIG. 1), the paper powder 63, and the like.

That is, the development apparatus 21 removes the negatively electrified foreign material (and a cluster thereof) from the surface of the photoreceptor 1 by adhering the negatively electrified foreign material onto the development roller 23. In short, the development apparatus 21 is an apparatus for the development and cleaning.

As described above, the development apparatus 21 is provided with the developer tank 22, the development roller 23, the layer thickness regulating member 24, and the development bias power source 25.

Moreover, as shown in FIG. 1, the development roller 23 is provided with a magnet roll 23*a* and a sleeve 23*b* that covers the magnet roll 23*a*.

The development roller 23 is so arranged as to magnetically adhere the toner 61 on the surface of the sleeve 23*b* by using the magnetic force generated by the magnet roll 23*a*, and to be provided with a magnetic brush (not shown) on the surface of the sleeve 23*b*.

Moreover, onto the development roller 23, a development bias (for example −400V) that is more positive than a surface potential (for example −600V) of the photoreceptor 1.

That is, in the development region 4, the development roller 23 supplies the toner 61 to the photoreceptor 1 so as to develop the electrostatic latent image. Whereas, in the upstream of the development region 4 in the direction of the arrow R, the development roller 23 performs electrostatic removal (electrostatic attraction) or mechanical removal of the negatively electrified foreign material left over on the surface of the photoreceptor 1. The removal is performed by brushing off the negatively electrified foreign material left over on the surface of the photoreceptor 1.

Note that, the negatively electrified foreign material (especially the negatively electrified left-over toner 61*a*) attracted onto the development roller 23 is returned to the developer tank 22 in accordance with the rotation of the development roller 23, the developer tank 22 being provided beyond the development roller 23 with respect to the photoreceptor 1. Thereafter, the negatively electrified left-over toner 61*a* is subjected to sufficient agitation electrification in the developer tank 22 by using an agitating roller (not shown) provided in the developer tank 22.

Next, printing process of the present printing apparatus is briefly explained.

Firstly, the surface of the photoreceptor 1 is evenly electrified by the electrification apparatus 51. Next, the thus evenly electrified surface of the photoreceptor 1 is exposed to the laser beam 12 radiated from the laser beam source 11*a* of the LSU 11. The exposure is carried out line by line in a main scanning direction while modulating the laser beam 12 based on the image data externally inputted. In this way, the electrostatic latent image is formed on the photoreceptor 1 (Exposure Step).

Next, when the electrostatic latent image passes the development region 4 in accordance with the rotation of the photoreceptor 1, the development apparatus 21 (development roller 23) supplies the toner 61 to the latent image. Hereby, the toner 61 is electrostatically attracted on exposed portion of the electrostatic latent image, so that the electrostatic latent image is visualized as the toner image (converted into the toner image) (Development Step).

Then, when the toner image on the photoreceptor 1 passes through the nip section (transcription region) between the photoreceptor 1 and the transcription apparatus 31, the toner image on the photoreceptor 1 is transcribed on the sheet P that is supplied from a sheet-feeding cassette (not shown) (Transcription Step).

Thereafter, the sheet P is transferred to a fixing apparatus (not shown). The toner image is fixed onto the sheet P by the fixing apparatus, so as to permanently visualize the toner image on the sheet P. Then, the sheet P on which the toner image is fixed is delivered out into a delivery-out tray (not shown) by using a delivery-out roller (not shown).

Moreover, left-over materials such as the left-over toner that is not transcribed on the sheet P in the transcription region and left over on the photoreceptor 1, is agitated (stirred) by the conductive brush 42 so that no cluster of the left-over materials will be formed. While the conductive brush 42 agitating the left-over materials, the conductive brush 42 also applies, on the left-over materials, a positive agitating voltage (DC) that is identical to the transcription bias in terms of polarity.

After that, the positively electrified left-over materials on the photoreceptor 1, especially the positively electrified left-over toner 61*b* and the carrier 62 are magnetically or electrostatically attracted onto the electrification roller 52 in the upstream of the electrification region 5 in the direction of the arrow R, whereby the photoreceptor is cleaned with respect to the positively electrified left-over materials. Then, the left-over materials attracted onto the electrification roller 52 is removed from the electrification roller 52 by using the cleaning film 54, and returned to the developer tank 22 (First Cleaning Step).

Moreover, in the upstream of the development region 4 in the direction of the arrow R, the negatively electrified left-over materials (negatively electrified left-over toner 61*a*), which is left over on the photoreceptor 1 after passing the electrification region 5 (in the downstream of the electrification region 5), is electrostatically or mechanically removed by brushing carried out by the use of the magnetic brush provided to the development roller 23. Then, the negatively electrified left-over materials are returned to the developer tank 22 (Second Cleaning Step).

Then, the photoreceptor 1 from which the left-over materials are removed is evenly electrified again by the electrification roller 52, and the exposure, development, transcription, first and second cleaning steps are repeated for the next printing.

As described above, the present removing system is so arranged that the positively electrified foreign material left over on the photoreceptor 1 is removed (attracted) by the electrification roller 52, whereas the negatively electrified foreign material is removed (attracted) by the development roller 23.

The present removing system eliminates a need of a special cleaning apparatus (such as a cleaning blade) for removing the foreign material left over on the photoreceptor 1. This makes it possible to miniaturize the present printing apparatus.

Moreover, the use of the present removing system prevents also makes it possible to prevent occurrence of film attrition and friction-caused damage of the photoreceptor 1 caused in case where a cleaning blade is used, and to reduce load torque of the photoreceptor 1.

Moreover, the electrification apparatus 51 is provided with the cleaning film 54 for cleaning the surface of the electrification roller 52 by removing the foreign material adhered on the electrification roller 52.

This arrangement prevents the foreign material (left-over toner) from accumulating on the electrification roller 52. Therefore, it is possible to prevent deterioration of electrification characteristics of the electrification roller 52 and abnormal electric discharge from the electrification roller 52. Hereby, the electrification roller 52 is given stable electrification characteristics. Therefore, it is possible to avoid occurrence of image fogging (in which adjacent images are printed overlapping each other).

Figure 2:
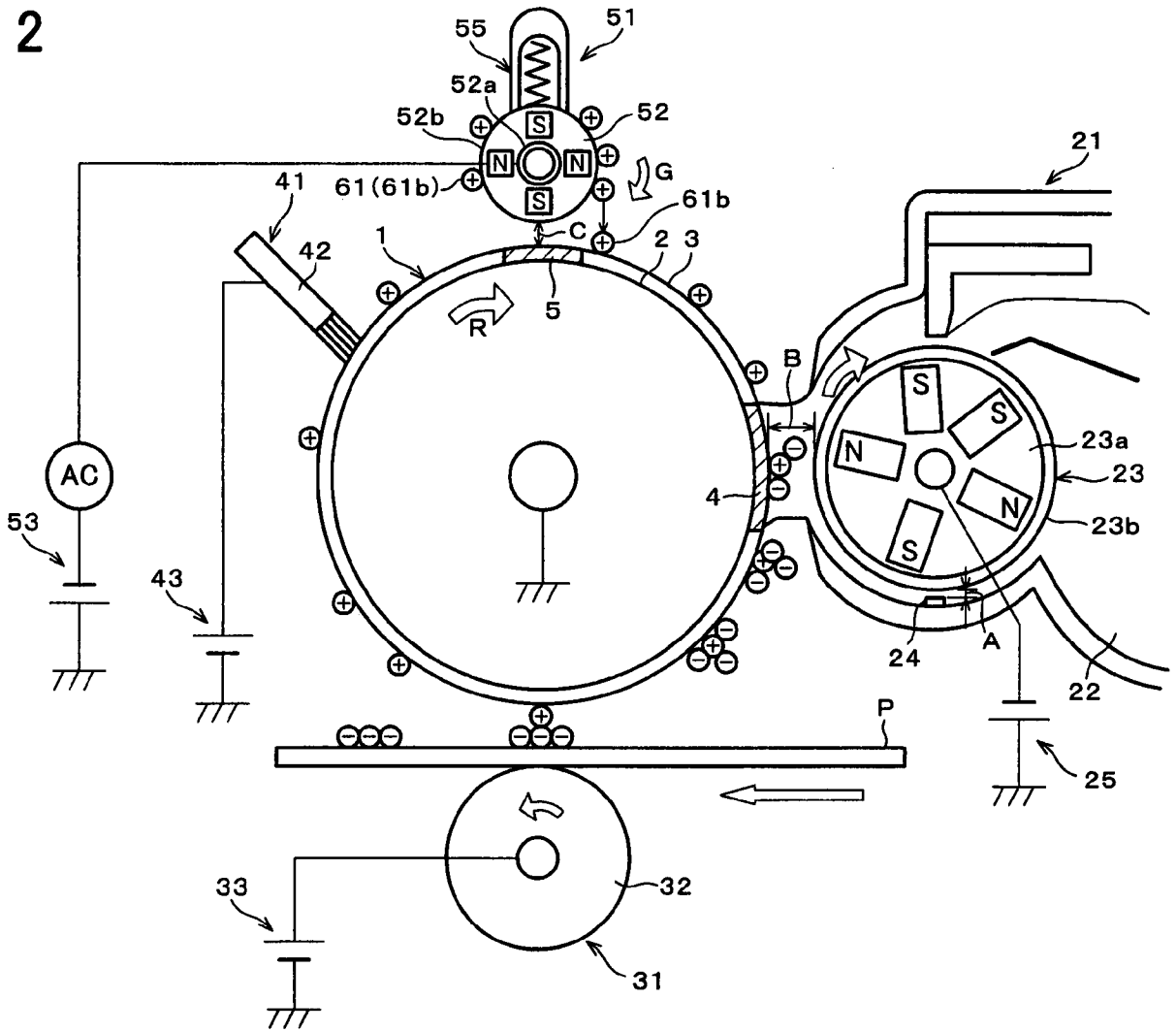
FIG. 2 is an explanatory view for illustrating a condition under which a foreign material attracted on an electrification roller is returned to the photoreceptor in case where there is no cleaning film.

Moreover, in case where no cleaning film 54 is provided, there is a possibility that the foreign material (the positively electrified left-over toner 61*b*) that is attracted onto the electrification roller 52 returns to the photoreceptor 1 again as shown in FIG. 2.

On the contrary, in the present printing apparatus, the positively electrified left-over toner 61*b* is recovered into the developer tank 22 by using the cleaning film 54, thereby preventing the positively electrified left-over toner 61*b* from returning to the photoreceptor 1.

Moreover, the electrification apparatus 51 is so arranged that the foreign material, such as the positively electrified left-over toner 61*b*, that is removed from the electrification roller 52 by the cleaning film 54 is returned into the developer tank 22. This arrangement causes the positively electrified left-over toner 61*b* to be subjected to sufficient agitation electrification, as in the negatively electrified left-over toner 61*a*. As a result, it is possible to recycle the positively electrified left-over toner 61*b*.

Moreover, the provision of the cleaning film 54 eliminates a need of a recovering apparatus for recovering the foreign material on the photoreceptor 1, in addition to the electrification apparatus 51. This leads to simplification of the structure of the printing apparatus.

Moreover, the electrification apparatus 51 is so arranged that the electrification roller 52 rotates in the same direction as the photoreceptor 1 (the electrification roller 52 performs the against rotation with respect to the photoreceptor 1).

That is, in case where the electrification roller 52 and the photoreceptor 1 respectively rotate in opposite directions (with rotation; the closest portions of them move in the same directions (facing surfaces of them move in the same direction in a place where the distance between them is shortest), the foreign material on the photoreceptor 1 is attracted onto the electrification roller 52 in the upstream of the electrification region 5. This allows the foreign material to pass through the electrification region 5. While passing the electrification region 5, the foreign material is sandwiched between the electrification roller 52 and the photoreceptor 1. Then, the foreign material is removed from the photoreceptor 1 in the downstream of the electrification region 5.

This allows foreign material having a large size to be stuck in the electrification gap, thereby increasing load on the rotation of the electrification roller 52. Moreover, if the foreign material thus stuck in the electrification gap is comparatively hard, (for example, the stuck foreign material is the carrier 63), there is a possibility that the stuck foreign material gives a damage onto the surfaces of the photoreceptor 1 and the electrification roller 52.

Further, in case of the with rotation, there is a possibility that the stuck foreign material cause abnormal electric discharge that leads to uneven electrification and damages on the photoreceptor and the electrification roller.

Moreover, when the foreign material such as the positively electrified left-over toner 61*b* passes through the electrification region 5 while sandwiched between the photoreceptor 1 and the electrification roller 52, the electrification bias electrifies the foreign material, whereas that portion of the photoreceptor 1 which is under the foreign material is not electrified (non-electrified region is produced). Because of this, an amount of the electrification (electrification amount) in the portion is so small that the toner required for the development is attracted onto the portion, even if the foreign material is removed by the development apparatus 21. This causes the image fogging.

On the other hand, in case the electrification roller 52 performs the against rotation with respect to the photoreceptor 1, the foreign material that is attracted onto the electrification roller 52 in the upstream of the electrification region 5 (upstream in the R direction) is so moved away from the electrification region 5 in accordance with the rotation of the electrification roller 52.

This arrangement prevents the foreign material on the photoreceptor 1 from passing through the electrification region 5 (electrification gap C), thereby preventing the foreign material from being stuck in the electrification gap C (and from damaging the photoreceptor 1 and the electrification roller 52), and preventing the production of such non-electrified portion in the photoreceptor 1.

Moreover, in the electrification apparatus 51, there is no need to have a wide electrification gap C in accordance with the large-sized foreign material (for example, the carrier 62) because the foreign material is prevented from entering the electrification gap C. Therefore, the electrification gap C may be narrow.

The narrow electrification gap C allows use of low electrification bias, as shown by "Paschen's experimental formula" which finds an break-down voltage of aerial electric discharge (aerial discharge). Further, the narrow electrification gap C leads to the miniaturization of the electrification apparatus 51.

Moreover, in case the electrification superimposing voltage is applied on the electrification roller 52, in the downstream of the electrification region 5, the surface of the photoreceptor 1 is so electrified as to have the substantially same potential as a DC component of the electrification superimposing voltage. Therefore, in case of the with rotation, there is a large reduction in capacity to statistically attract the positively electrified foreign material from the photoreceptor 1.

On the other hand, in case of the against rotation, the positively electrified left-over toner 61*b* is attracted onto the electrification roller 52 in immediate upstream vicinity of the electrification region 5 (from which the electrification of the photoreceptor 1 is started) in the rotation direction of the photoreceptor 1. Then, the positively electrified left-over toner 61*b* is transferred by the electrification roller 52. For this reason, the DC component of the electrification superimposing voltage can be effectively utilized for the electrostatic attraction of the positively electrified left-over toner 61*b*.

Further, in the reversal development, if foreign material (the positively electrified foreign material in the present embodiment) that is electrified in the opposite polarity to the toner used for the development is left over on the photoreceptor 1, the toner is easily attracted to the foreign material. Therefore, in case where such foreign material is left over in a non-exposed portion of the photoreceptor 1, it is a problem that the image fogging (uneven electrification; staining of white background) occurs frequently.

Moreover, in the electrification roller 52, the against rotation of the electrification roller 52 with respect to the photoreceptor 1 extends relative travel distance of the electrifying surface of the electrification roller 52 and the surface to be electrified of the photoreceptor 1.

This prevents electrification fluctuation due to local resistance value fluctuation in the electrification roller 52. Because of this, it is possible to improve the electrification property of the photoreceptor 1 (evenness in the electrification; more even electrification of photoreceptor 1)

Moreover, because of the against rotation of the electrification roller 52 with respect to the photoreceptor 1, the portion that is to be electrified next enters the electrification region 5 (electrification gap C) from the downstream thereof. Thus, even if electrification of capacitance component in the electrification roller 52 causes voltage drop in accordance with the electrification operation of the photoreceptor 1, it is possible to alleviate the reduction in the electrification potential for the photoreceptor 1 due to the internal voltage drop.

Moreover, in the downstream of the electrification region 5, the surface potential of the photoreceptor 1 is increased as the electrification proceeds. Because of this, the increase in the surface potential reduces electrification current density (with respect to area), thereby alleviating the electrification potential reduction of the photoreceptor 1 due to the voltage drop caused by the resistance component inside the electrification roller 52.

In case the resistance of the electrification roller is high, the voltage drop due to the electrification of the capacitance component, and the voltage drop due to the resistance component become remarkable. This makes it difficult to increase potential of the photoreceptor 1 to the regular electrification potential. Thus, the foregoing effect becomes especially remarkable when the resistance of the electrification roller is high.

Moreover, the electrification apparatus 51 is so arranged that the electrification superimposing voltage is applied on the electrification roller 52, the electrification superimposing voltage being prepared by adding an AC component in the negative DC voltage (the AC component having peak-to-peak voltage of 1.8 kV and frequency of 900 Hz is added into the DC component of −600V).

With this arrangement, it is possible to evenly electrify the surface of the photoreceptor 1 by using the negative DC component, and to electrostatically attract the positively electrified foreign material (especially the positively electrified left-over toner 61*b*) onto the electrification roller 52.

Further, by using the AC component, it is possible to vibrate (agitate, swing) the positively and negatively electrified foreign material on the surface of the photoreceptor 1. This facilitates the removal of the foreign material from the photoreceptor 1, and attains efficient electrostatic attraction of the positively electrified left-over toner 61*b*. As a result, it is possible to improve the efficiency of the removal of the positively electrified left-over toner 61*b*.

Specifically, the superimposing of the AC component on the DC component exerts an AC electrostatic force on the positively electrified left-over toner 61*b* located on the photoreceptor 1 in the vicinity of an entering position to the electrification region 5 (in the immediate upstream of the electrification region 5 in the direction of the arrow R).

This facilitates the removal of the positively electrified left-over toner 61*b* from the photoreceptor 1, and causes the positively electrified left-over toner 61*b* to be cloudy after the removal. This improves the electrification roller 52 in attraction efficiency (this allows the electrification roller 52 to perform more efficient attraction of the left-over material).

Note that, microscopically, there is a timing at which the positively electrified left-over toner 61*b* is affected by repulsion from an AC electric field. However, overall, the effect of the DC component realizes the efficient attraction of the positively electrified left-over toner 61*b*.

Moreover, in the electrification apparatus 51, the electrification roller 52 is a magnetic roller provided with the magnet below the resistance layer 52*b*. With this arrangement, it is possible to remove the foreign material on the photoreceptor 1 not only by the electrostatic force but also by the magnetic force (magnetic attraction force).

Specifically, in case the carrier 62 having a large mass is to be electrostatically attracted, the load on the electrification roller 52 is so large that the attraction efficiency is deteriorated. On the other hand, the attraction efficiency can be improved by the arrangement in which the magnetic attraction force together with the electrostatic force is applied.

Table 1 shows an effect caused by attraction of the toner 61 and carrier 62 by the electrification roller 52.

TABLE 1

| LODC | RECOVERED | NOT RECOVERED |
|---|---|---|
| CARRIER | GOOD IMAGE | -IMAGE WITH BLACK STRIPE *<br>-PHOTORECEPTOR DAMAGED |
| TONER | GOOD IMAGE | -IMAGE FOGGING |

Abbreviation:
LODC refers to Left-Over Developer Component
*The carrier is being stuck.

As shown in Table 1, a good image can be obtained by attracting the toner 61 and carrier 62 by using the electrification roller 52.

Moreover, in the present removing system, the foreign material agitating apparatus 41 including the conductive brush 42 is provided in the upstream of the electrification region 5.

With this arrangement, the agitation (stirring) of the foreign material on the photoreceptor 1 allows the electrification roller 52 and the development apparatus 21 to perform more efficient attraction.

Moreover, the foreign material agitating apparatus 41 is provided with the conductive brush 42 having a brush structure. Because of this, the foreign material that has been crumbled, pass through gaps of fibers of brushes. This prevents the foreign material from being stuck at the conductive brush 42, thereby permitting of good agitation of the foreign material. Further, this arrangement prevents damaging the surface of the photoreceptor 1.

Moreover, the conductive brush 42 applies the positive agitating voltage on the foreign material (such as the left-over toner and the like).

This causes the positive electrification shift of the foreign material on the photoreceptor 1 so that the majority of the left-over material is positively electrified (in positive polarity). Because of this it is possible to allow the electrification roller 52 to perform more efficient attraction of the foreign material.

Moreover, the agitating voltage takes an electric charge from the foreign material (toner 61), the electric charge being set in developing. Because of this, it is possible to prevent the image noise (black spot) due to the toner image memory, even if the removal of the toner 61 from the photoreceptor 1 is failed and the toner 61 enters the transcription region again.

Moreover, the agitating voltage of the conductive brush 42 flattens a left-over potential that is left over on the photoreceptor 1 (the conductive brush 42 causes the left-over potential to be even), and enables adjustment of a potential of the photoreceptor and a voltage of the foreign material.

Moreover, the present printing apparatus is so arranged that (i) the negatively electrified foreign material (especially the negatively electrified left-over toner 61*a* that is left over on the photoreceptor 1) is attracted and revered by using the development roller 23, (ii) the negatively electrified left-over toner 61*a* thus recovered is returned into the developer tank 22, and (iii) the agitating roller in the developer tank 22 gives sufficient agitation electrification to the negatively electrified left-over toner 61*a* thus returned.

This arrangement permits adjusting, to a predetermined value, the electric charge of the negatively electrified left-over toner 61*a* thus recovered. Thus, it is possible to reuse the negatively electrified left-over toner 61*a*. As a result, it is possible to prevent toner image memory and recycle the negatively electrified left-over toner 61*a* thus recovered.

The following explains how the foreign material agitating apparatus 41 of the present removing system applies an alternating voltage on the conductive brush 42.

As described above, the present removing system, almost all of the toner 61 is in negative polarity before the toner 61 reaches the transcription region. Then, in case the toner 61 is left over on the photoreceptor 1 beyond the transcription region, the electrification of the left-over toner is broadly distributed in terms of electrification amount, due to transcription bias of +2 kV. As a result, the overall (average) electrification of the left-over toner is positive. Here, the majority of the left-over toner is the positively electrified left-over toner 61*b* while a slight amount of the negatively electrified left-over toner 61*a* also exists therein.

Further, the foreign material agitating apparatus 41 is so arranged that the agitating voltage power source 43 applies the positive agitating voltage on the conductive brush 42 so as to cause the positive electrification shift of the left-over toner (and the other foreign material) so that the majority of the left-over toner is in positive polarity, that is, the amount of the positively electrified left-over toner 61*b* located on the photoreceptor 1 is increased. This allows the electrification roller 52 to perform more efficient attraction.

However, there is a possibility that such agitation using the conductive brush 42 causes the left-over toner to adhere and accumulate on the conductive brush 42.

Specifically, the distribution of the electrification amount of the left-over toner indicates averagely positive. However, the left-over toner includes (i) ones that are weakly positively electrified and have week electrostatic repulsion force, (ii) ones that are not electrified, and (iii) in a slight amount, ones that are negatively electrified.

Such left-over toner is attracted and accumulated on the conductive brush 42 by the intermolecular force, adhesive force, and the like working between the conductive brush 42 and the left-over toner (as to the negatively electrified left-over toner, a synergistic effect of (a) the intermolecular force and the adhesive force, and (b) the electrostatic attraction force is applied).

Thus, the present removing system is so arranged that, in accordance with user's instructions, the agitating voltage power source 43 applies, onto the conductive brush 42, a superimposing voltage prepared by superimposing a direct current voltage (DC bias) on an alternating voltage (agitating superimposing voltage: AC superimposing bias). Here, the superimposing voltage is the agitating voltage.

Such agitating superimposing voltage has an amplitude of 1 kVp-p, a frequency in a range between 500 and 2000 Hz, and a DC bias of +500V, where a process speed is 130 mm/s, for example.

Figure 3:
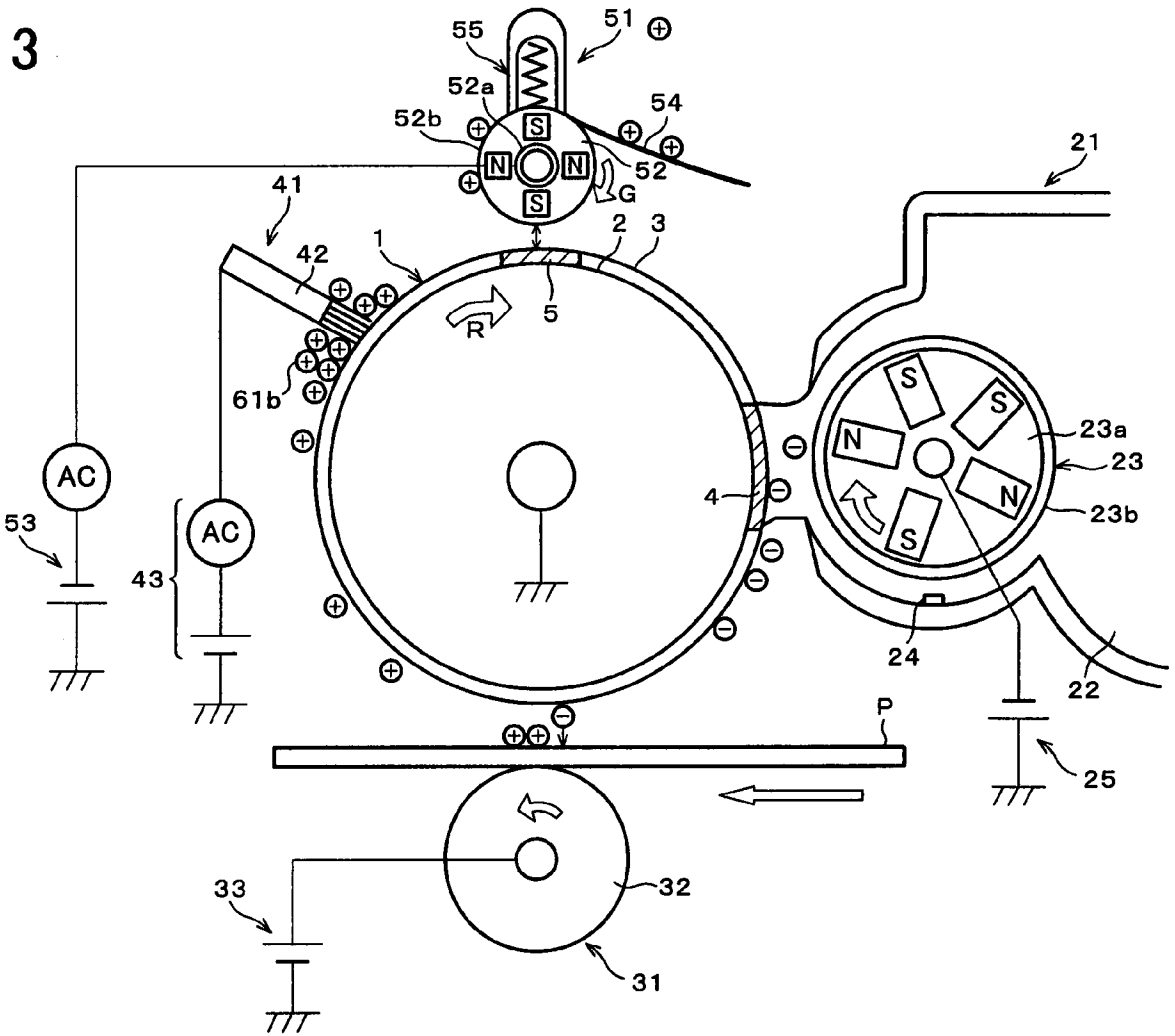
FIG. 3 is an explanatory view for illustrating a condition under which a positively electrified left-over toner is deposited on a conductive brush of the printing apparatus shown in FIG. 1.
Figure 4:
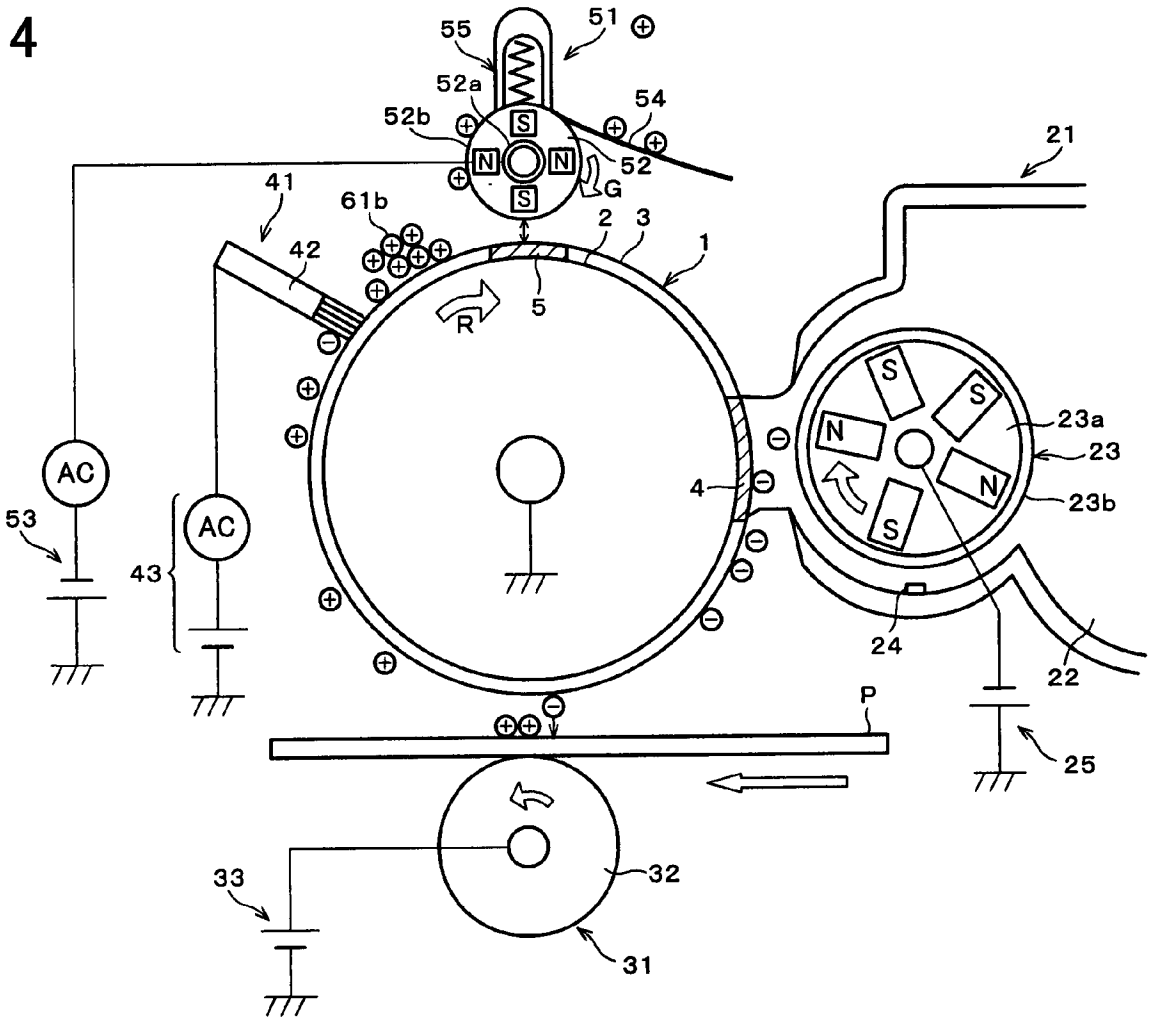
FIG. 4 is an explanatory view for illustrating a condition under which the positively electrified left-over toner is removed from the conductive brush of the printing apparatus shown in FIG. 1.

With this arrangement, as shown in FIG. 3, a (positive) voltage instantaneously applied on the conductive brush 42 is large, even if the positively electrified left-over toner 61*b* is accumulated at the conductive brush 42. Thus, as shown in FIG. 4, it is possible to electrically remove the positively electrified left-over toner 61*b* from the conductive brush 42.

Moreover, because the voltage of the conductive brush 42 becomes negative in a moment, it is possible to remove the negatively electrified left-over toner 61*a* attached on the conductive brush 42.

Further, by applying the agitation superimposing voltage by using the agitating voltage power source 43, it is possible to fluctuate (vary) polarity and amount of the electrostatic power on the left-over toner 61*a* and 61*b* that attach on the conductive brush 42.

Therefore, the electrostatic agitation of the left-over toner 61*a* and 61*b* makes it possible to remove, from the conductive brush 42, the left-over toner 61*a* ad 61*b* that attach on the conductive brush 42 by the intermolecular force and adhesive force.

Moreover, there is a timing at negative shift of the electrification amount (negative electrification shift) of the left-over toner on the photoreceptor 1 is caused by application of such agitating superimposing voltage on the agitating voltage power source 43. When this region enters the electrification region, there is a possibility that there is a time at which efficiency of the recovery (recollection) of the left-over toner 61 by the electrification roller 52 is slightly lower.

However, in the present removing system, not only the positively electrified left-over toner 61*b* is recovered by the electrification roller 52, but also the negatively electrified left-over toner 61*a* is recovered by the development roller 23 performing the against rotation with respect to the photoreceptor 1 (the negatively electrified left-over toner 61*a* is mechanically and electrostatically recovered by the magnetic brush performing the against rotation with respect to the photoreceptor 1). Therefore, the present removing system has no such problem.

Moreover, the surface, which the conductive brush 42 touches, of the photoreceptor 1 is a non-image region (is not an image region) in applying the agitating superimposing voltage as the agitating voltage.

Here, the image region is a region which is part of the surface of the photoreceptor 1 and in which an image is formed (which is exposed) in one cycle of the photoreceptor 1 between a time at which the region is in front of the conductive brush 42 to a time at which the region returns to in front of the conductive brush 42.

On the other hand, the non-image region is a region which is the other part of the surface of the photoreceptor 1 except the image region, (and in which no image is formed (which is not exposed) in one cycle of the photoreceptor 1 between a time at which the region is in front of the conductive brush 42 to a time at which the region returns to in front of the conductive brush 42).

When the agitating superimposing voltage is used as the agitating voltage to be applied on the conductive brush 42, the left-over toner attached and accumulated on the conductive brush 42 is moved to the surface of the photoreceptor 1. This increases an amount of the left-over toner existing on that part of the surface to which the left-over toner is moved. There is a possibility that all the left-over toner cannot be removed from such region by the electrification roller 53 and the development roller 23. If an image is formed in such region, there is a possibility that failure in electrification and exposure is caused thereby deteriorating the image.

In view of this, the present removing system that the agitating voltage power source 43 applies the agitating superimposing voltage on the conductive brush 42 when the non-image region comes to where the conductive brush 42 is (when the conductive brush 42 touches the non-image region), so as to remove the left-over toner accumulated on the conductive brush 42. With this arrangement, it is possible to prevent such image deterioration mentioned above.

Here, the non-image region of the photoreceptor 1 may be, for example, a region that is located in front of the LSU 11 in pre-rotation time and post-rotation time, and a region that corresponds to a gap between sheets in case of multiple printing (in which plural sheets are printed).

Note that the pre-rotation time is a time (printing preparation time) in which a series of operation to make the present printing apparatus ready for printing is carried out prior to the printing when printing instructions (print execution command) is received from outside. The operation to make the present printing apparatus ready for printing is warming-up of the fixing apparatus, the electrification of the developer 60 in the developer tank 22, starting of the electrification apparatus 51, and the like operation.

Moreover, the post-rotation time is a time (stopping preparation time) in which a series of operation that stops the printing apparatus is carried out after the last image formation (exposure) in accordance with the printing instructions is completed. The operation that stops the present printing apparatus is delivery-out of the sheet, stopping of the electrification, and the like operation.

Moreover, a control section (not shown) provided to the present printing apparatus (or the present removing system) judges whether or not a region on the photoreceptor 1 is the non-image region.

The control section controls all of (or part of) the operation (such as the printing and the removing the foreign material) of the present removing system. Particularly, the control section controls the present removing system (especially, the agitating voltage power source 43) in accordance with instructions from a user (user's instruction), or instructions from a sensor for measuring an amount of the left-over toner attached on the conductive brush 42, or the like instructions. The control section adjusts a type of the agitating voltage to be applied on the conductive brush 42 (whether the agitating voltage is the direct current voltage or the superimposing voltage).

Moreover, in the present removing system that the (direct current) agitating voltage to be applied on the conductive brush 42 by the agitating voltage power source 43 is of the same polarity as the transcription bias, that is, of positive polarity, as described above. Moreover, the direct current voltage (DC bias) of the agitating superimposing voltage to be applied on the conductive brush 42 by the agitating voltage power source 43 is of positive polarity.

Table 2 shows image quality (whether there is toner image memory or not) (a) in case a direct current voltage of +500V is applied as the agitating voltage, (b) in case a direct current voltage of −500V is applied as the agitating voltage, (c) no agitating voltage is applied (floating), and (d) in case the conductive brush 42 is earthed (0V). Here, a conductive brush 42 having a resistance of $10^4$ Ω·cm was used.

TABLE 2

| Brush Bias | +500 V | Earthed | Floating | −500 V | No Brush |
|---|---|---|---|---|---|
| Image | Image Memory Absent | Image Memory Present | Image Memory Present | Image Memory Present | Image Memory Prominently Present |

Figure 5:
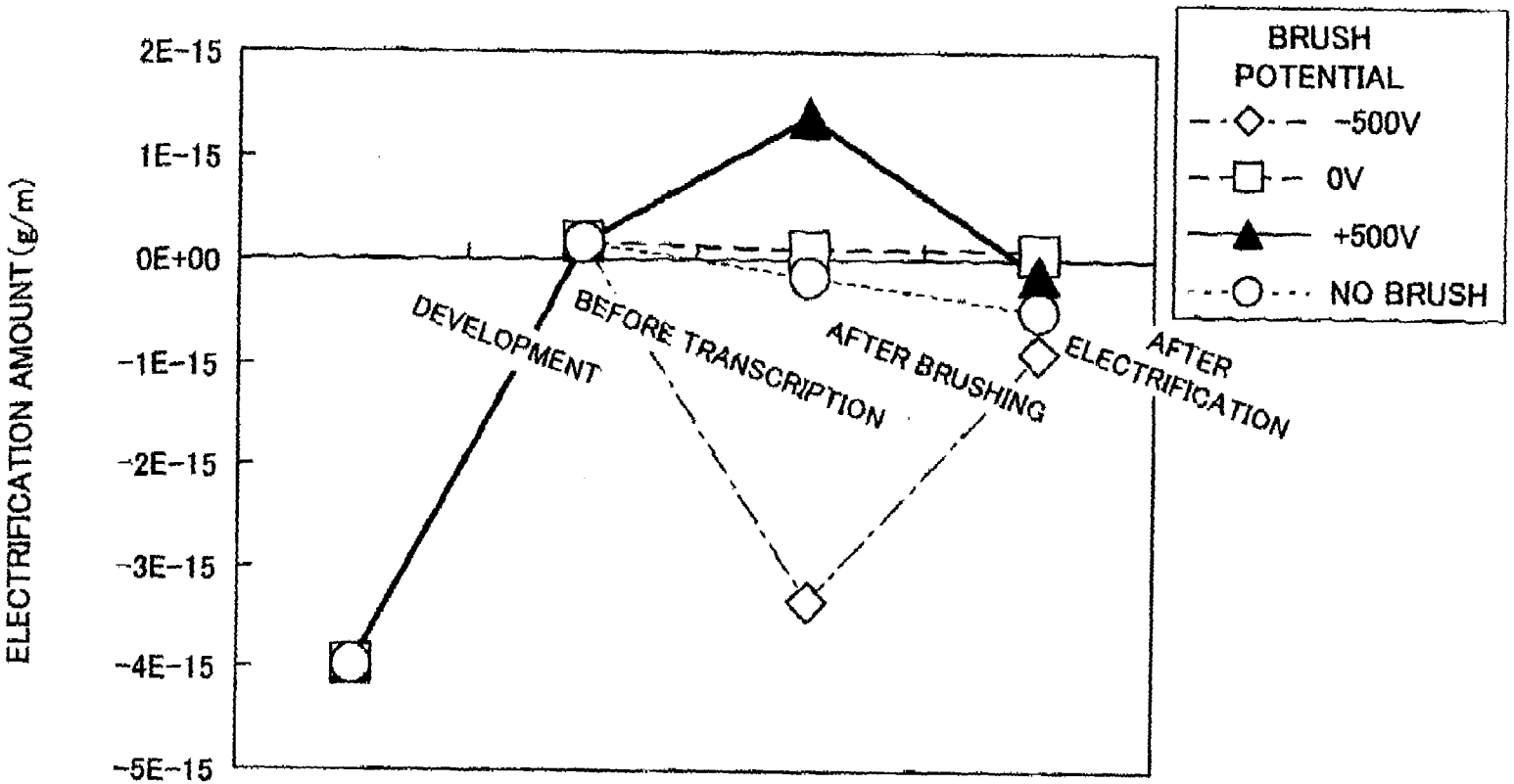
FIG. 5 is a graph showing a relationship between a brush bias (agitating bias) and an electrification amount of toner.

Moreover, FIG. 5 is a graph showing results of measurement of the electrification of the toner 61 in the cases (a), (b), and (c), (i) when developing, (ii) just before transcription (the transcription has not been performed yet), (iii) after passing the conductive brush 42, and (iv) after electrification of the electrification roller 52.

Note that in FIG. 5 the vertical axis indicates the amount of the electrification (C) of the toner 61, while the horizontal axis indicates state (timing) of (i) to (iv). Moreover, in FIG. 5, "◇" indicates (b), "□" indicates (d), "▲" indicates (a), and "○" indicates a case where no conductive brush 42 is used (no brush).

As indicated in FIG. 5, it was found that the amount of the positively electrified left-over toner 61*b* was increased when the direct current voltage of +500V is applied on the conductive brush 42.

Moreover, the result shown in Table 2 shows that the toner image memory can be suppressed significantly by increasing the positively electrified left-over toner 61*b* by using the conductive brush 42 (that is, electrification amount (initial electric charge) that the toner 61 has during the development, is lost).

Moreover, when the direct current component of the agitating voltage to be applied on the conductive brush 42 is negative, the positively electrified left-over toner 61*b*, which is the majority of the left-over toner, is attracted to the conductive brush 42. Such attraction of the large amount of the positively electrified left-over toner 61*b* can be prevented by arranging such that the direct current component of the agitating voltage is of the same polarity as the transcription bias as described above.

Moreover, in the present removing system, the direct current component of the agitating superimposing voltage to be applied on the conductive brush 42 by the agitating voltage power source 43 is equal to or higher than an break-down voltage. With this arrangement, the electrification roller 52 attracts the positively electrified foreign material more efficiently.

This is because insulating materials to which an electric charge cannot be introduced easily, can be electrified by applying thereon a voltage equal to or higher than the break-down voltage, as already well known for a contact type electrification roller. Therefore, by applying such agitating voltage having the direct current component equal to or higher than the break-down voltage, it becomes possible to pass an effective electrification current though the toner (non-conductive toner) to which an electric charge cannot be introduced with ease (which cannot be electrified easily) and that is located on the photoreceptor 1. This ensures electrification of the toner.

Moreover, in case where the direct current component of the agitating voltage to be applied on the conductive brush 42 is equal to or higher than the break-down voltage, the surface, which the conductive brush 42 touches, of the photoreceptor 1 is the non-image region (not the image region), because of the aforementioned reasons.

Moreover, the agitating superimposing voltage to be applied on the conductive brush 42 as the agitating voltage is a voltage for vibrating the conductive brush 42 by an electrostatic force.

With this arrangement, it is possible to shake off the left-over toner that attaches on the conductive brush 42, thereby attaining more efficient removal of the left-over toner. Therefore, it is possible to improve a capability of cleaning the conductive brush 42.

Note that in case the conductive brush 42 is vibrated, it is possible to attain more efficient vibration of the conductive brush 42 by vibrating the conductive brush 42 at a frequency in vicinity of a character frequency (eigen frequency) of the conductive brush 42.

Provided below is a detailed explanation on the vibration (electrostatic vibration) of the conductive brush 42 caused by an electrostatic force.

Each fiber of the conductive brush 42 is made of an elastic material, and can be used as a beam. Specifically, when the agitating superimposing voltage is applied on the conductive brush 42, the electrostatic force is caused between the conductive brush 42 and the photoreceptor 1. The electrostatic force is composed of an image force and a coulomb force. The image force is irrelevant to polarity and has only attraction force. The coulomb force has an attraction force or a repulsion force depending on polarity given thereto by the electric charge of the surface of the photoreceptor 1. Here, a surface of a base member (aluminum drum) of the photoreceptor 1 is a boundary. The image force works on one side of the boundary and the coulomb force work on another side of the boundary. For example, in case where the image force is greater than the coulomb force, for example in case where a surface potential of the photoreceptor 1 is 0V, the electrostatic force has a frequency component two times greater than that of the alternating component (AC component). On the other hand, in case where the coulomb force is greater than the image force, the electrostatic force has a frequency component equal to that of the alternating component (AC component).

This arrangement causes vibration (oscillation; excitement) of the conductive brush 42.

Note that the conductive brush 42 is electrostatically vibrated at a larger frequency in case where the alternating component of the electrostatic force caused by the agitating superimposing voltage has a frequency close to the character frequency of the conductive brush 42, that is, in case where the agitating superimposing voltage has a frequency component that is equimultiple of or a half of the character frequency of the conductive brush 42.

Moreover, in calculating the character frequency of the conductive brush 42, each fiber is regarded one beam, as described above.

Specifically, the calculation as a moving beam is carried out by taking that contact points of the fibers with the photoreceptor 1 (tip ends of brush fibers) are regarded as supporting ends, whereas in case where bottom ends are fixed by using a resin, bottom ends thereof are regarded as a fixing end. Moreover, in the brush fibers are transplanted, bottom ends thereof are regarded as second supporting ends.

The following briefly explains the calculation of the character frequency of the beam The character frequency f(Hz) is obtained by the following Equation (1), where a particle diameter of the beam is d(cm), a length thereof is L(cm), a modulus of longitudinal elasticity is E(kg/cm$^2$), a geometric moment of inertia is I(cm$^4$), a cross sectional area is A(cm$^2$), a weight per unit volume is $\gamma$(kg/cm$^3$), a gravitational acceleration is g=981(cm/s$^2$), and a coefficient based on boundary condition is $\lambda$.:

$$f=\lambda^2/(2\pi\cdot L^2)\cdot(E\cdot I\cdot g/(\gamma\cdot A)^{1/2} \quad (1),$$

where $I=(\pi/64)\cdot d^4$, for fixing end–supporting end, $\lambda=3.927$, for supporting end–supporting end, $\lambda=n$.

Note that those equations are explained in detail in a reference 8, "Japan Machinery Academy "Machine Manual Fifth Edition" (published on Aug. 10, 1974 (fifth impression).

Moreover, the tip ends of the brush fibers touch the photoreceptor 1 in such a manner that the tip ends can freely move on the photoreceptor 1. Thus, there is no limit in angles the tip ends have. Therefore, it is appropriate to regard the tip ends as the supporting ends (however, the tip ends becomes free ends when an intensive vibration (excitement) is applied so that the tip ends are not in contact with the surface of the photoreceptor 1).

Moreover, in case where the bottom ends of the fibers are fixed by using a resin, the bottom ends are regarded as the fixing ends because the angles of the bottom ends are limited (fixed).

Further, in case where the brush fibers are transplanted, it is appropriate that the bottom ends are regarded as the supporting ends (second supporting ends) because there is a degree of freedom in the angle of the bottom ends.

As described above, in the present removing system, the conductive brush 42 is vibrated by the electrostatic force with the arrangement in which the agitating voltage power source 43 applies the agitating superimposing voltage on the conductive brush 42. Therefore, it is possible to more efficiently remove the left-over toner that attaches and accumulated on the conductive brush 42.

Moreover, it is not necessary to additionally have a special apparatus for mechanically vibrating the brush. Therefore, it is possible to reduce manufacturing cost, compared with such a brush that can mechanically move (movable brush; a kind of fur brush and the like).

Figure 6:
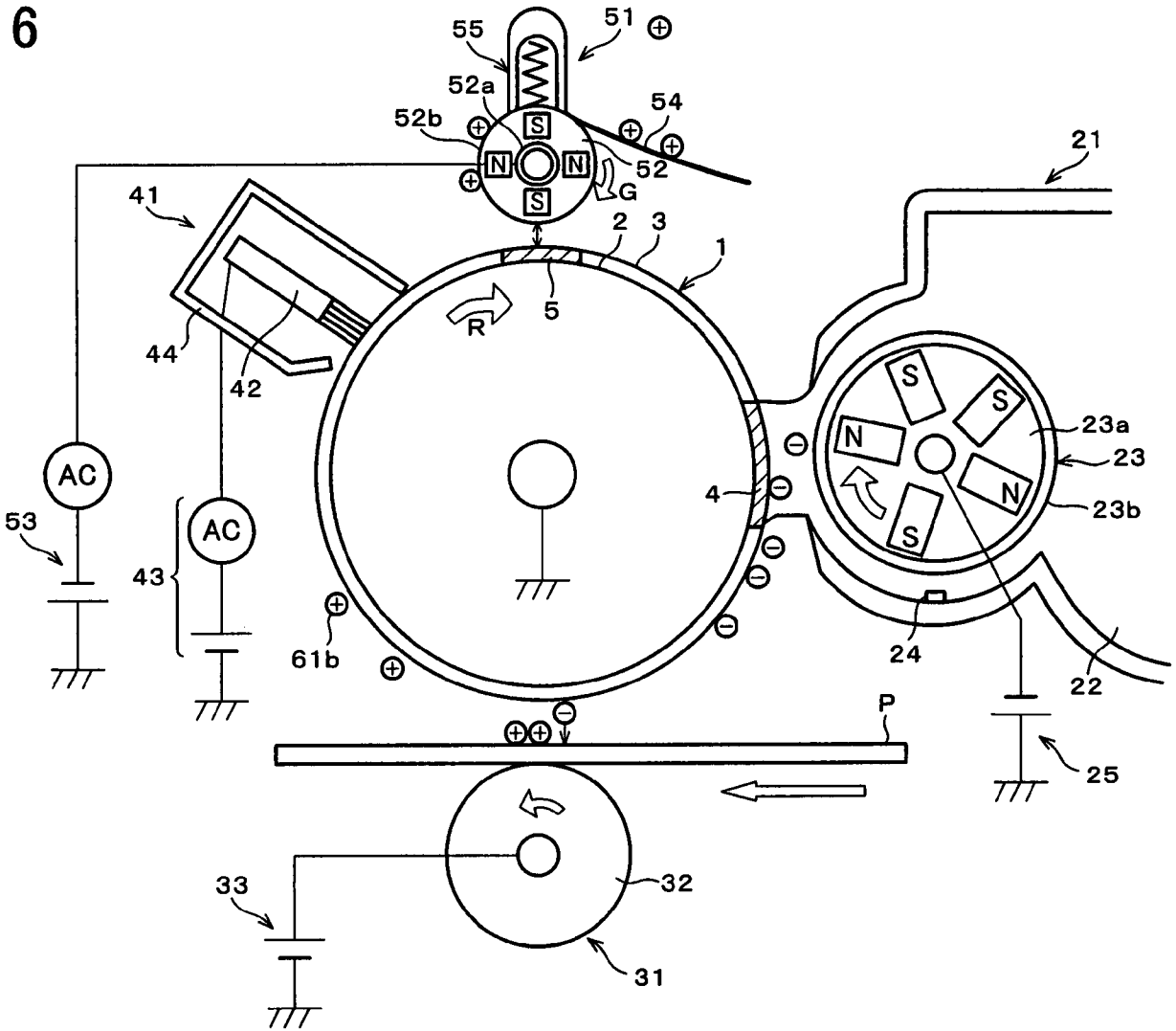
FIG. 6 is an explanatory view for illustrating an arrangement in which a foreign material agitating apparatus of the printing apparatus shown in FIG. 1 is provided with a housing for storing the conductive brush therein.

Moreover, as shown in FIG. 6, the foreign material agitating apparatus 41 is provided with a housing 44 for containing the conductive brush 42 therein (the conductive brush is contained in the housing 44).

In this arrangement, if the left-over toner that attaches on the conductive brush 42 is dropped or scatter (spatter), the left-over toner is kept inside of the housing 44 (or, it is possible to return the left-over toner on the surface of the photoreceptor 1). With this arrangement, it is possible to prevent (a) an inside of the present printing apparatus and (b) the sheet, from being stained by the dropping and scattering of the left-over toner.

Moreover, as described above, the removal of the left-over toner from the conductive brush 42 by the application of the agitating superimposing voltage is carried out when the non-image region of the photoreceptor 1 is positioned in front of the conductive brush 42.

Here, after being returned, there is a significant change in the amount of the electrification of the left-over toner returned from the conductive brush 42 to the photoreceptor 1. Further, because the left-over toner is returned to the non-image region of the photoreceptor 1 at once during the cleaning operation of the conductive brush 42 (removal of the left-over toner attached on the conductive brush 42), a large amount of the left-over toner is present locally in the non-image region.

Thus, the transcription roller 32 is floated (in a floating state in which the transcription roller 32 is electrically floated in air by removing all the electric contacts connected thereto (being isolated electrically)), when the non-image region on which the left-over toner that has been removed from the conductive brush 42 enters the transcription region. With this arrangement, it is possible to prevent the left-over toner from attaching (being electrostatically attracted) on the transcription roller 32 due to an intensive electric field caused by the transcription bias even in case where the left-over toner that has not been recovered via the electrification roller 52 and the development roller 23 is transferred to the transcription region.

This avoids staining of the transcription roller 32. Hereby, it is possible to prevent such left-over toner from being transcribed (transferred) on a reverse side of the sheet, thereby preventing staining of a reverse side of the sheet.

Moreover, in this case, if it is so arranged that application of the transcription bias onto the left-over toner located on the photoreceptor 1 is prevented, there is no need of floating the transcription roller 32.

For example, it may be so arranged that, when the non-image region, in which the left-over toner removed from the conductive brush 42 exists, enters the transcription region, the transcription bias power source 33 is stopped, instead of floating the transcription roller 32.

Moreover, in the present embodiment, it is so arranged that the agitating superimposing voltage to be applied on the conductive brush 42 has the amplitude of 1 kVp-p, the frequency of 500 Hz to 2000 Hz, and the DC bias of +500V. However, the specification of the agitating superimposing voltage is not limited to this, provided that the specification of the agitating superimposing voltage attains efficient removal of the left-over toner from the conductive brush 42. The specification of the agitating superimposing voltage is set according to types of the toner 61 and the carrier 62, the material of which the photoreceptor 1 is made of, the electrification distribution of the left-over toner, the process speed, and the like, so as to attain efficient removal of the left-over toner from the conductive brush 42.

Moreover, in the above, both of the left-over toner 61*a* and 61*b* attached on the conductive brush 42 are removed by applying the alternating voltage (alternating electric field) onto the conductive brush 42 by using the agitating voltage power source 43.

However, the present invention is not limited to this. Even with an arrangement in which a direct current agitating voltage is applied on the conductive brush 42, by alternately switching the polarity of the direct current agitating voltage, it is also possible to remove both of the left-over toner 61*a* and 61*b* attached on the conductive brush 42.

This is because application of the positive agitating voltage on the conductive brush 42 enables the removal of the positively electrified left-over toner 61*b* from the conductive brush 42 whereas application of the negative agitating voltage on the conductive brush 42 enables the removal of the negatively electrified left-over toner 61*a* from the conductive brush 42.

Moreover, by adjusting a timing of switching the polarity of the (direct current) agitating voltage which the agitating voltage power source 43 applies on the conductive brush 42, it is possible to attain an effect almost similar to the effect attained in the case where the alternating agitating voltage is used.

Furthermore, by adjusting, depending on electrification characteristics of the left-over toner, a length of time in which the agitating voltage is positive, and a length of time in which the agitating voltage is negative (by arranging such that the length of time in which the agitating voltage is in the same polarity as the average polarity of the left-over toner, is longer), it is possible to attain efficient control of the attraction of the left-over toner.

Moreover, in the present embodiment, the agitating voltage power source 43 of the present removing system usually applies a direct current agitating voltage onto the conductive brush 42. However, for removing the left-over toner attached on the conductive brush 42, the agitating voltage power source 43 applies the agitating superimposing voltage onto the conductive brush 42.

However, it is not necessary to apply such agitating voltage on the conductive brush 42 always. In short, in a normal time, it is not necessary to apply a voltage on the conductive brush 42. In this case, the conductive brush 42 has only the function of agitating and crumbling the left-over toner located on the photoreceptor 1.

Moreover, it may be so arranged that, for removing the attached left-over toner, an alternating voltage having no direct current voltage is applied on the conductive brush 42.

Again in this arrangement, changing the polarity of the electrification of the conductive brush 42 makes it possible to remove, from the conductive brush 42, both of the left-over toner, that is, the negatively electrified left-over toner 61*a* and the positively electrified left-over toner 61*b*. Moreover, it is also possible to attain the vibration of the conductive brush 42 by switching over the polarities thereof. Further, it is also possible to attain the electrostatic vibration of the conductive brush 42.

Moreover, in the present embodiment, the conductive brush 42 agitates the left-over toner located on the photoreceptor 1. However, the present invention is not limited to this. The present invention may be so arranged that the conductive brush 42 does not agitate the left-over toner, but performs only the adjustment of the electrification of the left-over toner.

Moreover, the foreign material removing system of the present invention may be so expressed as foreign material removing system for removing foreign material left over on an image holding body of an electronic photography type printing apparatus, the foreign material removing system including an electrification adjusting member (conductive brush 42) for adjusting an amount of electrification of the foreign material located on the image holding body by touching the foreign material; and an attracting section for attracting, by using an attraction bias, the foreign material whose electrification is thus adjusted, electrification polarity of the electrification adjusting member being switched over alternately.

Furthermore, the foreign material removing system of the present invention may be so expressed as foreign material removing system for removing foreign material left over on an image holding body of an electronic photography type printing apparatus, the foreign material removing system including: an electrification adjusting member for adjusting electrification of the foreign material located on the image holding body by touching the foreign material; a power source (agitating voltage power source 43) for setting the electrification of the electrification adjusting member; and an attracting section for attracting, by using an attraction bias, the foreign material whose electrification is thus adjusted, the power source alternately switching over electrification polarity of the electrification adjusting member.

Further, the foreign material removing system of the present invention may be so expressed as foreign material removing system for removing foreign material left over on an image holding body of an electronic photography type printing apparatus, the foreign material removing system including: an agitating member for agitating the foreign material located on a photoreceptor; a power source; and an attracting section for attracting the agitated foreign material by an attraction bias, the agitating member being electrified in accordance with a voltage applied thereon by the power source and adjusting the electrification of the foreign material by touching the foreign material located on the image holding body, and the power source switching electrification polar of the electrification adjusting member alternately.

Moreover, in the present embodiment, the electrification apparatus 51 of the present printing apparatus is provided with the cleaning film 54. By using the cleaning film 54, the foreign material attracted onto the electrification roller 52 is scratched off so as to clean the electrification roller 52, and the foreign material is recovered and transferred into the developer tank 22.

However, the present invention is not limited to this. In the present printing apparatus, it is not particularly necessary to recover the foreign material, as long as the foreign material located on the electrification roller 52 is removed so as to clean the electrification roller 52.

For example, the present invention may be so arranged that, a cleaning blade is provided instead of the cleaning film 54, and the foreign material located on the electrification roller 52 is scratched off so that the electrification roller 52 is cleaned, and then the scratched-off foreign material is discarded or recovered into a recovery container that is irrelevant to the development apparatus 21. In other words, the present invention may be so arranged that the scratched-off foreign material is not returned to the developer tank 22 (the scratched-off foreign material is not recovered for recycling).

Moreover, the cleaning film 54 may be made in any shape or any material, provided that the cleaning film 54 can clean the surface of the electrification roller 52 by removing the foreign material (toner) from the surface. For example, it is possible to arrange such that the cleaning film 54 is composed of a blade or a film. With this arrangement, it is possible to have a cleaning film 54 that is simple and of low cost.

Further, the cleaning film 54 is made of a conductive material, and is provided with a system (such as an earth system) for discharging an electric charge generated on the cleaning film 54.

With this arrangement, it is possible to avoid accumulation of the electric charge in the cleaning film 54 due to friction between the cleaning film 54 and the electrification roller 52. Therefore, it is possible to prevent age-related deterioration in a cleaning capability of the cleaning film 54.

Note that the (negative) electrification of the cleaning film 54 causes the positively electrified foreign material (positively electrified left-over toner 61*b*) to accumulate on the cleaning film 54 due to electrostatic attraction force, after the positively electrified foreign material is removed from the electrification roller 52.

Then, toner hump (the accumulation of the toner) is developed on the cleaning film 54. The development of the toner hump increases an amount of toner passing through the cleaning member by the help of the toner hump. The increase of such toner passing through the cleaning member is a problem.

Moreover, the surface of the electrification roller 52 has a mold-lubricant property. Therefore, for example, the resistance layer 52*b* of the electrification roller 52 is made of a conductive fluorine resin or the like. With this arrangement, it is possible to improve cleaning capability of the cleaning film 54.

Moreover, in the electrification apparatus 51, resistance of the resistance layer 52*b* of the electrification roller 52, that is, resistance of the electrification roller 52 contributes to prevention of abnormal electric discharge and smoothing of the electrification in superimposing. Because of this, if the resistance is too small, a longer time is necessary to electrify the electrification roller 52, and it becomes difficult to increase an electrification potential of the electrification roller 52 to a regular value. There is a possibility that this results in low potential or uneven electrification due to insufficient electrification. Therefore, the resistance layer 52 has a resistance equal to or lower than $10^8$ Ωcm.

Moreover, the electrification bias (electrification superimposing voltage) to be applied on the electrification roller 52 is equal to or higher than the break-down voltage, in order that the electrification bias is used as the electrification superimposing voltage. Moreover, if the electrification superimposing voltage is too high, there is a possibility that uneven electrification is caused by the abnormal electric discharge. In view of this, the electrification superimposing voltage has a crest value not less than the break-down voltage, and not more than a dielectric strength. Specifically, the electrification superimposing voltage is in a range between 450 (Vo-p) and 1300 (Vo-p).

Moreover, the value of the electrification superimposing value is chosen considering the electrification gap C between the electrification roller 52 and the photoreceptor 1, the electrification gap C affecting the break-down voltage.

On the other hand, if the magnetic field generated by the electrification roller 52 is too small, the attraction of the carrier 62 becomes difficult. Because of this, the magnetic filed generated by the electrification roller 52 is in a range between 400 gauss and 800 gauss.

Moreover, the electrification gap C of the electrification apparatus 51 is smaller than a particle diameter (carrier diameter) of the carrier 62 and larger than a particle diameter (toner diameter) of the toner 61.

The electrification gap C smaller than the particle diameter of the carrier 62 surely prohibits the carrier 62 from entering the electrification gap C. With this arrangement, the photoreceptor 1 and the electrification roller 52 are surely protected from damages due to the carrier 62 entering the electrification gap C.

FIGS. 7 to 10 and Table 3 show results of an evaluation test on electrification stability of the photoreceptor 1. In the evaluation test, the electrification stability was tested for various sizes of the electrification gap C under the following conditions: Used as the electrification roller 52 was a genuine electrification roller, called Ipsio 8000, produced by Ricoh Co. Ltd. (having a diameter (Φ) of 11 cm, a resistance of 40 MΩ, a volumetric resistivity of the resistance layer 52*b* of $10^7$ Ω·cm). As the electrification bias, applied was an alternating voltage (superimposing voltage) having a direct current component of −600V, a peak-to-peak voltage of 1.8 KVppV, and a frequency of 900 Hz. Moreover, the photoreceptor 1 had a diameter (Φ) of 30 mm, the film 3 had a thickness of 17 μm, and the process speed was 130 mm/s.

TABLE 3

| Electrification Gap | 25 μm | 40 μm | 55 μm | 190 μm |
|---|---|---|---|---|
| Change in Surface Potential of Photoreceptor | 5 V pp or less | 5 V pp | 50 V pp | 250 V pp |
| Image Quality | Good | Good | Black Spot | Bad |

Figure 7:
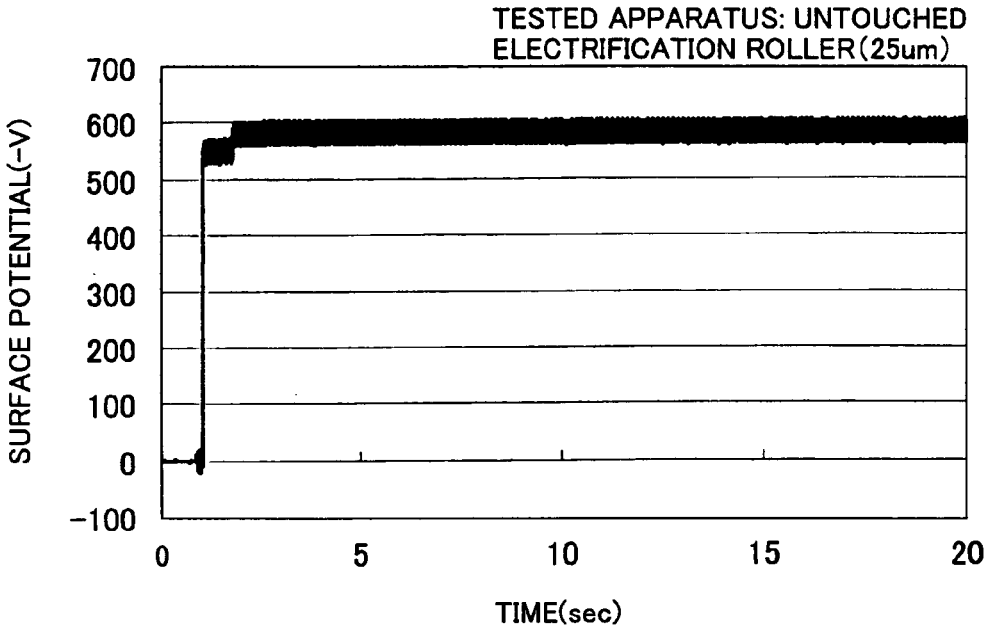
FIG. 7 is a graph showing electrification stability of the photoreceptor in case where an electrification gap of the printing apparatus shown in FIG. 1 is 25 μm.
Figure 8:
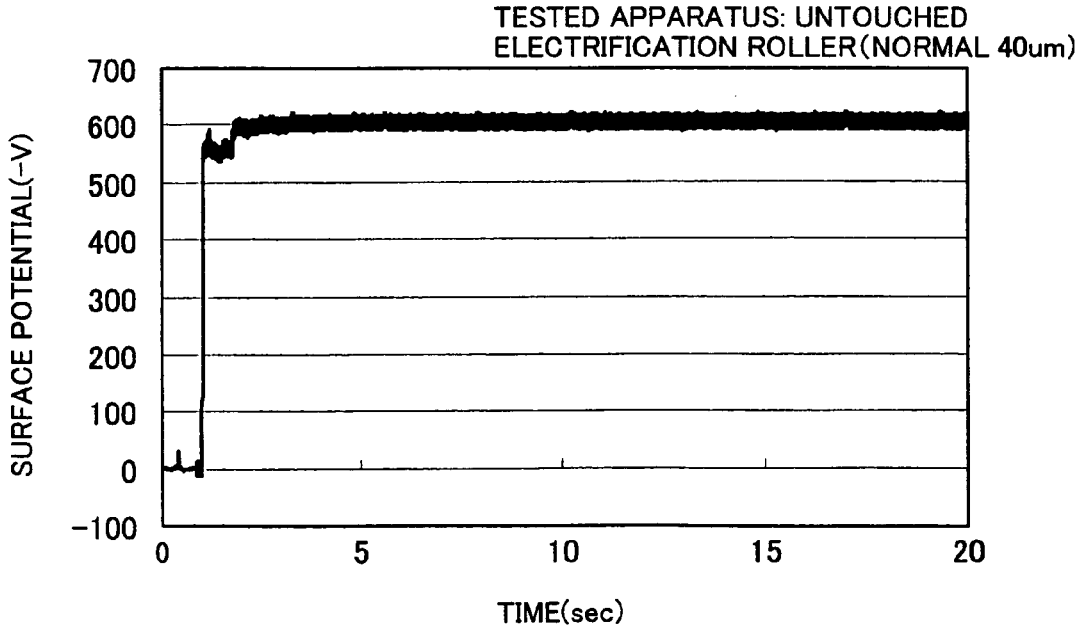
FIG. 8 is a graph showing the electrification stability of the photoreceptor in case where the electrification gap of the printing apparatus shown in FIG. 1 is 40 μm.
Figure 9:
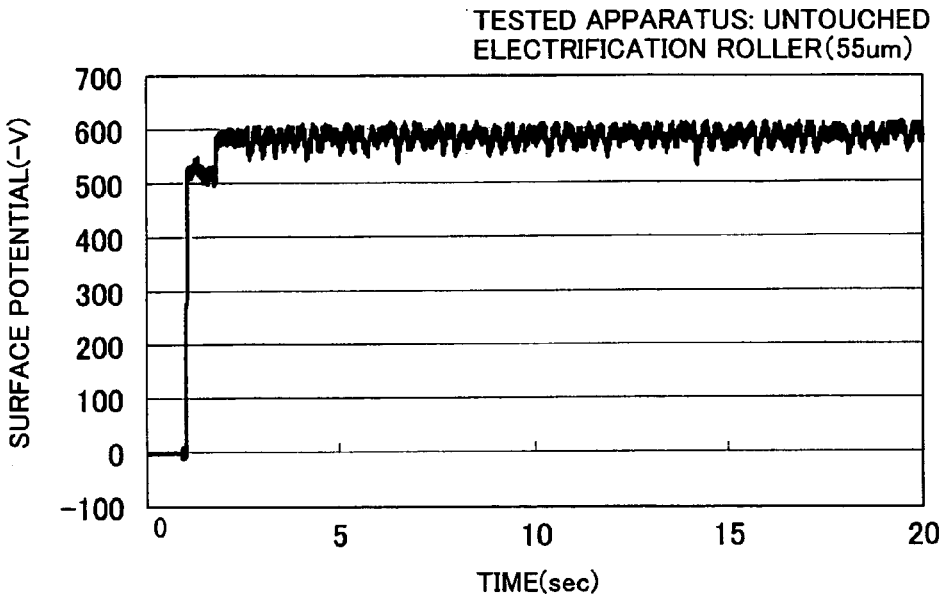
FIG. 9 is a graph showing the electrification stability of the photoreceptor in case where the electrification gap of the printing apparatus shown in FIG. 1 is 55 μm.
Figure 10:
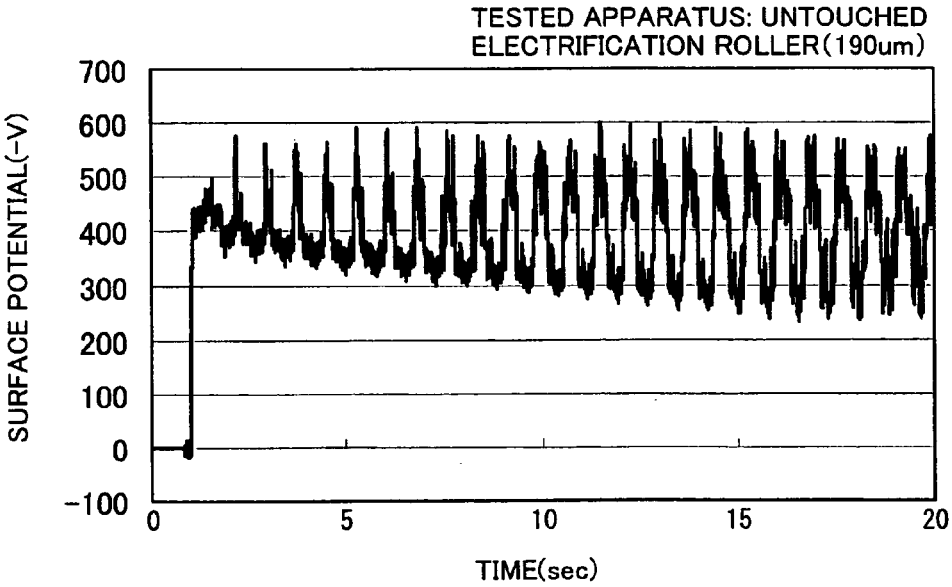
FIG. 10 is a graph showing the electrification stability of the photoreceptor in case where the electrification gap of the printing apparatus shown in FIG. 1 is 190 μm.

As shown in FIGS. 7 to 9, the results of the measurement show that it is possible to attain stable electrification of the photoreceptor 1 when the electrification gap C is 25 μm or wider and 55 μm or narrower, especially, 25 μm or wider and 40 μm or narrower. Note that in FIGS. 7 to 9, the vertical axis is the surface potential (−V) of the photoreceptor 1 and the horizontal axis is time (sec).

The results of the measurement shows that stable electrification of the photoreceptor 1 can be attained by arranging such that the electrification gap C is smaller than the carrier diameter. For example, in case where a carrier 62 having a particle diameter of 60 μm is used, it is possible to increase a carrier attraction efficiency (carrier recovery efficiency) in the attraction performed by the electrification roller 52, with an arrangement in which the electrification gap C is smaller than the particle diameter of the carrier 62, that is, 60 μm.

Figure 11:
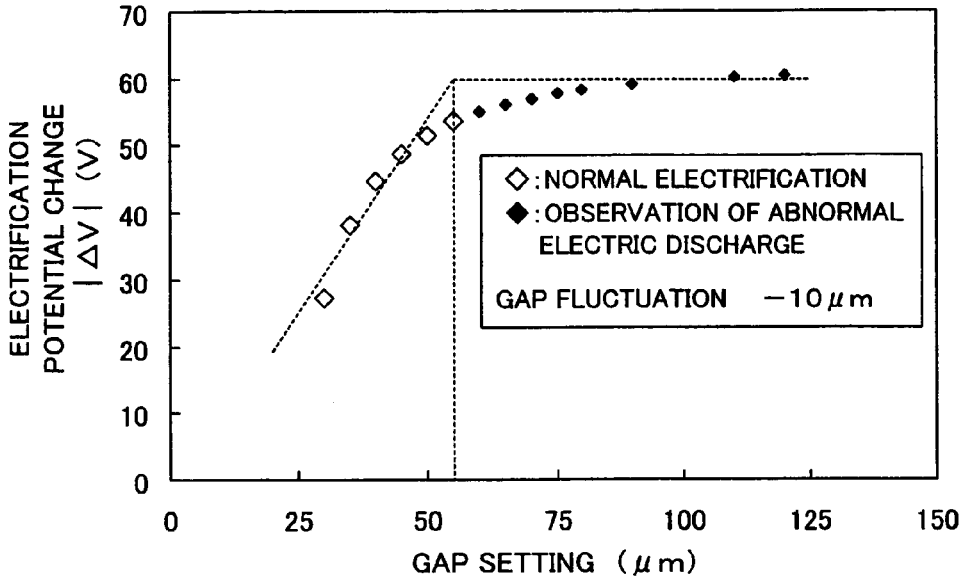
FIG. 11 is a graph showing how an electrification potential of the photoreceptor varies with respect to a defined gap.
Figure 12:
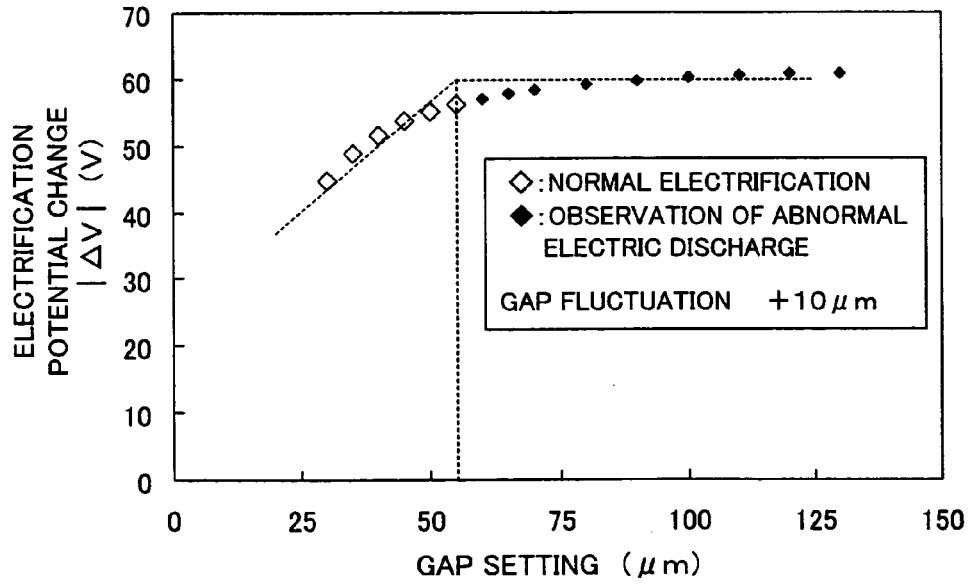
FIG. 12 is another graph showing how the electrification potential of the photoreceptor varies with respect to the defined gap.

Moreover, FIGS. 11 and 12 shows dependency of the electrification potential of the photoreceptor 1 on a setting value of the electrification gap C. As shown in FIGS. 11 and 12, the electrification gap C exceeding 60 μm increases the possibility of the abnormal electric discharge. Thus, by setting the electrification gap C to be 60 μm or less, it is possible to reduce the occurrence of the abnormal electric discharge and reduce occurrence of uneven electrification of the photoreceptor 1 due to the abnormal electric discharge.

Note that in FIGS. 11 and 12, the vertical axis is a change in the electrification potential (|ΔV|(V)), and the horizontal axis is a setting gap (μ) of the electrification gap C.

Where the direct current bias is used for the electrification, as shown in FIGS. 11 and 12, the electrification gap C is 55 μm or lower, taking into account a case where a size of the electrification gap C is changed from the setting value due to process error (an allowance may be about 10 μm). With this arrangement, it is possible to reduce a change of the electrification potential of the photoreceptor 1.

As described above, it is possible to attain stable electrification state of the photoreceptor 1 by arranging such that the electrification gap C is smaller than the carrier diameter, specifically, 60 μm or less. Thus, it is possible to attain high image quality.

Moreover, as shown in FIGS. 8 and 9 and Table 3, if the electrification gap C exceeds the 50 μm, it becomes difficult to attain stable electrification status of the photoreceptor 1. Because of the development characteristics, image fogging is caused when the surface potential of the photoreceptor 1 is reduced by 150V. Therefore, the surface potential of the photoreceptor 1 is not changed by 150 Vpp or more. For attaining stable half tone, the surface potential of the photoreceptor 1 is not changed by 30 Vpp or more.

For this reason, by arranging such that the electrification gap C is 55 μm or less, especially, 40 μm or less as described above, it is possible to prevent uneven electrification (image fogging) of the photoreceptor 1. due to the abnormal electric discharge.

It is possible to prevent black spotting in a white background of the transcription sheet, by arranging such that the electrification roller 52 has a high carrier recovery efficiency and the uneven electrification of the photoreceptor 1 due to the abnormal electric discharge is prevented.

On the other hand, it is possible to prevent fuse-bonding of the left-over toner 61*a* and 61*b* onto the electrification roller 52, by having such arrangement that the electrification gap C is larger than the particle diameter of the toner 61 that adheres on the photoreceptor 1. Note that the toner diameter is usually about 7 μm. Thus, the electrification gap C is 7 μm or wider.

Further, the electrification gap C is larger than the toner diameter by not less than three times and not more than nine times, from a point of view of micromeritics. Specifically, where the toner diameter is about 7 μm, the electrification gap C is not less than 21 μm and not more than 63 μm.

If the electrification gap C is larger than the toner diameter by less than three times, powder blow-out phenomenon is conspicuously occurred. Thus, it is possible to prevent blow-out of the toner 61 by arranging such that the electrification gap C is larger than the toner diameter by not less than three times.

Moreover, so-called bridge arch of powder is frequently occurred when the electrification gap C is larger than the toner diameter by about more than 9 times. Thus, it is possible to prevent fuse-bonding of the toner 61 on the electrification roller 52 due to the bridge arch of the toner 61, by arranging such that the electrification gap C is larger than the toner diameter by not more than nine times. Further, with this arrangement, it is possible to prevent a agglomeration cluster of the toner 61 from passing the electrification gap C. Thus, it is possible to prevent image quality deterioration caused by the agglomeration cluster of the toner 61 entering the development region 4.

Moreover, because a generally used sheet has a thickness in a range between about 70 μm and 100 μm, it is possible to prevent a jammed sheet from entering the electrification gap C by arranging such that the electrification gap C is narrower than the thickness of the generally used sheet. Hereby, it is possible to prevent the jammed sheet from being entangled around the electrification roller 52. This arrangement makes it easier to remove the jammed sheet, because this arrangement prevents the jammed sheet from entering the development region 4.

Furthermore, described below is a peripheral velocity ratio of the electrification roller 52 with respect to the photoreceptor 1. The peripheral velocity ratio is a ratio of a peripheral velocity of the electrification roller over a peripheral velocity of the photoreceptor. When the peripheral velocity ratio is 0 (there is no peripheral velocity ratio), that is, when the electrification roller 52 is fixed, it is impossible to remove the foreign material attached on the surface of the electrification roller 52. This causes failure in the electrification. Moreover, in case where the electrification roller 52 performs the against rotation with respect to the photoreceptor 1 as in the present printing apparatus, there is no limit in the peripheral velocity ratio (electrification peripheral velocity ratio) from point of view of the electrification characteristics.

However, there is a possibility that the attracted foreign material is scattered. Further, where a tape (not shown) is rolled, in a ring-like shape, around the photoreceptor 1 and pressed against the surface of the photoreceptor 1 in order to control the electrification gap C by a thickness of the tape, attrition of a surface in contact with the tape is caused due to friction. Considering the scattering of the attracted foreign material and the attrition of the surface in contact with the tape, the electrification peripheral velocity ratio is in a range of 0.2 to 1.0 (for example, 0.5).

"The electrification roller 52 has a peripheral velocity ratio with respect to the photoreceptor 1", that is, "the electrification roller 52 and the photoreceptor 1 has a peripheral velocity ratio" (the electrification roller 52 has a peripheral velocity that is in a ratio with a peripheral velocity of the photoreceptor 1) means that the electrification roller 52 rotates and the surface of the electrification roller 52 and the surface of the photoreceptor 1 rotate at relative speeds in the electrification region 5.

Moreover, in the present removing system, the magnetic field of the development roller 23 is in a range of 400 (Gs) and 800 (Gs).

Moreover, in the present removing system, the development roller 23 has a peripheral velocity that is in a ratio (for example, 2.25) with a peripheral velocity of the photoreceptor 1. That is, the development roller 23 is provided rotatably. With this arrangement, it is possible to further increase the attraction efficiency (recovery efficiency) of the negatively electrified foreign material (negatively electrified left-over toner 61*a*) in the attraction performed by the development roller 23.

"The development roller 23 and the photoreceptor 1 have a peripheral velocity ratio (the development roller 23 has a peripheral velocity ratio that is in a ratio with a peripheral velocity ratio of the photoreceptor 1)" means that the development roller 23 rotates and the facing surfaces of development roller 23 and the photoreceptor 1 rotate at relative speeds in the development region 4.

The peripheral ratio (development peripheral velocity ratio) of the development roller 23 with respect to the photoreceptor 1 is not particularly limited, provided that the peripheral velocity ratio is set suitably according to the doctor gap A, which regulates the thickness of the layer of the developer 60, a toner density (T/D) of the developer 60, and a required development amount (how many times the development is performed desirably). However, the peripheral ratio is in a range of one to four times.

If the development peripheral velocity ratio is too small, the development amount tends to be not enough. If the development peripheral velocity ratio is too large, the deterioration of the developer 60 is accelerated, thereby causing such problems that the life of the developer 60 is shortened and the fuse-bonding of the toner 61 to the development roller 23 is caused.

Moreover, (a) the development roller 23 is so provided that the development roller 23 does not touch the photoreceptor 1, and (b) the development roller 23 performs the against rotation so that, in the development region 4 of the photoreceptor 1, the surface of the development roller 23 that faces (is opposite to) the photoreceptor 1, moves in an opposite direction to the moving direction of the surface of the photoreceptor 1 that faces the development roller 23.

In short, the present printing apparatus is so arranged that the development roller 23 and the photoreceptor 1 are driven by different driving systems and rotated in the same direction.

With this arrangement, it is possible to attract the negatively electrified foreign material (such as the negatively electrified left-over toner 61*a*) that is left over beyond the electrification region 5, before the negatively electrified foreign material passes through the development region 4 (before the negatively electrified foreign material passes through the development gap B; in a vicinity of immediate upstream of the development region 4 in the rotation direction of the photoreceptor 1). Therefore, with this arrangement, it is possible to further improve the efficiency in attracting the negatively electrified foreign material.

Moreover, a setting of the development apparatus 21 of the present printing apparatus is as follows: for example, where a developer 60 containing (a) a toner 61 whose binder resin is a styrene acryl resin and whose particle diameter is 8 μm and (b) an iron-powder type carrier 62 whose particle diameter is 60 μm, is used, (i) the photoreceptor has an electrification potential of −600V, a development bias of −400V, a doctor gap A of 1.5 mm, and a development gap B of 2 mm, and (ii) the photoreceptor 1 and the development roller 23 perform against rotation with a development peripheral velocity ratio of 1.25.

Moreover, in the present embodiment, the voltage values are concretely indicated for each bias voltage, agitating voltage and the like. However, those voltage values are merely examples. That is, as long as good printing can be performed, any voltage values can be chosen for those voltages. That is, as long as good printing can be performed with the voltages, the values can be any value.

Moreover, in the present embodiment, the electrification bias of the electrification apparatus 51 is negative (the surface of the photoreceptor 1 is negatively electrified), and the development apparatus 21 performs the reversal development with respect to the electrostatic latent image.

However, the present invention is not limited to this. The present printing apparatus may be so arranged that the electrification bias has positive polarity. In this case, the other biases, such as the development bias, the transcription bias, the direct component of the agitating voltage, have opposite polarity.

Moreover, in the present embodiment, the development apparatus 21 performs the reversal development. However, the present invention is not limited to this. The development apparatus 21 may perform normal development.

In this case, the development apparatus 21 is so arranged that the toner adheres on unexposed portion of the electrostatic latent image. Thus, the toner is positively electrified in the developer tank 22 (main electrification polarity of the toner becomes positive; the majority of the toner is positively electrified). In this case, the development bias is negative (a smallest absolute value of the unexposed photoreceptor potential; for example, −400V), meanwhile the transcription bias is negative, which is opposite polarity to the main electrification polarity of the toner).

Moreover, in case of the normal development, the agitating voltage (or, in case where the agitating voltage is the agitating superimposing voltage, the direct current component of the agitating superimposing voltage) to be applied on the conductive brush 42 is positive, which is the same polarity as the (positive) main electrification polarity of the toner (that is, the opposite polarity to the transcription bias). This arrangement is for causing the electrification roller 52 to more efficiently attract the foreign material located on the photoreceptor 1.

Moreover, the attraction of the foreign material performed by the electrification roller 52 is more meaningful (effective) when the development performed by the development apparatus 21 is the reversal development, compared with a case where the development is the normal development.

In the normal development, the main electrification polarity of the toner is positive (that is, the toner image is generated with the toner positively electrified). Therefore, in case where the electrification roller 52 does not remove the foreign material, the positively electrified left-over toner 61*b* that is returned to the development region 4 is captured by the development bias and adhered onto the unexposed portion of the photoreceptor 1 thereby forming a toner image.

Meanwhile, the negatively electrified left-over toner 61*a* that is returned to the development region 4 is hardly left on the exposed portion (white background region) of the photoreceptor 1 due to the negative electrification of the photoreceptor 1. Thus, it is easy to remove the negatively electrified left-over toner 61*a* by using the development roller 23.

Therefore, even if the electrification roller 52 does not remove the foreign material, influence of the image fogging due to the left-over toner 61*a* and 61*b* is relatively small.

On the other hand, in the reversal development, the main electrification polarity of the toner is negative (that is, the toner image is generated with the toner negatively electrified). Therefore, in case where the electrification roller 52 does not remove the foreign material, the negatively electrified left-over toner 61*a* that is returned to the development region 4 is captured by the development bias, and adhered onto the exposed portion of the photoreceptor 1 thereby forming a toner image.

Meanwhile, the positively electrified left-over toner 61*b* that is returned to the development region 4 is subjected to a strong electrostatic force due to the negative electrification of the photoreceptor 1. Thus, the positively electrified left-over toner 61*b* tends to be left on the non-exposed portion (white background region, which is negatively electrified) of the photoreceptor 1 and it is difficult to remove the positively electrified left-over toner 61*b* by using the development roller 23.

Therefore, in case where the electrification performed by the electrification roller 52 dose not remove the foreign material, the influence of the image fogging due to the positively electrified left-over toner 61*b* is significant.

Moreover, in case the present embodiment, the two-component developer containing the toner 61 and the carrier 62 is used as the developer 60. However, developers the present printing apparatus may be used are not limited to this. For example, the present printing apparatus may use a one-component developer, which includes toner 61 but not the carrier 62.

In this case, the electrification apparatus 51 is provided with an electrification roller 52 that includes no magnet below the resistance layer 52*b*. This is because there is no need of electrostatically attracting the carrier 62 having a large mass. With this arrangement, it is possible to reduce the cost of the electrification roller 52.

Moreover, in this case, the electrification gap C is narrower than the thickness of the sheet P and wider than the particle diameter (toner diameter) of the toner 61.

As to the sheet P that is used in an electronic photography type printing apparatus, if the sheet P is a general printing paper, a thin type of the sheet P is about 60 g/m$^2$ in weight per area (pound weight), and 60 μm to 80 μm in thickness. Therefore, the electrification gap C wider than the thickness of the sheet P allows the sheet P to enter the region (such as the development region 4) beyond the electrification region 5 in case it is failed to peel off, from the photoreceptor 1, the sheet P that is electrostatically adhered on the photoreceptor 1 by the transcription bias (in case the jamming of the sheet P is caused). This makes it difficult to solve the jamming (to perform jam-solving operation). Moreover, this also causes such a problem that hands and/or clothes of a person who is performing the jam-solving operation get dirty during the jam-solving operation.

On the other hand, in case where the electrification gap C is narrower than the thickness of the sheet P, the sheet P that adheres on the photoreceptor 1 can be surely peeled off from the photoreceptor 1 by using the electrification roller 52. Therefore, it is possible to reduce a trouble required for the jam-solving operation, and to avoid the above-mentioned case that the person who is performing the jam-solving operation, get dirty.

Moreover, if the electrification gap C exceeds 60 μm, the possibility of the occurrence of the abnormal electric discharge is increased. Therefore, by arranging such that the electrification gap C is not more than 60 μm, it is possible to reduce the occurrence of the abnormal electric discharge thereby preventing the uneven electrification of the photoreceptor 1 due to the abnormal electric discharge.

Moreover, considering deviance in the electrification gap C due to processing errors, the electrification gap C is not more than 55 μm, for suppressing the fluctuation of the electrification potential. Further, for realizing more stable electrification, the electrification gap C is not more than 40 μm.

Moreover, by arranging such that the electrification gap C is wider than the particle diameter of the toner 61, it is possible to prevent the toner 61 that has not been cleaned by the cleaning film 54, from being fused and bonded together (fuse-bonding) on the electrification roller 52. In addition, because the toner diameter is usually about 7 μm, the electrification gap C is not less than 7 μm.

Moreover, in the present embodiment, the carrier 62 contained in the developer 60 is made of an inorganic magnetic material such as magnetite, ferrite, or the like. However, the present invention is not limited to this. The carrier 62 may be made of any raw material generally used for the carrier of the two-component developer, for example, iron powder, triiron tetroxide, and the like.

Moreover, in the present embodiment, the shape of the photoreceptor is a photoreceptor drum. However, the present invention is not limited to this. The photoreceptor 1 may be structured as a so-called photoreceptor belt in which an endless conductive belt is stretched (engaged) between supporting rollers that are rotatably provided with an interval therebetween.

Moreover, the transcription apparatus 31 is provided with the transcription 32. However, the present invention is not limited to this. Instead of the transcription roller 32, a so-called transcription belt may be used. In the transcription belt, an endless transcription belt is stretched (engaged) between supporting rollers that are rotatably provided with an interval therebetween.

Moreover, the present printing apparatus may be expressed as a printing apparatus in which an electrostatic latent image is formed by exposing, in accordance of image data, a surface of an image holding body that has been electrified by an electrification apparatus, and a toner image that is formed by developing the latent image is transcribed on the sheet, wherein the electrification apparatus (i) attracts the foreign material left over on the image holding body after the transcription of the toner image, (ii) includes an electrification roller for electrifying the image holding body, the electrification roller and the image holding body performing against rotation with respect to each other and (iii) includes a cleaning section for cleaning a surface of the electrification roller by removing foreign material attracted onto the electrification roller.

Figure 14:
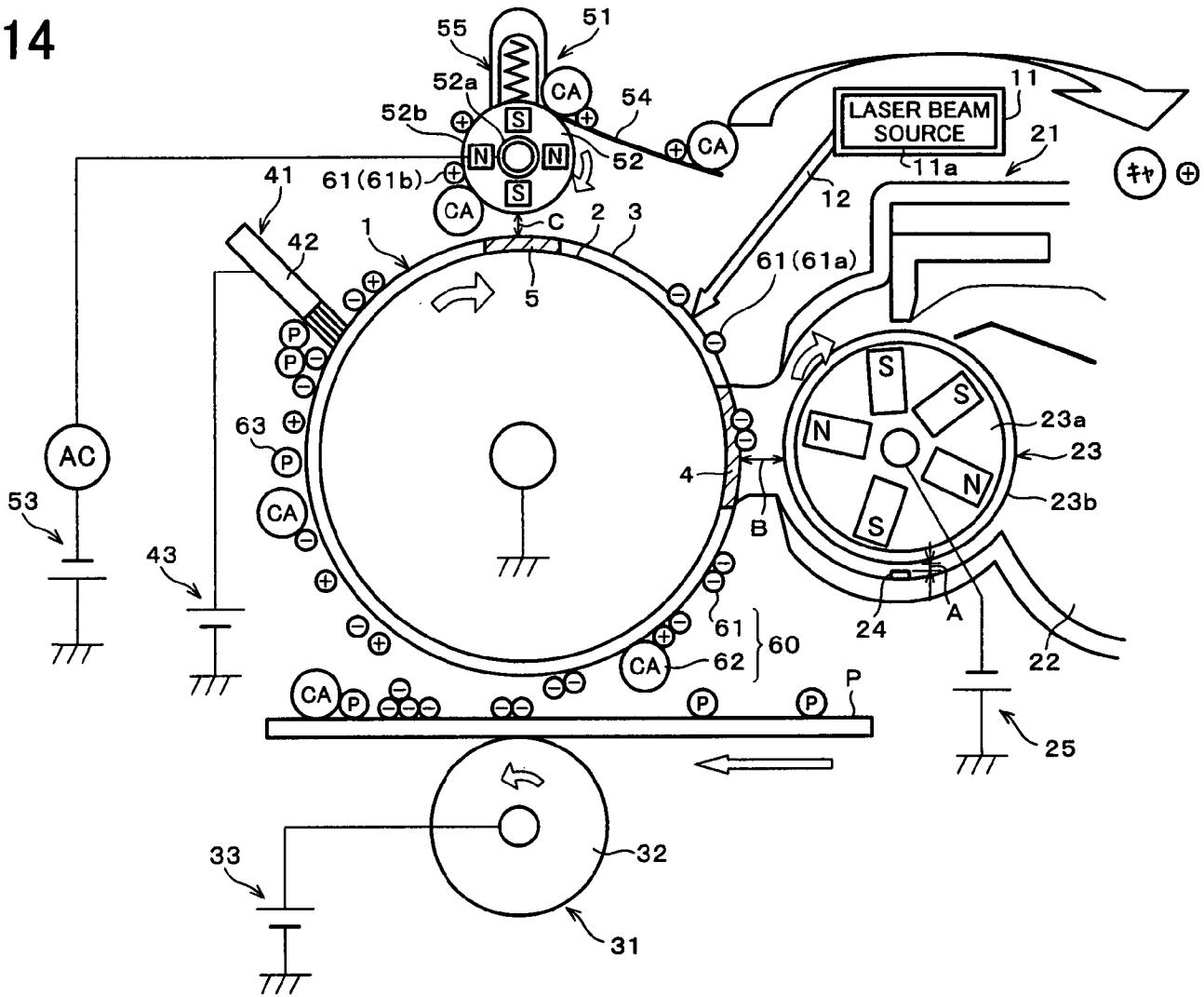
FIG. 14 is an explanatory view for illustrating an arrangement of the printing apparatus in case where a direct current agitating voltage is used.

Moreover, in the present embodiment, both of the left-over toner 61*a* and 61*b* adhered on the conductive brush 42 are removed by applying the alternating voltage (alternating electric field) on the conductive brush 42 from the agitating voltage power source 43, or by alternately switching over the polarity of the direct current agitating voltage. However, the present invention is not limited to this, and may be so arranged that a unipolar agitating voltage (agitating bias) is applied the agitating voltage power source 43 as shown in FIG. 14. Again with this arrangement, it is possible to attain the effect that is given by arranging that the electrification roller 52 and the photoreceptor 1 perform the against rotation with respect to each other.

Moreover, the electrification roller 52 and the photoreceptor 1 perform the against rotation with respect to each other. However, the present invention is not limited to this. In the present invention, even with the arrangement in which the electrification roller 52 and the photoreceptor 1 perform with rotation with respect to each other, it is also possible to attain the effect given by arranging that the electrification polarity of the conductive brush 42 is alternately switched over.

Moreover, as described above, the electrification roller 52 and the photoreceptor 1 are so rotated that the rotation direction of the electrification roller 52 on its rotation axis and the rotation direction of the photoreceptor 1 on its rotation axis are the same. In short, the electrification roller 52 and the photoreceptor 1 are so arranged that the electrification roller 52 and the photoreceptor 1 are driven by different driving systems and are so rotated that, in a place where a distance between the electrification roller 52 and the photoreceptor 1 is shortest (the electrification roller 52 is closest to the photoreceptor 1), the facing surfaces of the electrification roller 52 and the photoreceptor 1 move in opposite directions (in other words, the electrification roller 52 and the photoreceptor 1 perform the against rotation with respect to each other).

With this arrangement, the foreign material, such as the oppositely electrified toner (positively electrified left-over toner) 61*b*, the carrier 62, and the like, which is left over on the photoreceptor 1 after the transcription, is removed by being attracted onto the electrification roller 52 before the foreign material passes the electrification gap C, which is the narrowest gap between the electrifying surface of the electrification roller 52 and the photoreceptor 1. Moreover, the electrification apparatus 51 is provided with the cleaning film 54 as foreign material recovery (recollection) means (left-over developer component recovery means), which is so located as to touch the electrification roller 52, the foreign material recovery means being for scratching the foreign material adhered on the electrification roller 52, and recovering the thus scratched foreign material into the developer tank 22 provided beyond the developer roller 23. The cleaning film 54 is provided with the cleaning blade and the toner transferring screw. As a raw material of the cleaning film 54, polyethylene telephthalate, for example. With the arrangement in which the cleaning film 54 is provided as the foreign material recovery means, the foreign material such as the oppositely electrified toner 61*b* and the like, which is attracted onto the electrification roller 52, is returned to the developer tank 22. The foreign material thus returned into the developer tank 22 is subjected to the sufficient agitation electrification, as the normally electrified toner (negatively electrified toner) 61*a* is. As a result, it is possible to recycle the opposite electrification toner 61*b* whose electrification has been greatly changed. Moreover, with the arrangement in which the electrification roller 52 is provided with the cleaning film 54 as the foreign material recovery means for recovering the foreign material on the surface of the photoreceptor 1, it becomes unnecessary to include means for removing and recovering the foreign material in addition to the electrification apparatus 51. Therefore, it is possible to simplify the structure of the present printing apparatus.

As described above, the electrification roller 52 performs the against rotation with respect to the photoreceptor 1. With this arrangement, the foreign material, which is left over on the photoreceptor 1 after the transcription, is attracted onto the electrification roller 52 so as to be removed from the surface of the photoreceptor 1. This prevents, for example, the foreign material such as the oppositely electrified toner 61*b*, the carrier and the like from entering the electrification gap C between the electrification roller 52 and the photoreceptor 1, the foreign material causing the image quality deterioration such as the image fogging and the like. The image fogging is caused when a transcription material P, to a white background region which the oppositely electrified toner 61*b* adheres, is developed. Therefore, the removal and recovery of the foreign material from the surface of the photoreceptor 1 is surely carried out as one of the functions of the electrification roller 52, but only as a side effect thereof.

Consider a case where the electrification roller 52 and the photoreceptor 1 perform the with rotation, in which the rotation direction of the electrification roller 52 on its rotation axis and the rotation direction of the photoreceptor 1 on its rotation axis are different so that the facing surfaces of the electrification roller 52 and the photoreceptor 1 move in the opposite directions in the place where the distance between the electrification roller 52 and the photoreceptor 1 is shortest. In this case, the oppositely electrified toner 61*b* passes the electrification region 5. On the other hand, in case where the electrification roller 52 and the photoreceptor 1 performs the against rotation, the foreign material such as the oppositely electrified toner 61*b* and the like is attracted onto the electrification roller 52 in the immediate upstream of the electrification region 5 in the rotation direction of the photoreceptor 1. As a result, it is possible to prevent the foreign material from entering the electrification gap C, thus preventing the foreign material, especially the oppositely electrified toner 61*b* from passing the electrification region 5.

Moreover, in a case where the superimposing voltage (AC superimposing bias) is applied on the electrification roller 52, the with rotation leads to significant reduction in the efficiency of the electrostatic recovery of the oppositely electrified toner 61*b*, because in case of the with rotation, the surface potential of the photoreceptor 1 is substantially the same as the voltage of the direct current bias. On the other hand, in this case, the against rotation leads to efficient electrostatic recovery of the oppositely electrified toner 61*b* by effective contribution of the direct current (DC) component of the AC superimposing bias of the electrification roller 52, because in case of against rotation, the oppositely electrified toner 61*b* is recovered in the immediate upstream of the electrification region 5 in the rotation direction of the photoreceptor 1, and transferred, the electrification region 5 being a starting point of the electrification of the photoreceptor 1.

Especially, in case where the reversal development is adopted, when the oppositely electrified toner 61*b* left over on the unexposed portion enters the development region 4, the oppositely electrified toner 61*b* is not recovered because of the strong electrostatic attraction force which causes the oppositely electrified toner 61*b* to be attracted toward photoreceptor 1. The normally electrified toner 61*a* is electrostatically attracted in the development region 4. Thus, the transcription step is started with an increased amount of the toner 61 on the photoreceptor 1. This results in a significant staining of the white background. Because of this, the against rotation is especially effective for recovery of the oppositely electrified toner 61*b*.

Therefore, according to the present printing apparatus, it is possible to miniaturize the apparatus because no special cleaning apparatus for removing the foreign material left over on the photoreceptor 1 is additionally necessary. Further, it is possible to have a lower power source voltage. As a result, it is also possible to prevent occurrence of film attrition and friction-caused damage of the photoreceptor 1 due to the cleaning, and to reduce load torque of the photoreceptor 1.

Further, according to the present printing apparatus, the arrangement in which the electrification roller 52 performs the against rotation with respect to the photoreceptor 1, enables the attraction of the foreign material onto the electrification roller 52 before the foreign material passes the electrification gap C between the electrification roller 52 and the photoreceptor 1. Further, it is possible to prevent the uneven electrification due to the foreign material passing through the electrification gap C, because the foreign material attracted onto the electrification roller 52 is removed and recovered so as to prevent the foreign material from passing through the electrification gap C.

When the foreign material such as the oppositely electrified toner 61*b* exists in the electrification gap C, for example, the oppositely electrified toner 61*b* receives the electric charge, whereby an non-electrified shadow is caused in a portion from which such oppositely electrified toner 61*b*. However, with the aforementioned arrangement, the foreign material, especially the oppositely electrified toner 61*b* is attracted onto the electrification roller 52 in the immediate upstream of the electrification region 5 in the rotation direction of the photoreceptor 1. Therefore, it is possible to prevent the foreign material from entering the electrification gap C, thereby improving the electrification property.

Especially, according to the present printing apparatus, it is possible to maintain a good image by the development-cleaning method in which the development apparatus and the cleaning apparatus are integrated, because the electrification roller 52 provided in the upstream of the development apparatus 21 in the rotation direction of the photoreceptor 1 recovers the oppositely electrified toner 61*b* that causes image deterioration, especially the image fogging. Moreover, the integration of the development apparatus and the cleaning apparatus leads to miniaturization of the present printing apparatus. Moreover, according to the present printing apparatus, in which the oppositely electrified toner 61 is scratched off by the carrier 62 in the electrification roller 52, it is possible to improve the recovery efficiency of the normally electrified toner 61*a*.

Moreover, according to the present printing apparatus, in which the foreign material is prevented from entering the electrification gap C, there is no need of having such arrangement in which the electrification gap C is so wide that the carrier 62, for example, will pass through the electrification gap C without being stuck therein. Thus, according to the present printing apparatus, it is possible to have the arrangement in which the electrification gap C is narrow. The narrow electrification gap C leads to lower power source voltage, as shown by "Paschen's experimental formula" which finds an break-down voltage of aerial electric discharge. Even if it is so arranged that the electrification gap C is narrow, the present printing apparatus is free from such a problem that relatively hard foreign material such as the carrier 62 and the like passing through the narrow gap C damages the surface of the electrification roller 52 or the surface of the photoreceptor 1.

Further, the arrangement in which the electrification roller 52 performs the against rotation with respect to the photoreceptor 1, leads to extension of the relative travel distance between the electrification surface of the electrification roller 52 and the electrification surface of the photoreceptor 1. This eliminates the electrification fluctuation caused when the resistance of the electrification roller is locally (partially) changed. Hereby, the electrification property of the photoreceptor 1 is improved. Meanwhile, it is also possible to reduce the effect caused when the electrification roller 52 itself is electrified, because in this arrangement the surface to be the electrification surface (the surface to be electrified) of the electrification roller 52 enters the electrification region 5, specifically, the electrification gap C, from the downstream side with respect to the photoreceptor 1, that is, from a side at which the electrification is done (the downstream of the electrification region 5).

Note that the effect becomes more remarkable when the resistance of the resistance layer 52*b* is high. The resistance of the resistance layer 52*b*, that is, the resistance of the electrification roller 52, contributes to the prevention of the abnormal electric discharge and the flattening of the electrification in superimposing. Therefore, if the resistance is too small, the possibility of the abnormal electric discharge and the uneven electrification is increased. On the other hand, if the resistance is too high, the time required for electrification is extended, thereby making it difficult to attain the regular electrification potential. This possibly leads to low potential and uneven electrification due to insufficient electrification. Thus, the resistance of the resistance layer 52*b* is not more than $10^8$ Ωcm.

Moreover, if the superimposing voltage to be applied on the electrification roller 52 is not more than break-down voltage, it is impossible to attain the effect aimed by the arrangement in which the superimposing voltage is used. there is a possibility that the abnormal electric discharge occurs thereby causing the uneven electrification. In view of this, the superimposing voltage has a crest value not less than the break-down voltage, and not more than a dielectric strength. Specifically, the superimposing voltage is in a range between 450 (Vo-p) and 1300 (Vo-p).

Further, if the magnetic field is too small, it becomes difficult to recover the carrier 62. Therefore, the magnetic filed generated by the electrification roller 52 is in a range between 400 gauss and 800 gauss, as in the development roller 23 for use in the two-component development mentioned above.

Moreover, the superimposing voltage is affected by the electrification gap C between the electrification roller and the photoreceptor 1, the electrification gap C affecting the break-down voltage.

The electrification gap C between the electrification roller 52 and the photoreceptor 1 is smaller than a particle diameter (carrier diameter) of the carrier 62 and larger than a particle diameter (toner diameter) of the toner 61. By arranging such that the electrification gap C is smaller than the particle diameter of the carrier 62 attached on the photoreceptor 1, it is possible to surely prevent the carrier 62 from entering the electrification gap C. This arrangement further ensures the prevention of damaging the photoreceptor 1 and the electrification roller 52 by the carrier 62 that enters the electrification gap C.

Moreover, the printing apparatus of the present embodiment may be expressed as an image forming apparatus as follows: an image forming apparatus of the present embodiment, is so arranged as to comprise (i) an image holding body on a surface of which a latent image is to be formed, (ii) an electrification apparatus for electrifying the image holding body by applying a voltage onto an electrification member provided around the image holding body in such a manner that the electrification member does not touch the surface of the image holding body, (iii) development means for developing, by using a developer containing at least toner, the latent image formed on the surface of the image holding body by an electrification charge, so as to form a toner image, and (iv) transcription means for transcribing, on a transcription material, the toner image thus formed on the image holding body, the electrification apparatus being an apparatus for electrification and cleaning, (a) the apparatus removing a left-over developer component that is left over on the image hold member after the transcription, from the image holding body, by attracting the left-over developer component to the electrification member, and (b) the apparatus electrifying the image holding body, the electrification member and the image holding body respectively rotating in such a manner that facing surfaces of the electrification member and the image holding body moves in opposite directions in a place where a distance between the electrification member and the image holding body is shortest. Further, especially, the image forming apparatus of the present embodiment is a two-component development type image forming apparatus using a two-component developer containing toner and carrier, wherein a narrowest gap between the electrification member and the image holding body is less than a particle diameter of the carrier that is a left-over developer component, and is greater than a particle diameter of the toner that is a left-over developer component.

More specifically, an image forming apparatus of the present embodiment is so arranged as to compose an electrification apparatus, in a vicinity of a surface of a photoreceptor, for electrifying the photoreceptor, the electrification apparatus including (A) an electrification roller having a conductive member having a circular tube shape or a circular column shape, and a resistance layer for covering a surface of the conductive layer, (B) an electrification belt having a resistance layer, (C) an electrification brush, or (D), the like, the image forming apparatus developing a latent image formed on the photoreceptor by using a developer containing at least a toner, wherein a rotation direction of the electrification roller on its rotation axis and a rotation direction of the photoreceptor on its rotation axis are the same (against rotation); and a narrowest gap (electrification gap) between an electric discharging surface of the electrification apparatus and the photoreceptor is less than the carrier attached on the photoreceptor and greater than the toner attached on the photoreceptor.

Moreover, an image forming method of the present embodiment, using an image forming apparatus of the present embodiment, including (i) an image holding body on a surface of which a latent image is to be formed, (ii) an electrification apparatus for electrifying the image holding body by applying a voltage onto an electrification member provided around the image holding body in such a manner that the electrification member does not touch the surface of the image holding body, (iii) development means for developing, by using a developer containing at least toner, the latent image formed on the surface of the image holding body by an electrification charge, so as to form a toner image, and (iv) transcription means for transcribing, on a transcription material, the toner image thus formed on the image holding body, is so arranged as to include the steps of: (a) rotating the electrification member and the image holding body respectively, in such a manner that facing surfaces of the electrification member and the image holding body rotate in opposite directions in a place where a distance between the electric discharge surface of the electrification member and the image holding body is shortest; (b) removing, from the image holding body, a left-over developer component left over on the image holding body after the transcription, the left-over developer being removed by being attracted to the electrification member; and (c) while the step of removing being performed, electrifying the image holding body.

As described above, according to the present embodiment, the against rotation enables that the left-over developer component, such as the oppositely electrified toner and the like, which is left over on the image holding body after the transcription, is removed before passing the electrification gap located in the place where the distance between the electric discharge surface of the electrification member and the image holding body is shortest. In the against rotation, facing surfaces of the electrification member and the image holding body rotate in opposite directions in the place where the distance between the electric discharge surface of the electrification member and the image holding body is shortest. Because of this, it is possible to prevent the left-over developer component such as the oppositely electrified toner and the like from entering the electrification gap. Further, it is possible to surely remove and recover the left-over developer component from the image holding body, as one of the functions of the electrification member. Therefore, according to the present embodiment, it is possible to miniaturize the apparatus and have a low power source voltage. Further, it is possible to provide an image forming apparatus and an image forming method capable of attaining good image quality. Note that, at the same time the electrification member removes the left-over developer component, the electrification member is capable of also removing and recovering, from the image holding body, the foreign material (left-over material), such as debris of the transcription material, that adheres on the left-over developer component that is to be attracted to the electrification member. In short, the electrification apparatus removes, from the image holding body, the foreign material (left-over material) including the left-over developer component, by attracting the left-over developer component onto the electrification member, the left-over developer component being left over on the image holding body after the transcription.

Further, the gap (electrification gap) may be greater than a toner diameter by more than three times and less than nine times. If the electrification gap C is larger than the toner diameter by less than three times, powder blow-out phenomenon is frequently occurred. Thus, with this arrangement, it is possible to prevent blow-out of the toner. Moreover, clogging of the electrification gap by forming a bridge arch of powder is frequently occurred when the electrification gap C is larger than the toner diameter by about more than 9 times. Thus, it is possible to prevent fuse-bonding of the toner on the electrification roller due to the bridge arch of the toner, by arranging such that the electrification gap is larger than the toner diameter by not more than nine times. Further, with this arrangement, it is possible to prevent an agglomeration cluster of the toner from passing the electrification gap. Thus, it is possible to prevent image quality deterioration caused by the agglomeration cluster of the toner entering the development region.

As described above, a foreign material removing system of the present invention for removing foreign material left over on an image holding body of an electronic photography type printing apparatus, is so arranged as to include: a power source; an agitating member for agitating the foreign material that is on the image holding body; and an attracting section for attracting the agitated foreign material by an attraction bias, the agitating member being electrified in accordance with a voltage applied thereon from the power source, and the power source alternately switching polarity of the electrified agitating member.

The first removing system is used for an electronic photography type printing apparatus adopted as a photocopy machine, a printer, a facsimile machine, and the like.

In such printing apparatus, the surface of the image holding body being rotating is electrified and exposed so as to form an electrostatic latent image, and the latent image is developed by using a developer (such as the toner or the like) so as to form a visible image (such as the toner image). The visible image is transcribed onto the sheet (such as recording paper or the like).

Further, the first removing system is used for removing the foreign material (left-over foreign material; mainly the developer) left over on the image holding body after the transcription of the visible image.

As described above, the first removing system is provided with the agitating member, the attracting section, and the power source.

The attracting section removes (attracts) the foreign material from the image holding body by the attraction bias.

In the electronic photography type printing apparatus, the image (image formed with the developer) on the image holding body is electrostatically transcribed onto the sheet. Thus, the left-over foreign material has an electrification status in accordance with the transcription voltage (the left-over foreign material is electrified in accordance with the transcription voltage). The first removing system electrostatically removes such left-over foreign material from the image holding body by using the attraction bias of the attracting section.

Moreover, the agitating member agitates (stirs) the aggregation cluster (foreign material cluster) of the left-over foreign material located on the image holding body. This arrangement crumbles the foreign material cluster located on the image holding body so as to make it easier to attract the left-over foreign material.

Moreover, the power source applied the voltage (agitating voltage) onto the agitating member, so as to cause the agitating member to be in the electrification status in accordance with the agitating voltage.

In the first removing system having this arrangement, it is possible to adjust the electrification status of the left-over foreign material by using the agitating member. Note that, as such agitating member, a conductive brush may be used, for example.

Incidentally, in some case, electrostatic force, intermolecular force, adhesive force and the like cause the left-over foreign material to be adhered and accumulated on the agitating member for agitating the foreign material located on the image holding body.

For removing such left-over foreign material from the agitating member, the first removing system is so arranged that the power source changes the polarity of the agitating voltage so as to alternately switch over the electrification polarity of the agitating member.

In other words, it is possible to remove the positively electrified left-over foreign material from the agitating member, by applying the positive agitating voltage onto the agitating member. Meanwhile, it is possible to remove the negatively electrified left-over foreign material from the agitating member, by applying the negative agitating voltage onto the agitating member.

In the first removing system having this arrangement, it is possible to remove the left-over foreign material from the agitating member regardless of whether the left-over foreign material is positively or negatively electrified.

Moreover, the arrangement in which the electrification polarity of the agitating member is alternately switched over, prevents excess attraction of the left-over foreign material electrified in one of the polarities.

Moreover, by adjusting, depending on electrification characteristics of the left-over toner, a length of time in which the agitating voltage is positive, and a length of time in which the agitating voltage is negative (by arranging such that the length of time in which the agitating voltage is in the same polarity as the average polarity of the left-over toner), it is possible to attain efficient control of the attraction of the left-over toner.

Moreover, the first removing system may be so arranged that the power source applies an alternating voltage onto the agitating member, in order to switch over the electrification polarity of the agitating member mentioned above.

This arrangement attains easy switchover of the electrification polarity of the agitating member.

Further, with the arrangement in which the power source applies an alternating voltage onto the agitating member, it is possible to fluctuate (vary) the electrostatic force that is applied onto both of the positively and negatively electrified left-over foreign material attached on the agitating member.

Because of this, the left-over foreign material is agitated by the electrostatic force. Therefore, it is possible to remove, from the agitating member, the left-over foreign material attached on the agitating member by the intermolecular force and the adhesive force.

As described above, the first removing system is so arranged as to be capable of easily removing the left-over foreign material attached on the agitating member.

Moreover, the printing apparatus provided with the first removing system having the above-mentioned arrangement is capable of printing without much image quality deterioration (with the image quality deterioration (effectively) inhibited).

Moreover, the power source applies a superimposing voltage (agitating superimposing voltage) that is prepared by superimposing an alternating current voltage on a direct current voltage.

With this arrangement, the electrification property of the left-over foreign material that touches the agitating member is shifted to the polarity of the direct current voltage. Therefore, for example, by arranging that the direct current voltage has polarity opposite to polarity of the attraction bias, it is possible to cause the attracting section to perform the attraction of the left-over foreign material with better attraction efficiency.

Furthermore, in case where the direct current voltage of the superimposing voltage has the polarity opposite to the polarity of the attraction bias, the power source causes the direct current voltage of the superimposing voltage to be equal to or higher than an break-down voltage.

In other words, in this case, the direct current voltage is equal to or higher than an break-down voltage.

This arrangement causes the attracting section to perform the attraction of the foreign material with better attraction efficiency.

This is because the insulating material, which is hardly electrified, can be electrified by applying a voltage equal to or higher than the break-down voltage. Therefore, even if the left-over material on the image holding body cannot be electrified with ease, it is possible to flow an effective electrification current by applying the superimposing voltage having the direct current voltage that is equal to or higher than the break-down voltage. Thus, it is possible to ensure the electrification of the left-over foreign material.

Moreover, the electronic photography type printing apparatus provided with the first removing system is usually so arranged as to include a transcription section for transcribing an image that is formed on the image holding body, onto a sheet by a transcription bias.

Therefore, in case where the superimposing voltage is used, the power source causes the direct current voltage of the superimposing voltage to have the same polarity as the transcription bias.

In other words, in this case, the direct current voltage is in the same polarity as the transcription bias.

On average, there is a high possibility that the left-over foreign material left over on the image holding body after the transcription is electrified in the same polarity as the polarity of the transcription bias (the polarity of the average electrification value of the left-over foreign material is the same as the polarity of the transcription bias).

Therefore, with the arrangement in which the direct current voltage of the superimposing voltage is in the same polarity as the transcription bias, it is possible to hinder the left-over foreign material from adhering onto the agitating member.

Moreover, in the case where the superimposing voltage is used, the power source causes the alternating current voltage to have such a value that the agitating member is oscillated by an electrostatic force caused by the alternating current voltage.

In other words, in this case, the alternating voltage of the superimposing voltage has such a value that the agitating member is oscillated by an electrostatic force caused by the alternating current voltage.

With this arrangement, it is possible to shake off, from the agitating member, the left-over foreign material attached on the agitating member. This improves efficiency of the removal of the left-over foreign material.

The value with which the alternating voltage causes oscillation of the agitating member, is for example a frequency that is approximately equimultiple of or approximately a half of a character frequency of the agitating member.

Moreover, for removing the left-over foreign material attached on the agitating member, the first removing system is so arranged that, by using the power source, polarity of the electrification (electrification polarity) of the agitating member is alternately switched over. Here, the switchover is performed when the agitating member touches the non-image region (the region which is not the image region) of the image holding body (that is, when the non-image region is positioned in front of the agitating member).

Here, the image region is a region (i) that is located on the image holding body and (ii) in which no image is formed during one cycle of the image holding body (during a time in which the image holding body rotates one time) between a time the region is in front of the agitating member and a time the region returns to in front of the agitating member.

On the other hand, the non-image region is a region that is on the image holding body and other than the image region, that is, a region that is on the image holding body, and in which no image is formed during one cycle of the image holding body between a time at which the region is in front of the agitating member and a time at which the region returns to in front of the agitating member.

That is, the image region is a region that is on the image holding body and that is subjected to the operation for the image formation when the region passes a part for the respective processes (in front of apparatuses for the processes) such as the electrification, the exposure, the development, the transcription, and the agitation, and the like. That is, the image region is a place in which an image is to be formed.

On the other hand, the non-image region is a region on the image holding body and other than the image region. That is, the non-image region is a region that is on the image holding body and that is not subjected to the operation for the image formation when the region passes a part for the respective processes (in front of apparatuses for the processes). Included in the non-image region are (i) a "pre-rotation" region in which preparation of the image formation on the image holding body is carried out by respective processes and the like when the apparatus is activated in accordance with a printing (printout) command, (ii) a "sheet-to-sheet" region that is between the images on the image holding body in case of continuous printing, and (iii) a "post-rotation" region in which the termination operation is carried out on the image holding body by the respective processes and the like in order to stop the apparatus or to put the apparatus in the waiting status.

When the polarity of the voltage to be applied on the agitating member is switched over, the left-over foreign material that adheres on and is accumulated on the agitating member is moved to the surface of the image holding body. Therefore, the amount of the left-over foreign material on that part of the surface is increased. Because of this, there is a possibility that not all of the left-over foreign material is removed by the attracting section.

If an image is formed in such region, there is a possibility that the electrification and the exposure are carried out inefficiently during the printing step using the electronic photography method.

Therefore, for the first removing system, the polarity of the agitating member is switched over by the power source when the non-image region, in which no image is formed in one cycle, comes in front of the agitating member (when the agitating member touches the non-image region), so as to drop, onto the non-image region, the left-over toner accumulated on the agitating member. With this arrangement, it is possible to avoid dropping, onto the image region, the left-over foreign material that is removed from the agitating member, thereby preventing the image deterioration mentioned above.

Moreover, in case the left-over foreign material attached on the agitating member is removed by using the non-image region, the transcription section prevents the transcription bias from being applied onto the non-image region.

With this arrangement, even if the left-over foreign material that has not been recovered via the attracting section is transferred to the transcription section, it is possible to prevent from adhesion (electrostatic adhesion) of the foreign material onto the transcription apparatus due to the transcription bias.

Therefore, it is possible to prevent the stain on the transcription section from being transcribed onto the sheet and getting the sheet dirty.

Note that, the application of the transcription can be avoided by floating the transcription section, for example (so that the transcription section is electrically isolated and put in a condition that the transcription section is electrically in air).

Moreover, in the first removing system, the agitating member is located in a housing for covering the agitating member.

In this arrangement, even if the left-over foreign material that attaches on the agitating member is dropped or scattered in a place other than the image holding body, the left-over foreign material is kept inside of the housing (or, it is possible to return the left-over foreign material back to image holding body). With this arrangement, it is possible to prevent (a) an inside of the present printing apparatus and (b) the sheet from being stained by the dropping and scattering of the left-over toner, and to prevent the sheet from being stained (getting dirty).

Note that the agitating member of the first removing system is, for example, the electrification roller of the printing apparatus.

In this case, the electrification roller electrifies the image holding body by using the electrification bias, and attracts the foreign material on the image holding body by using the electrification bias as the attraction bias.

Moreover, the present invention may be so arranged that a development roller of the printing apparatus is used as the attracting section.

In this case, the development roller develops the electrostatic latent image on the image holding body by using the development bias, and attracts the foreign material on the image holding body by using the development bias as the attraction bias.

With the arrangement in which the electrification roller and/or the development roller is used as the attracting section as described above, eliminated is the need of a special member (such as the cleaning blade) for removing the foreign material from the image holding body. Therefore, this arrangement reduces the manufacturing cost of the first removing system (and the printing apparatus including the first removing system).

Moreover, in case where the electrification roller and/or the development roller is used as the attracting section, the electrification roller and/or the development roller performs against rotation with respect to the image holding body.

Here, "the electrification roller and/or the development roller performs against rotation" indicates that the electrification roller and/or the development roller rotates in the same direction as the image holding body.

In this case, the surface of (i) the electrification roller and/or the development roller and the surface (ii) the image holding body, which face each other, moves in the opposite directions in the electrification region or the development region. (that is, the surface of the electrification roller and/or the development roller, and the surface of the image holding body moves in such a manner that the surface and the surface pass by each other.) Here, the electrification region (or development region) is that region on the image holding body, in which the electrification roller (or development roller) face against the image holding body.

Therefore, in this case, the left-over foreign material on the image holding body is attracted to the electrification roller (or the development roller) in an entering position for the electrification region (or the development region). (In other words, the left-over foreign material on the image holding body is attracted to the electrification roller (or the development roller) just before (in the immediate upstream of) the electrification region (or the development region).) The left-over foreign material thus attracted onto the electrification roller (or development roller) is transferred away from the electrification region (or the development region) in accordance with the rotation of the electrification roller (or the development roller).

With this arrangement, it is possible to prevent the foreign material on the image holding body from entering the electrification region (or the development region). Thus, it is possible to prevent the foreign material from being stuck in the gaps between the rollers and the image holding body (and from damaging the image holding body and the rollers).

Moreover, because the left-over foreign material will not be left in the electrification region (or the development region), the electrification (or the development) will not be hindered by the foreign material.

Moreover, especially in case where the electrification roller performing the against rotation with respect to the image holding body is used as the attracting section, it is possible to prevent the foreign material from entering the electrification gap (between the image holding body and the electrification roller). This eliminates the need of having a wide electrification gap in accordance with large-size left-over foreign material, and allows to have a narrow electrification gap. With the arrangement in which the electrification gap is narrow, it is possible to have a low electrification bias, as understood from "Paschen's experimental formula" which finds an break-down voltage of aerial electric discharge. Therefore, it is possible to miniaturize the first removing system or the printing apparatus.

Note that the electrification roller on which the thus removed left-over adheres, passes the electrification region in case the electrification member and the image holding body perform the with rotation with respect to each other (in other word, in case where the electrification roller and the image holding body rotate in the opposite directions). However, in the downstream of the electrification region (the downstream with respect to the image holding body), the surface potential of the image holding body is electrified to have the substantially same potential as the (direct current) electrification bias. Therefore, the image holding body has the substantially same foreign material attracting force as the electrification roller. Thus, in case of the with rotation, significantly reduced is the capacity of electrostatically recovering the left-over foreign material from the image holding body.

In the first removing system, on the other hand, the against rotation is performed. Thus, where the electrification roller removes the left-over foreign material from the image holding body is the upstream of the electrification region (from which the left-over foreign material on the image holding body enters the electrification region). Thus, according to the first removing system, it is possible to avoid the effect of the attraction force of the image holding body.

Moreover, according to the first removing system, it is possible to extend the relative travel distance between the surface (electrification surface) of the electrification roller and the surface (the surface to be electrified) of the image holding body, because the electrification roller performs the against rotation with respect to the image holding body.

This prevents electrification fluctuation due to the local change in resistance of the electrification roller (the resistance of part of the electrification roller changes). Thus, it is possible to improve the electrification property (evenness in the electrification) of the image holding body.

Moreover, in the first removing system, the surface to be electrified next, of the electrification roller enters the electrification from the downstream of the electrification, because the electrification roller performs the against rotation with respect to the image holding body.

Therefore, even in case of internal voltage drop of the electrification roller, it is possible to alleviate the decrease of the electrification potential of the image holding body due to the internal voltage drop. In the internal voltage drop, the voltage inside the electrification roller is reduced due to electrification of a capacitor component as a result of the electrification of the image holding body.

Moreover, in the downstream of the electrification region, the surface potential of the image holding body increases as the electrification proceeds. Because of this, an electrification current density (per area) is also reduced, as the surface potential increases. This alleviates the electrification potential reduction of the image holding body due to the voltage drop caused by a resistance component inside of the electrification roller.

Note that this effect becomes especially remarkable when the resistance of the electrification roller is high. That is, when the electrification roller has a high resistance, the voltage drop caused by electrification of the capacitance component and the voltage drop caused by the resistance component become remarkable, whereby it becomes difficult to increase the electrification potential of the image holding body to the regular value.

Moreover, a first method of removing foreign material (first removing method) of the present invention is a method of removing foreign material left over on an image holding body of an electronic photography type printing apparatus, the method comprising the steps of (i) agitating, by using an agitating member, the foreign material that is on the image holding body; and (ii) attracting the thus agitated foreign material by an attraction bias, the step of agitating including the step of switching over polarity of electrification of the agitating member.

The first removing method is used in the first removing system. That is, in order to remove the left-over foreign material from the agitating member, the present method of removing foreign material is so arranged that the electrification polarity of the agitating member is alternately switched over by switching over the polarity of the agitating voltage.

In the first removing method, the positively electrified left-over foreign material can be removed from the agitating member by applying the positive agitating voltage on the agitating member, whereas the negatively electrified foreign material can be removed from the agitating member by applying the negative agitating voltage on the agitating member.

Because of this, with the first removing method, it is possible to remove the left-over foreign material from the agitating member even if there are both positively electrified left-over foreign material and the negatively electrified left-over foreign material.

Moreover, the alternating switchover of the electrification polarity of the agitating member prevents excess attraction of the left-over foreign material of one polarity.

Moreover, with the arrangement in which the agitating voltage it is possible to more efficiently suppress the adhesion of the left-over material, by adjusting, depending on electrification characteristics of the left-over toner, a length of time in which the agitating voltage is positive, and a length of time in which the agitating voltage is negative (by arranging such that the length of time in which the agitating voltage is in the same polarity as the average polarity of the left-over toner, is longer).

Moreover, a second foreign material removing system (second removing system) is a foreign material removing system for removing foreign material left over on an image holding body of an electronic photography type printing apparatus, is so arranged as to include: an electrification roller for (i) performing against rotation with respect to the image holding body, (ii) electrifying the image holding body by an electrification bias, and (iii) attracting the foreign material that is on the image holding body; and a cleaning section for cleaning a surface of the electrification roller by removing the foreign material thus attracted onto the electrification roller.

The second removing system is used for an electronic photography type printing apparatus adopted as a photocopy machine, a printer, a facsimile machine, and the like.

In such printing apparatus, the surface of the image holding body being rotating is electrified and exposed so as to form an electrostatic latent image, and the latent image is developed by using a developer (such as the toner or the like) so as to form a visible image (such as the toner image). The visible image is transcribed onto the sheet (such as recording paper or the like).

Further, the second removing system is used for removing the foreign material (mainly the developer) left over on the image holding body after the transcription of the visible image.

As described above, the second removing system is provided with the electrification roller of the printing apparatus and the foreign material removing system.

The electrification roller is so provided as to face the image holding body. There is a predetermined gap (electrification gap) between the electrification roller and the image holding body. A predetermined electrification bias is applied on the electrification roller. As a primary function, during the printing operation of the printing apparatus, by using an electrification bias, the electrification roller electrifies the surface of the image holding body, the surface being in the electrification region.

Note that the electrification region is a region in which in aerial electric discharge occurs between the electrification roller and the image holding body (for example, the region is worked out by substitution of a maximum value of the voltage to be applied on the electrification roller, in "Paschen's experimental formula").

Moreover, the second removing system is so arranged that the foreign material on the image holding body (foreign material electrified oppositely to the electrification bias) is attracted to the electrification roller by using the electrification bias of the electrification roller.

In short, in the second removing system, the electrification roller has not only the function of electrifying but also the function of removing the foreign material. For this reason, there is no need of providing a special member (such as the cleaning blade) for removing the foreign material from the image holding body. This reduces a manufacturing cost.

The electrification bias, the electrification property and the electrification amount of the foreign material and the image holding body determine which kind of the foreign material can be removed by the electrification bias.

For the foreign material that can be removed by the electrification bias, an attraction force to attract the foreign material to the electrification roller is greater than an attraction force to attract the foreign material to the image holding body, when the electrification bias is applied on the foreign material.

Moreover, especially, the second removing system is so arranged that the electrification roller performs against rotation with respect to the image holding body.

Here, "the electrification roller performs against rotation" indicates that the electrification roller rotates in the same direction as the image holding body. In this case, the facing surfaces of the electrification roller and the image holding body move in the opposite direction in the electrification region (that is, the surface of the electrification roller and the surface of the image holding body pass by each other).

Therefore, in the second removing system, the foreign material located on the image holding body is attracted onto the electrification roller in an entering position for the electrification region. Then, the foreign material is transferred away from the electrification region in accordance with the rotation of the electrification roller.

With the second removing system having this arrangement, it is possible to prevent the foreign material on the image holding body from passing through the electrification region (electrification gap), and from being stuck between the electrification gap (and damaging the image holding body and the electrification roller).

Moreover, because no foreign material left in the electrification region, the electrification will not be hindered by the foreign material. Therefore, it is possible to prevent occurrence of non-electrified part of the image holding body due to the existence of the foreign material.

Moreover, because it is possible to prevent the foreign material from entering the electrification gap, it is unnecessary to have a wide electrification gap in accordance with a large-sized foreign material. Thus, it is possible to have such arrangement that the electrification gap is narrow. With the arrangement in which the electrification gap is narrow, it is possible to have such arrangement that the electrification bias is low, as understood from "Paschen's experimental formula" which finds the break-down voltage of aerial electric discharge. Further, the arrangement enables miniaturization of the second removing system and the printing apparatus.

Note that, in case where the electrification roller and the image holding body perform with rotation with respect to each other, (rotate in the opposite directions), the electrification roller passes the electrification region with the foreign material attached on the electrification roller. However, in the downstream of the electrification region (the downstream with respect to the image holding body), the surface potential of the image holding body is electrified to have the substantially same potential as the (direct current) electrification bias. Therefore, the image holding body has the substantially same foreign material attracting force as the electrification roller. Thus, in case of the with rotation, significantly reduced is the capacity of electrostatically recovering the left-over foreign material from the image holding body.

In the second removing system, on the other hand, the against rotation is performed. Thus, where the electrification roller removes the left-over foreign material from the image holding body is the upstream of the electrification region (from which the left-over foreign material on the image holding body enters the electrification region). Thus, according to the first removing system, it is possible to avoid the effect of the attraction force of the image holding body.

Moreover, according to the second removing system, it is possible to extend the relative travel distance between the surface (electrification surface) of the electrification roller and the surface (the surface to be electrified) of the image holding body, because the electrification roller performs the against rotation with respect to the image holding body.

This prevents electrification fluctuation due to the local change in the resistance of the electrification roller (the resistance of part of the electrification roller changes). Thus, it is possible to improve the electrification property (evenness in the electrification) of the image holding body.

Moreover, in the second removing system, the surface to be electrified next, of the electrification roller enters the electrification from the downstream of the electrification, because the electrification roller performs the against rotation with respect to the image holding body.

Therefore, even in case of internal voltage drop of the electrification roller, it is possible to alleviate the decrease of the electrification potential of the image holding body due to the internal voltage drop. In the internal voltage drop, the voltage inside the electrification roller is reduced due to electrification of a capacitor component as a result of the electrification of the image holding body.

Moreover, in the downstream of the electrification region, the surface potential of the image holding body increases as the electrification proceeds. Because of this, an electrification current density (per area) is also reduced, as the surface potential increases. This alleviates the electrification potential reduction of the image holding body due to the voltage drop caused by a resistance component inside of the electrification roller.

Note that this effect becomes especially remarkable when the resistance of the electrification roller is high. That is, when the electrification roller has a high resistance, the voltage drop caused by electrification of the capacitance component and the voltage drop caused by the resistance component become remarkable, whereby it becomes difficult to increase the electrification potential of the image holding body to the regular value.

Moreover, especially, the second removing system is provided with a cleaning section for cleaning a surface of the electrification roller by removing the foreign material thus attracted onto the electrification roller.

With this arrangement, it is possible to prevent the foreign material from accumulating on the electrification roller. Therefore, it is possible to prevent (i) the deterioration in electrification property of the electrification roller due to the accumulation of the foreign material, and (ii) the abnormal electrical discharge due to the accumulation of the foreign material, thereby attaining stable electrification property of the electrification roller. Therefore, it is possible to avoid occurrence of the image quality deterioration such as image fogging.

Moreover, because it is possible to prevent, from being returned to the image holding body, the foreign material that has been once removed by the electrification roller, it is possible to prevent image deterioration caused by such foreign material that is returned from the electrification roller to the image holding body.

Moreover, by arranging a printing apparatus to have the second removing system as descried above, it is possible to perform printing without much image quality deterioration (with the image quality deterioration (effectively) inhibited).

Moreover, in the second removing system, the cleaning section includes a recovering member for recovering, into a developer tank of the printing apparatus, the foreign material thus removed from the electrification roller.

Usually, the majority of the foreign material left over on the image holding body after the transcription is components (such as the toner, carrier and the like) of the developer. Thus, in this arrangement, the foreign material that has been removed from the image holding body by the electrification roller, is recovered into the developer tank so that the foreign material can be reused. This arrangement can lower running cost (cost of the developer) in the printing apparatus.

Moreover, the second removing system may be so arranged that the cleaning section of the second removing system is made of a plate or a film, which touches the surface of the electrification roller. With this arrangement, it is possible to have such cleaning section that is simple and has a low cost.

Moreover, in this case, the cleaning section is made of a conductive material. Further, the second removing system is provided with an earth system for an earth system for discharging, from the cleaning section, an electric charge that is generated in the cleaning section.

With this arrangement, it is possible to prevent accumulation of the electric charge on the cleaning section due to the friction between the cleaning section and the electrification roller. Therefore, it is possible to prevent age-related deterioration in the cleaning capability of the cleaning section due to the electrification of the cleaning section itself.

Moreover, in this case, the surface of the electrification roller is made of a raw material (for example, a conductive fluorine resin) having a mold-lubricant property. With this arrangement, it is possible to improve the cleaning capability of the cleaning section.

Moreover, in the second removing system, the electrification bias of the electrification roller is a superimposing voltage prepared by superimposing an alternating current voltage on a direct current voltage.

With this arrangement, it is possible to electrify the surface of the image holding body evenly and wholly by using the direct current component.

Meanwhile, by using the alternating component, it is possible to agitate (vibrate, oscillate) the foreign material on the surface of the image holding body. With this arrangement, it is possible to facilitate the removal of the foreign material from the image holding body, thereby attaining efficient electrostatic attraction of the foreign material.

More specifically, in this arrangement, an alternating electrostatic force is applied on the foreign material of the image holding body in the vicinity of the entering position for the electrification region (that is, the upstream of the electrification region with respect to the image holding body).

With this arrangement, it is possible to facilitate the removal of the foreign material from the photoreceptor, and cause the thus removed foreign material to be in a cloudy state. This improves efficiency in attraction and recovery performed by the electrification roller.

Moreover, in the second removing system, a magnetic field is formed on the electrification roller.

With this arrangement, it is possible to remove the foreign material on the image holding body, not only by using the electrostatic force by the electrification bias, but also the magnetic force (magnetic attraction force).

For example, in case where the developer contains a carrier having large mass, good recovery efficiency cannot be attained by using only the electrification bias. On the other hand, by using the magnetic attraction force together with the electrostatic force, it is possible to improve the recovery efficiency.

Moreover, in the second removing system is provided with an electrification adjusting member for electrifying an amount of electrification of the foreign material that is on the image holding body, so as to render the foreign material to have opposite polarity to the electrification bias.

The electrification adjusting member is located in the upstream of the electrification region.

With this arrangement, it is possible to adjust the amount of the electrification of the foreign material so that the foreign material can be easily attracted onto the electrification bias. Therefore, it is possible to improve the efficiency of foreign material attraction performed by the electrification roller.

Moreover, the second removing system is provided with a development roller for developing an electrostatic latent image formed on the image holding body, and for attracting (removing) the foreign material left over on the image holding body (that is, the foreign material which the electrification roller fails to remove).

The development roller is so located as to face the image holding body. There is a predetermined gap (development gap) between the development roller and the image holding body. A predetermined development bias is applied on the development roller. Thus, during the development operation of the printing apparatus, by using the development bias and the developer, the development roller performs the development of the electrostatic image formed on the image holding body, as the primary function thereof.

Note that the development region is a region in which aerial electric discharge occurs between the development roller and the image holding body (for example, the region is worked out by substitution of a maximum value of the voltage to be applied on the development roller, in "Paschen's experimental formula".

The second removing system is so arranged that the foreign material (which the electrification roller fails to attract) on the image holding body is attracted to the development roller by using the development bias of the development roller.

In short, in this arrangement, the development roller has not only the function of developing but also the function of removing the foreign material. For this reason, there is no need of providing a special member (such as the cleaning blade) for removing the foreign material from the image holding body. This reduces a manufacturing cost.

The development bias, the electrification polarity and the electrification amount of the foreign material and the image holding body determine which kind of the foreign material can be removed by the development bias.

For the foreign material that can be removed by the development bias, an attraction force to attract the foreign material to the development roller is greater than an attraction force to attract the foreign material to the image holding body, when the development bias is applied on the foreign material.

With this arrangement in which the development roller has the function of removing the foreign material, the removal of the foreign material from the image holding body is ensured.

Moreover, in the second removing system, a narrowest gap (electrification gap) between the electrification roller and the image holding body is less than a thickness of a sheet used in the printing apparatus, and greater than a particle diameter of a toner contained in a developer.

Usually, in the printing apparatus, the sheet is adhered onto the image holding body by the transcription bias, in transcribing, to the sheet, the visible image formed on the image holding body, Then after the transcription is done, the sheet is peeled off from the image holding body.

By arranging such that the electrification gap is less than the thickness of the sheet, it is possible to prevent the sheet from entering the electrification region and the downstream thereof, even if the peeling-off of the sheet from the image holding body is failed due to problems of some kind. With this arrangement, it is possible to prevent the sheet that has not been peeled off, from going further than the electrification gap in the printing apparatus. Thus, the removal of sheet (jam-solving operation) can be easily performed.

Moreover, considering a thickness of a generally used sheet, the arrangement in which the electrification gap is less than the thickness, reduces occurrence of the abnormal electric discharge in the electrification roller, and prevents uneven electrification of the image holding body due to the abnormal electric discharge. Further, by arranging such that the electrification gap is so small, it is possible to have a low break-down voltage and a low power source voltage, as shown by "Paschen's experimental formula".

Moreover, with the arrangement in which the electrification gap is greater than the particle diameter than the particle diameter of the toner, it is possible to prevent the toner from being fused and bonded inside the electrification gap (fuse-boding of the toner on the electrification roller and/or the image holding body).

Moreover, in case where the developer for use in the printing apparatus is a two-component developer containing a toner and a carrier, the electrification gap is less than the particle diameter of the carrier of the developer and greater than the particle diameter of the toner.

With this arrangement, it is possible to completely prevent the carrier from entering the electrification gap. Moreover, considering the particle diameter of a generally used carrier, it is possible to reduce the occurrence of the abnormal electric discharge by arranging such that the electrification gap is less than the particle diameter than the carrier. Thus, it is possible to prevent the uneven electrification of the image holding body due to the abnormal electric discharge.

Moreover, the second removing system in a printing apparatus that performs reversal development may be used. This arrangement attains a remarkable effect on maintaining good image quality.

More specifically, in a printing apparatus that performs the normal development, the foreign material that has an electrification property that allows the foreign material to be removed by the electrification roller, has the same polarity as the image holding body. For this reason, such foreign material is in a state that such foreign material can be easily removed from the image holding body even without a help of the electrification roller to remove such foreign material. It is considered that such foreign material gives little effect on printing performed subsequently.

On the other hand, in the printing apparatus that performs the reversal development, the foreign material that has an electrification property that allows the foreign material to be removed by the electrification roller, has the polarity opposite to the image holding body. Thus, a strong attraction force is exerted on the foreign material so that the foreign material tends to stay on the image holding body for a long time.

Therefore, in case the foreign material on the electrification roller is not removed and cleaned therefrom in removing the foreign material by using the electrification roller, the foreign material accumulates on the electrification roller, thereby deteriorating the capability of removing the foreign material from the image holding body. In some case, the accumulated foreign material comes off from the electrification roller and adheres on the image holding body again, thereby being left on the image holding body after the electrification. This gives a significantly large effect on the printing performed subsequently.

Therefore, it can be said that the image quality deterioration of the printing apparatus can be prevented by the use of the second removing system in the printing apparatus that performs the reversal development.

Moreover, with this arrangement, the electrification roller attracts, as the foreign material, the toner that is electrified in opposite polarity to the image holding body.

Such toner is a main cause of the image quality deterioration caused in case the electrification is not cleaned. In the second removing system, such image quality deterioration is not caused because the toner that is attracted onto the electrification roller is cleaned by the cleaning section.

Moreover, the second foreign material removing method (second removing method) of the present invention is a method of removing foreign material left over on an image holding body of an electronic photography type printing apparatus, the method comprising the steps of: electrifying and removing the foreign material on the image holding body, by (i) rendering the electrification roller of the printing apparatus to perform against rotation with respect to the image holding body, (ii) electrifying the image holding body by an electrification bias, and (iii) attracting, onto the electrification roller, the foreign material that is on the image holding body; and cleaning a surface of the electrification roller by removing the foreign material thus attracted onto the electrification roller.

The second removing method is the foreign material removing method for use in the second removing system.

Therefore, it is possible to remove the foreign material on the image holding body by the electrification roller. Because of this, there is no need of providing a special removing apparatus for removing the foreign material.

Moreover, because the electrification roller and the image holding body perform the against rotation with respect to each other, it is possible to prevent the foreign material on the image holding body from being stuck in the electrification gap (and damaging the image holding body and/or the electrification roller), and to prevent the image quality deterioration in the printing apparatus.

Further, because the electrification roller is cleaned, it is possible to prevent the foreign material from accumulating on the electrification roller, thereby preventing the image quality deterioration due to the accumulation.

Moreover, the second removing method includes the step of developing and attracting, the developing being performed by using a development roller of the printing apparatus, so as to develop an electrostatic latent image that is formed on the image holding body, and the attracting being performed so as to attract the foreign material left over on the image holding body.

In this method, it is arranged that the development roller has the function of removing the foreign material, in addition to the function of developing. With this arrangement, the foreign material which the electrification roller fails to attract, is removed from the image holding body by attraction.

According to this method, there is no need of a special member for removing the foreign material from the image holding body. Thus, it is possible to reduce the manufacturing cost and ensure the removal of the foreign material from the image holding body.

Moreover, it is possible to express the present invention as an image forming apparatus (printing apparatus) and an image forming method (printing method) as described below: The image forming apparatus of the present invention is an image forming apparatus that has a small size and can have a low power source voltage and attain a good image quality. That is, the image forming apparatus is a printing apparatus comprising (a) an image holding body (for example, a photoreceptor such as a photoreceptor drum, a photoreceptor belt, and the like) for holding, on a surface thereof, a latent image, (b) an electrification apparatus for electrifying the image holding body by applying a voltage onto an electrification member (for example, an electrification roller, an electrification belt, or the like), which is so located around the image holding body that the electrification member does not touch the surface of the image holding body, (c) a development means (for example, a development apparatus as an apparatus for developing and cleaning) for developing, by using a developer containing at least toner, a latent image that is formed on the surface of the image holding body by electrification charge, so as to convert the latent image into a toner image, and (d) transcription means (a transcription apparatus including a transcription roller, a transcription belt, or the like) for transcribing, onto a transcription material (for example, a recording sheet), the toner image thus formed on the image holding body, wherein: the electrification apparatus is an apparatus for electrifying and cleaning, the apparatus (a) causing the electrification member to attract a left-over developer component that is left over on the image holding body after the transcription, so as to remove the left-over developer component from the image holding body, and (b) electrifying the image holding body, and the electrification member and the image holding body rotating in such a manner that, in a place where a distance between the electrification member and the image holding body is shortest, facing surfaces thereof move in opposite directions.

Moreover, an image forming method of the present invention is an image forming method using a printing apparatus including (a) an image holding body (for example, a photoreceptor such as a photoreceptor drum, a photoreceptor belt, and the like) for holding, on a surface thereof, a latent image, (b) an electrification apparatus for electrifying the image holding body by applying a voltage onto an electrification member (for example, an electrification roller, an electrification belt, or the like), which is so located around the image holding body that the electrification member does not touch the surface of the image holding body, (c) a development means (for example, a development apparatus as an apparatus for developing and cleaning) for developing, by using a developer containing at least toner, a latent image that is formed on the surface of the image holding body by electrification charge, so as to convert the latent image into a toner image, and (d) transcription means (a transcription apparatus including a transcription roller, a transcription belt, or the like) for transcribing, onto a transcription material (for example, a recording sheet), the toner image thus formed on the image holding body, the printing method comprising the steps of: (i) rotating the electrification member and the image holding body respectively in such a manner that, in a place where a distance between the developer supplying means and the image holding body is shortest, facing surfaces thereof move in opposite directions; and (ii) attracting and electrifying, the attracting being performed so as to attract a left-over developer component that is left over on the image holding body after transcription, so as to remove the left-over developer component from the image holding body, and the electrifying being performed to electrify the image holding body.

According to the respective arrangements described above, because the electrification member and the image holding body performs the against rotation with respect to each other, the left-over developer component, such as the oppositely electrified toner and the like that is left over on the image holding body after the transcription, is attracted to the electrification member and removed before passing the electrification gap located in the place where (a) the discharging surface of the electrification member and (b) the image holding body are closed to each other. When performing the against rotation, the electrification member and the image forming so rotate that the facing surfaces thereof move in opposite directions in the place where (a) the discharging surface of the electrification member and (b) the image holding body are closed to each other. Because of this, according to the respective arrangements, it is possible to prevent the left-over developer component such as the oppositely electrified toner and the like from entering the electrification gap. Further, it is possible to surely remove and recover the left-over developer component from the surface of the image holding body, as one of the function. Moreover, in removing and recovering the left-over developer component, the electrification member can remove and recover, from the image holding body, the foreign material (left-over material) such as the debris of the transcription material, the foreign material adhering on the left-over developer component that is to be attracted onto the electrification member.

Therefore, according to the respective arrangements, there is no need of a special cleaning apparatus for removing the foreign material such as the left-over developer component and the like that is left over on the image holding body, on contrary to the conventional arrangement. Therefore, it is possible to miniaturize the apparatus, and lowers the power source voltage. Moreover, as a result, it is also possible to prevent occurrence of film attrition and friction-caused damage of the image holding body due to the cleaning, and to reduce load torque of the image holding body.

Further, according to the respective arrangements, it is possible to suppress the entering of the left-over developer component into the electrification gap. If the left-over developer passes through the electrification gap, there is a possibility that part of the image holding body is not electrified (non-electrified part thereof occurs). Therefore, with the respective arrangements, it is possible to suppress occurrence of non-electrified part, thereby improving the electrification property of the image holding body.

Further, according to the respective arrangements, the against rotation of the electrification member with respect to the image holding body leads to extension of the relative travel distance between the electrification surface of the electrification member and the electrification surface of the image holding body in the place where the distance between the electrification member and the image holding body is shortest. Because of this, it is possible to prevent the uneven electrification caused by the local change in resistance in the electrification member (resistance of part of the electrification member is changed), and the like reason, thereby attaining even electrification. Furthermore, the electrification surface (surface to be electrified) of the electrification member enters the electrification region, more specifically, the electrification gap, from the downstream with respect to the image holding body, that is, from a side at which the electrification is done (the downstream of the electrification region). This alleviates the effect caused by electrification of the electrification member itself. Moreover, the surface to be electrified, of the electrification member is refreshed by removing, from the electrification member, the developer component that has been attracted (recovered) onto the electrification member for recovery. The thus refreshed surface to be electrified, of the electrification member enters the electrification gap. This prevents the effect of the recovered material, thereby improving the electrification property of the image holding body.

Therefore, according to the respective arrangements, it is possible to attain the miniaturization and have the low power source voltage, and to provide an image forming apparatus with which a good image quality can be attained.

The printing apparatus of the image forming apparatus is so arranged that a narrowest gap (electrification gap) between the facing surfaces is less than a thickness of the transcription materials, and greater than a particle diameter of toner that is the left-over developer component.

The printing method of the present invention is so arranged that a narrowest gap (electrification gap) between the electrification member and the image holding body is less than a thickness of the transcription material, and is greater than a particle diameter of the toner that is the left-over developer component.

In the respective arrangements mentioned above, a narrowest gap (electrification gap) between the electrification member and the image holding body is less than a thickness of the transcription material. Because of this, it is possible to prevent the transcription material that is electrostatically attracted onto the image holding body by the transcription electric charge, from entering the development region, in case the peeling-off of the thus attracted transcription material is failed. When the transcription material enters the development region, the jam (paper jamming)-solving operation becomes more difficult and the operator who does the jam-solving operation gets his hand and clothes dirty. With this arrangement, the transcription material that is attracted onto the image holding body can be surely peeled off in the transcription region, thereby preventing the transcription material from entering the development region.

Moreover, with this arrangement, in which the electrification gap is less than the thickness of the transcription material, considering the thickness of the generally-used transcription material, it is possible to reduce the occurrence of the abnormal electric discharge, and to prevent the uneven electrification of the image holding body due to the abnormal electrical discharge. Further, by arranging that the electrification gap is narrow, it is possible to have a low break-down voltage, as shown by "Paschen's experimental formula", thus, it is possible to have low power source voltage.

Furthermore, when the oppositely electrified toner is captured by using the electrification member in order to perform the cleaning as to the left-over developer component, especially, the oppositely electrified toner and the carrier, the arrangement in which the electrification gap is greater than the particle diameter of the toner, prevents the toner from being fused and bonded with the electrification member (that is, prevents fuse-bonding of the oppositely electrified toner).

The image forming apparatus of the present invention is a two-component development type image forming apparatus using a two-component developer containing a toner and a carrier, is so arranged that a narrowest gap (electrification gap) between the electrification member and the image holding body is less than a particle diameter of the carrier that is a left-over developer component, and is greater than a particle diameter of the toner that is a left-over developer component.

Moreover, the image forming method of the present invention is so arranged that, in case where a two-component developer containing a toner and a carrier is used as the developer, a narrowest gap (electrification gap) between the electrification member and the image holding body is less than a particle diameter of the carrier that is a left-over developer component, and is greater than a particle diameter of the toner that is a left-over developer component.

In the respective arrangements described above, the narrowest gap (electrification gap) between the electrification member and the image holding body is less than a particle diameter of the carrier that is a left-over developer component. This completely prevents the carrier from entering the electrification gap. Moreover, by arranging such that the electrification gap is less than the particle diameter of the carrier, it is possible to attain stable electrification of the image holding body, thereby attaining a good image quality. With the respective arrangements described above, in which the electrification gap is less than the particle diameter of the carrier, considering the particle diameter of the generally used carrier, it is possible to reduce occurrence of the abnormal electric discharge and to prevent the uneven electrification of the image holding body due to the abnormal electric discharge. Further, by arranging that the electrification gap is narrow, it is possible to have a low break-down voltage, as shown by "Paschen's experimental formula", thus, it is possible to have low power source voltage.

Moreover, when the oppositely electrified toner is captured by using the electrification member in order to perform the cleaning as to the left-over developer component, especially, the oppositely electrified toner and the carrier, the arrangement in which the electrification gap is greater than the particle diameter of the toner, prevents the toner from being fused and bonded with the electrification member (that is, prevents fuse-bonding of the oppositely electrified toner).

The image forming apparatus of the present invention is so arranged that a voltage (superimposing voltage) prepared by superimposing an alternating voltage on a direct current voltage, is applied on the electrification member.

Moreover, the image forming method of the present invention is so arranged that a voltage (superimposing voltage) prepared by superimposing an alternating voltage on a direct current voltage, is applied on the electrification member.

Moreover, in a case where the superimposing voltage is applied on the electrification roller, the with rotation, in which the electrification member and the image holding body move in the same direction in the place where the distance between the electrification member and the image holding body is shortest, leads to significant reduction in the efficiency of the electrostatic recovery of the oppositely electrified toner, because in case of the with rotation, the surface potential of the image holding body is increased to a predetermined voltage in a vicinity of an downstream edge of the electrification region, as the electrification proceeds. On the other hand, in case where the against rotation is performed as in the present invention, the against rotation leads to efficient electrostatic recovery of the oppositely electrified toner by the help of effective contribution of the direct current (DC) component of the superimposing voltage, because in case of the against rotation, the oppositely electrified toner is recovered in the immediate upstream of the electrification region in the rotation direction of the image holding body, and transferred, the electrification region being a starting point of the electrification of the image holding body. For this reason, with the above arrangement, it is possible to electrostatically attract the oppositely electrified toner with high efficiency. Moreover, with this arrangement, because the voltage prepared by superimposing the alternating voltage on the direct current voltage is applied on the electrification member, it is possible to agitate the foreign material (left-over material) such as the left-over developer component and the like, which is left over on the surface of the image holding body after the transcription. Thus, it is possible to facilitate the removal of the foreign material such as the left-over developer component and the like, from the image holding body. Because of this, it is possible to improve the efficiency in removing the oppositely electrified toner.

The image forming apparatus of the present invention is so arranged that a magnetic field is formed on the electrification member.

Moreover, the method of forming an image, of the present invention is so arranged that a magnetic field is formed on the electrification member.

Especially, the foreign material, such as the carrier, having a large mass is difficult to remove by using the electrostatic attraction only, thus giving a low recovery efficiency. On the other hand, with the respective arrangements described above, the formation of the magnetic field on the electrification member enables the recovery of the carrier performed non-mechanically by the magnetic attraction force. Thus, it is possible to improve the recovery efficiency of the foreign material, such as the carrier, having a large mass.

Therefore, with the respective arrangements described above, it is possible to prevent the foreign material such as the carrier, the toner, and the like, from entering the electrification gap. This protects the image holding body and the electrification member against being damaged by, for example, the carrier entering the electrification gap. Moreover, it is possible to remove the oppositely electrified toner that is the cause of the image quality deterioration such as the image fogging, unlike the conventional arrangement. In the image fogging, an electrostatic latent image in which the oppositely electrified toner adheres to the region of the white background, is developed thereby overlapping the resultant images.

Further, for an apparatus in which a magnetic toner is used for magnetic one component development and the like, it is possible to magnetically recover (i) the normally electrified toner, (ii) the toner that is weakly electrified, and even (iii) the toner that is not electrified, which are difficult to recover electrostatically.

Moreover, the image forming apparatus of the present invention is so arranged that the electrification apparatus includes left-over developer component recovery means for recovering, into a developer tank of the development means, the left-over developer component thus attracted onto the electrification member.

With this arrangement, in which the electrification apparatus is provided with the left-over developer component recovery means for recovering the left-over developer component that is attracted onto the electrification member, it is possible to reuse the left-over developer component that is attracted onto the electrification member, and to prevent the failure of the electrification caused when the left-over developer component that is attracted onto the electrification member, enters the electrification region.

Moreover, in the above arrangement, in which the left-over developer component that is attracted onto the electrification member, is recovered into the developer tank of the development means, and is subjected to the sufficient agitation electrification in the developer tank. With this arrangement, it is possible to reuse the left-over developer component again after the amount of the electric charge thereof is adjusted to a predetermined value. As a result, it is possible to prevent the image deterioration such as toner image memory and the like.

The image forming apparatus of the present invention is so arranged as to include foreign material agitating means, in upstream of the electrification member with respect to a direction of rotation of the image holding body, for agitating foreign material that is on the image holding body.

In this arrangement, the foreign material such as the left-over developer component and the like, which is not used in the transcription by the transcription means and is left over on the surface of the image holding body after the transcription, is agitated (stirred) and crumbled. Thus, this arrangement enables the electrification member to recover the foreign material with better recovery efficiency. Furthermore, this arrangement mechanically prevents the image memory due to the left-over developer component.

The image forming apparatus of the present invention is so arranged that the foreign material agitating means includes electric charge adjusting means for adjusting an electric charge of the left-over developer component, (a) in case of reversal development, by applying a bias that has opposite polarity to main electrification polarity of the toner, or that has the same polarity as a transcription bias, and (b) in case of normal development, by applying a bias that has the same polarity as the main electrification polarity of the toner, or that has opposite polarity to the transcription bias.

Moreover, the image forming method is so arranged as to include the step of, before the left-over developer component is attracted onto the electrification member and removed, adjusting an electric charge of the left-over developer component in advance, (a) in case of reversal development, by applying a bias that has opposite polarity to main electrification polarity of the toner, or that has the same polarity as a transcription bias, and (b) in case of normal development, by applying a bias that has the same polarity as the main electrification polarity of the toner, or that has opposite polarity to the transcription bias.

With the respective arrangements, in case of the reversal development, the foreign material agitating means applies, via the adjusting means, the bias (+) onto the left-over developer component, specifically, the left-over toner, located on the image holding body. In this case, the bias has the polarity that is opposite to the main electrification polarity (−) of the toner, and is the same as the transcription bias (+). In case of the normal development, the foreign material agitating means applies, via the adjusting means, the bias (+) onto the left-over developer component, specifically, the left-over toner, located on the image holding body. In this case, the bias has the polarity that is the same as the main electrification polarity (+) of the toner, and is opposite to the transcription bias (−). Hereby, the electric charge of the left-over developer component (left-over toner) is adjusted, so that the toner left over on the image holding body after the transcription is oppositely (that is, positively) electrified intentionally (purposely). This enables the electrification member to more efficiently remove the foreign material such as the oppositely electrified toner and the like.

Furthermore, in the respective arrangement, the bias voltage is applied, via the electric charge adjusting means, onto the left-over developer component located. This removes, from the left-over developer component (for example, the left-over toner), the initial electric charge that the left-over developer component has during the development. Hereby, it is possible to prevent the toner image memory and flatten the left-over potential that is left over on the image holding body. Thus, it is possible to adjust the potential of the image holding body and the voltage of the left-over developer component.

With the respective arrangements, the bias voltage applied on the electric charge adjusting means prevents the foreign material such as the left-over developer component from adhering on the electric charge adjusting means, thereby preventing the accumulation of the foreign material on the electric charge adjusting means and deterioration of an agitation effect due to the accumulation.

The image forming apparatus of the present invention is so arranged that the foreign material agitating means includes a conductive brush.

With this arrangement, in which the foreign material agitating means is provided with the conductive brush, the foreign material such as the left-over developer component and the like is allowed to pass through the gaps of the fibers of the conductive brush. Hereby, it is possible to prevent the accumulation of the foreign material and attains good agitation of the foreign material. Further, it is possible to prevent damaging the surface of the image holding body.

The image holding apparatus of the present invention is so arranged that the development means is an apparatus for developing and cleaning, the apparatus including unremoved left-over developer component recovery means for recovering the left-over developer component that is left over on and has not removed from the image holding body after passing the electrification apparatus.

Moreover, the image forming method of the present invention is so arranged as to include the step of recovering, by using the development means, the unremoved left-over developer component that is left over on and has not removed from the image holding body after passing the electrification apparatus.

With the respective arrangements, the electrification member of the electrifying and cleaning apparatus recovers the left-over developer component (left-over material) such as the oppositely electrified toner and the like. After that, it is possible to recover, by using the developing and cleaning apparatus, the unremoved left-over developer component that is left over on the image holding body after passing the electrification member (electrifying and cleaning apparatus). With the respective arrangements, the left-over developer component, especially, the oppositely electrified toner is recovered by the electrification member, which is located in the upstream of the developing and cleaning apparatus in the rotation direction of the image holding member. The oppositely electrified toner is the cause of the image quality deterioration, especially, the image fogging. Therefore, with the respective arrangements, an image of good quality can be maintained in the development cleaning method.

Moreover, the respective arrangements give such an advantage that the integration of the development apparatus and the cleaning apparatus leads to miniaturization of the image forming apparatus.

Especially, in this case, recovered into the developer tank of the development means is the unremoved left-over developer component that is left over on the image holding body after passing the electrification apparatus. Because of this, it is possible to give sufficient agitation electrification to the thus recovered left-over developer component, in the developer tank. Because of this, it is possible to reuse the thus recovered left-over developer component after adjusting the electric charge thereof to a predetermined electric charge amount. As a result, it is possible to prevent the toner image memory and attain efficient recycle of the thus recovered developer component.

The image forming apparatus of the present invention is so arranged that the image holding body has a peripheral velocity that is in a ratio with a peripheral velocity of developer supplying means.

With this arrangement, in which the image holding body has a peripheral velocity that is in a ratio with a peripheral velocity of developer supplying means, it is possible to attain further more efficient recovery of the unremoved left-over developer component that is left over on the image holding body after passing the electrification apparatus. "The developer supplying means has a peripheral velocity ratio that is in a ratio with a peripheral velocity ratio of the image holding body" indicates that the developer supplying means (specifically, the development roller) rotates and the facing surfaces of the developer supplying means (specifically, the development roller) and the image holding body rotate at relative speeds in the development region.

The image forming apparatus of the present invention is so arranged that the developer supplying means is so located that the developer supplying means rotates in such a manner that, in a place where a distance between the developer supplying means and the image holding body is shortest, facing surface thereof move in opposite directions.

With this arrangement, the unremoved left-over developer component that is left over on the image holding body after passing the electrification apparatus, can be recovered before that left-over developer component passes through the development gap. This further improves the recovery efficiency of the unremoved left-over developer component.

Embodiment 2

Another embodiment of the present invention is described as follows.

Note that, Embodiment 1 exemplifies the printing apparatus that performs the two-component development in which the two-component developer containing the toner 61 and the carrier 62 is used. The present embodiment gives description by exemplifying a printing apparatus that performs one-component development in which a one-component developer containing no carrier 62 is used instead of the two-component developer. In the present embodiment, description focuses mainly on differences from Embodiment 1. For the purpose of convenience in the description, the same reference signs are given to components having the same functions as those of Embodiment 1, and description thereof is omitted.

Figure 15:
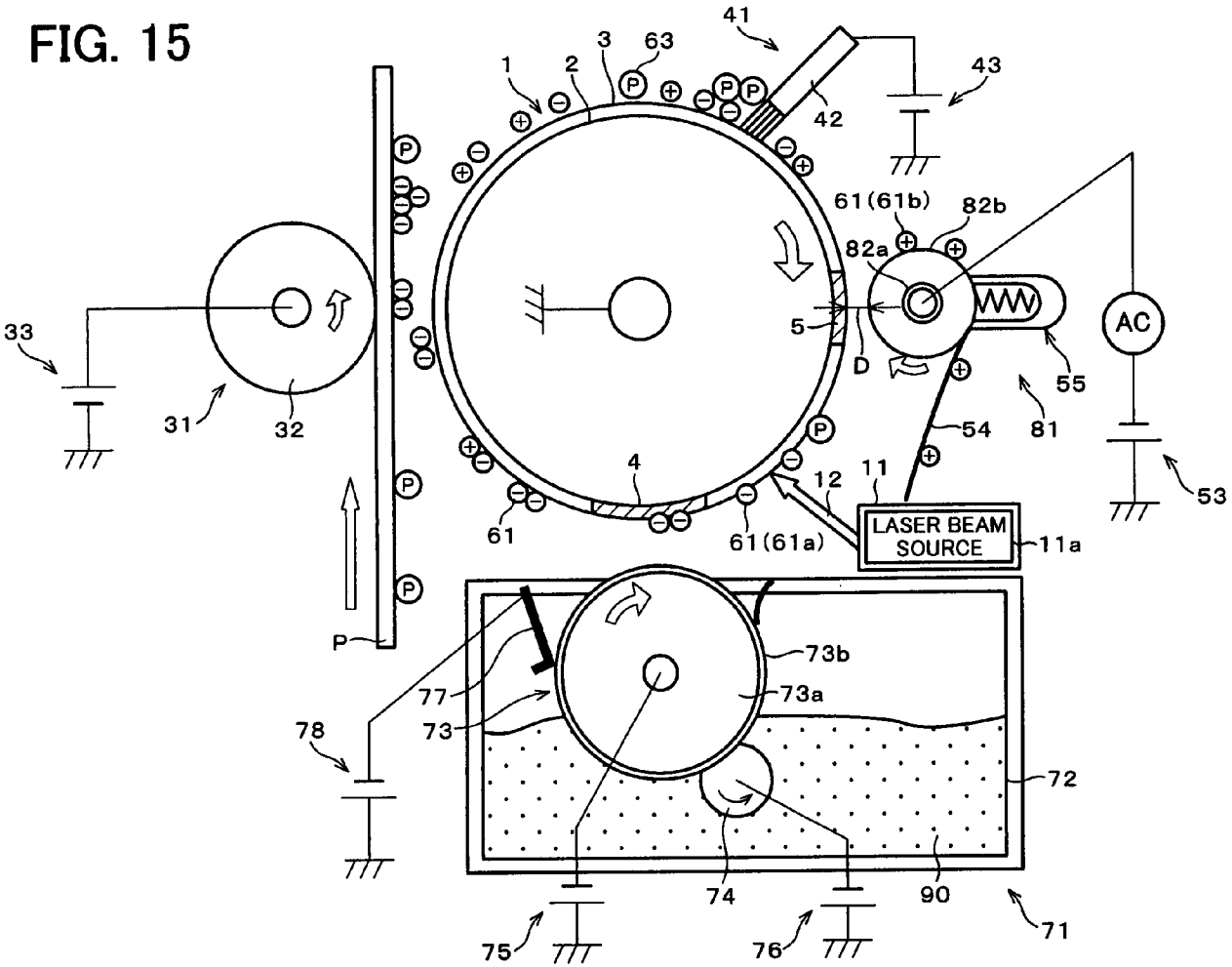
FIG. 15 is an explanatory view for schematically showing an essential part of a printing apparatus according to another embodiment of the present invention.
Figure 16:
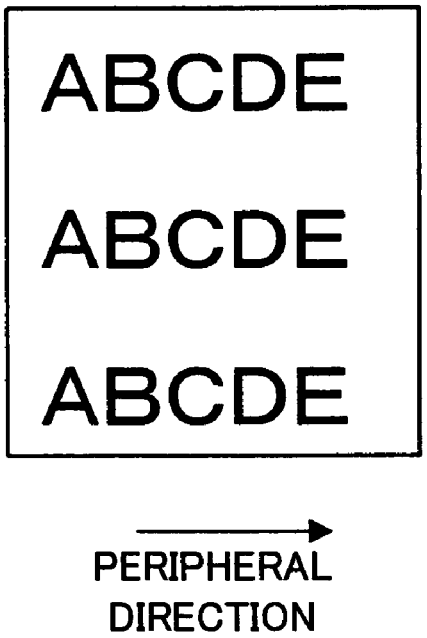
FIGS. 16(*a*) and 16(*b*) are explanatory views showing a result in case where a document is copied by a printing apparatus which does not remove the left-over toner on the electrification roller by cleaning.
Figure 16:
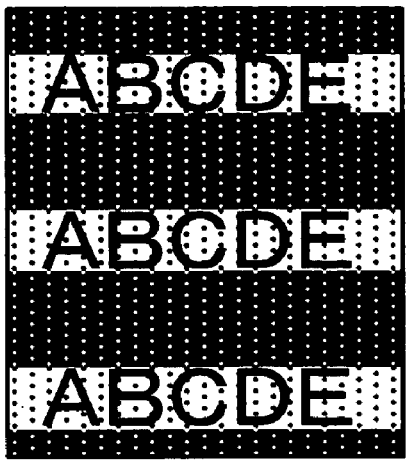
Figure 17A:
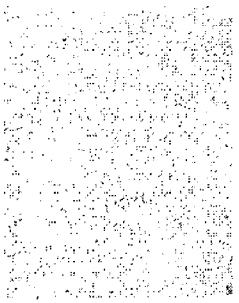
FIGS. 17(*a*) through 17(*h*) are explanatory views showing how the number of black points increases in accordance with frequency in use (the number of copied sheets) in the case where the left-over toner on the electrification roller is not removed.
Figure 17B:
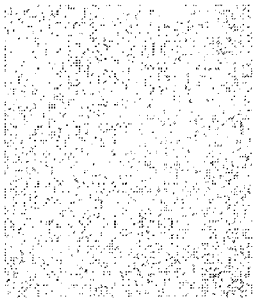
Figure 17C:
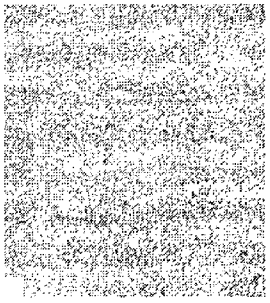
Figure 17D:
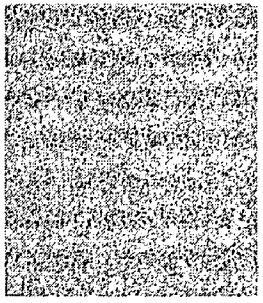
Figure 17E:
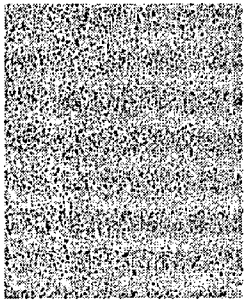
Figure 17F:
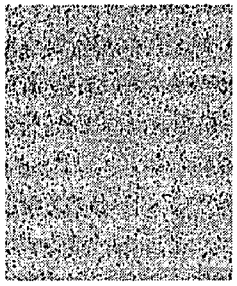
Figure 17G:
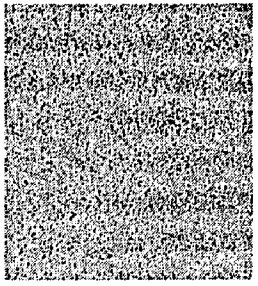
Figure 17H:
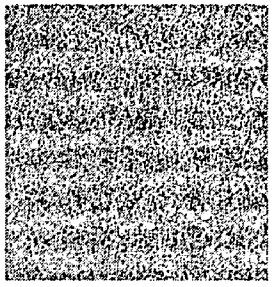
Figure 18:
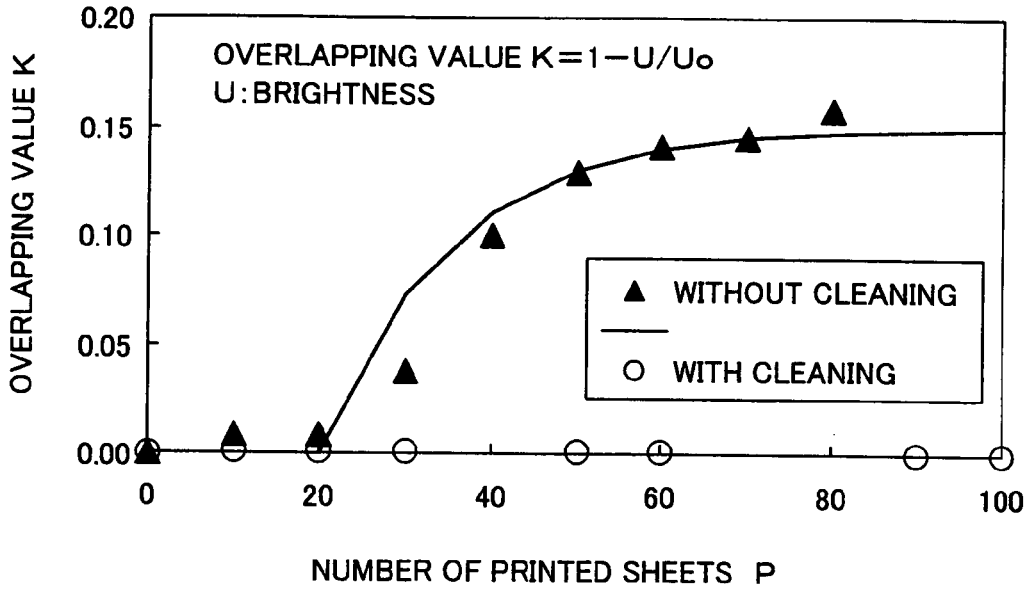
FIG. 18 is a graph showing a relationship between the number of printed sheets (P) and a fogging value K in case where the left-over toner on the electrification roller is removed by cleaning and in case where the left-over toner on the electrification roller is not removed by cleaning.

FIG. 15 is an explanatory view for illustrating a printing apparatus according to the present embodiment (present printing apparatus). As shown in this figure, the present printing apparatus is provided with the LSU 11, a developing apparatus 71, the transcription apparatus 31, the foreign material agitating apparatus 41, and an electrification apparatus 81 around the photoreceptor 1 which functions as an image holding body. The LSU 11, the developing apparatus 71, the transcription apparatus 31, the foreign material agitating apparatus 41, and the electrification apparatus 81 are provided, from an exposing position, i.e., from a position where the LSU 11 emits the laser beam 12, around the photoreceptor 1 in this order with respect to a rotation direction of the photoreceptor 1.

In the present embodiment, the one-component developer containing the toner 61 (magnetic toner) described in Embodiment 1 is used as the developer 90. Hereinafter, the present embodiment exemplifies the case of the reversal development, but the present invention is not limited to this.

The development apparatus 71 is provided with a development roller 73 which functions as developer supplying means for supplying the developer 90 stored in a developer tank 72 to the photoreceptor 1, and a supplying roller 74 for supplying the developer 90 stored in the developer tank 72 to the development roller 73. Further, a predetermined development bias and a predetermined supply bias are applied from power sources (voltage applying means) 75 and 76 onto the development roller 73 and the supply roller 74 respectively. These biases develop (visualize (as a toner image)) an electrostatic latent image which has been formed on the photoreceptor 1 in accordance with exposure performed by the LSU 11. Further, the development apparatus 71 is provided with a layer thickness regulating member 77 for regulating a thickness of a developer layer on a surface of the development roller 73. The layer thickness regulating member 77 is arranged so as to adjust a gap between the layer thickness regulating member 77 and the photoreceptor 1, and to receive a predetermined bias applied from the power source 78. Thus, the layer thickness regulating member 77 can adjust amounts of the developer supplied onto the photoreceptor 1 as in the development apparatus 21 according to Embodiment 1.

The development apparatus 71 is a development apparatus which has a development roller 7 provided with a conductive drum 73*a* and a sleeve 73*b* covering a surface of the conductive drum 73*a*. The development apparatus 71 enables the developer 90 to be electrostatically attracted on a surface of the sleeve 73*b* by a development bias applied to the development roller 73. Further, in a development region 4, the development apparatus 71 (development roller 73)

supplies the developer 90 from the developer tank 72 to the photoreceptor 1 so as to develop the electrostatic latent image on the surface of the photoreceptor 1, and in a recovery (recovery) region, the development apparatus 71 (development roller 73) removes a negatively electrified foreign material from the surface of the photoreceptor 1.

Here, the development region 4 is a region where the development roller 73 is close to the photoreceptor 1, and is a position where the development roller 73 supplies the developer 90 to the photoreceptor 1. Further, the recovery region is a region positioned in upstream of the development region 4 with respect to the rotation direction of the photoreceptor 1.

Further, the negatively electrified foreign material on the surface of the photoreceptor is a negatively electrified unremoved left-over developer component (unrecovered left-over developer) which has been left over on the surface of the photoreceptor 1 with it running off the electrification region. More specifically, the negatively electrified foreign material is contained in the un-transcribed developer 90 that has been left over on the photoreceptor 1, and examples thereof are (i) a negatively electrified left-over toner (normally electrified toner) 61*a* (indicated by the reference symbol "–" shown in FIG. 15) which has not been recovered by the electrification apparatus 81 and (ii) the foreign material such as paper (paper dust) adhering to the negatively electrified left-over toner 61*a*. That is, the development apparatus 71 causes the negatively electrified foreign material to be electrostatically attracted on the surface of the sleeve 73*b* of the development roller 73, so that the negatively electrified foreign material is removed from the surface of the photoreceptor 1.

In this manner, in the recovery region, the development roller 73 can electrostatically attract the negatively electrified foreign material by receiving a development bias (for example, −420V) which has more positive polarity than a surface potential (for example, −600V) of the photoreceptor 1. Further, in the recovery region, also the development roller 73 functions as unremoved left-over developer component recovery means (negatively electrified left-over toner recovery means) which recovers the negatively electrified foreign material, which has been electrostatically attracted, into the developer tank 72 (development cleaning). Note that, the development bias has more positive value (for example, −420V) than a surface potential (for example, −600V) of the photoreceptor 1.

In this manner, the development apparatus 71 functions as a developing and cleaning apparatus which performs development in the development region and cleans (removes and recovers) the negatively electrified foreign material in the recovery region.

Note that, the negatively electrified left-over toner 61*a* that has been recovered by the development roller 73 is returned to the developer tank 72 provided on a back side of the development roller 73. Thus, an agitating (stirring) roller (not shown) can sufficiently perform agitation electrification with respect to the negatively electrified left-over toner 61*a*, that has been recovered, in the developer tank 72. Thus, the negatively electrified left-over toner 61*a* can be reused to perform the development because it is possible to adjust an electric charge of the recovered negatively electrified left-over toner 61*a* to a predetermined electric charge. As a result, it is possible to prevent the toner image memory, thereby realizing the reuse of the recovered negatively electrified left-over toner 61*a*.

Further, the development roller 73 has a peripheral velocity that is in a ratio with a peripheral velocity of the photoreceptor 1 as in the development roller of Embodiment 1. That is, the development roller 73 is rotatably provided.

Thus, it is possible to further improve the efficiency in recovering the negatively electrified left-over toner 61*a*. Note that, the peripheral velocity ratio (development peripheral velocity ratio) of the development roller 73 with respect to the photoreceptor 1 is determined as required in accordance with (i) a doctor gap which defines a thickness of a developer layer, (ii) toner density (T/D) of the developer 90, and (iii) a required development amount, and is not particularly limited. For example, the peripheral velocity ratio as in the aforementioned development roller 23 may be determined.

Further, the development roller 73 is provided so as not to be in contact with the photoreceptor 1, and performs against rotation with respect to the photoreceptor 1. The against rotation is such that: the development roller 73 and the photoreceptor 1 rotate so that (i) a surface of the development roller 73 which surface faces (is opposite to) the photoreceptor 1 and (ii) a surface of the photoreceptor 1 which surface faces (is opposite to) the development roller 73 move in opposite directions in a position where a distance between the development roller 73 and the photoreceptor 1 is the shortest. That is, the development roller 73 is rotated by a driving system different from a driving system of the photoreceptor 1 so that a rotation direction of the development roller 73 is the same as a rotation direction of the photoreceptor 1. Thus, it is possible to further improve the efficiency in recovering the negatively electrified foreign material (negatively electrified left-over toner 61*a* or the like).

Further, the electrification apparatus 81 is arranged in the same manner as in the electrification apparatus 51 except that the magnet roller is not used as the electrification roller 52. That is, the electrification apparatus 81 (the electrification roller 82) is provided with a conductive drum 82*a* and a resistance layer 82*b* covering a surface of the conductive drum 82*a* as a cylindrical or columnar electrification member. A power source 53 applies a voltage to the conductive drum 82*a* of the electrification roller 82, so that the surface of the photoreceptor 1 is electrified via the resistance layer 82*b*.

As in the electrification roller 52, a bias force of the spring 55 which functions as electrification gap adjusting means causes the electrification roller 82 to be located around the photoreceptor 1 but the electrification roller 82 does not touch the photoreceptor 1. The electrification roller 82 is rotated by a driving system different from a driving system of the photoreceptor 1 so as to perform the against rotation in a position where the electrification roller 82 is closest to the photoreceptor 1 (a distance between the electrification roller 82 and the photoreceptor 1 is shortest). Further, a negative (−) direct current voltage is applied to the electrification roller 82 as the electrification bias, so that the electrification roller 82 can electrostatically attract oppositely (oppositely) electrified toner 61*b* having a positive (+) electric charge.

Thus, as an electrifying and cleaning apparatus, the electrification apparatus 81 causes the positively electrified foreign material, left over on the photoreceptor 1 without being transcribed, to be attracted on the surface of the resistance layer 82*b* so as to remove the positively electrified foreign material before passing the electrification gap D as in the electrification apparatus of Embodiment 1. Here, the negatively electrified foreign material is a left-over developer component, more specifically, examples of the negatively electrified foreign material are (i) the positively electrified left-over toner (oppositely electrified toner) 61*b* (indicated by the reference sign "+" shown in FIG. 1) of the developer 90 that has been left over on the photoreceptor 1 without being transcribed, (ii) negatively left-over toner adhering to the positively electrified left-over toner 61*b*, and (iii) (paper powder (paper dusts) and the like adhering to the toner. Further, the electrification gap D is a narrowest gap between the discharge surface of the electrification roller 82 and the photoreceptor 1.

Note that, also in the electrification apparatus 81, a direct current component (in this case, a superimposing voltage prepared by superimposing an alternating current voltage on a negative (−) direct current component (DC voltage) is applied to the electrification roller 82. Thus, it is possible to excite the positively electrified foreign material on the surface of the photoreceptor 1, thereby promoting separation of the foreign material from the photoreceptor 1. Thus, it is possible to electrostatically attract the positively electrified foreign material with high efficiency, thereby improving the efficiency in removing the positively electrified foreign material.

Further, also in the electrification apparatus 81, the cleaning film 54 is provided as the foreign material recovering means with it in contact with the electrification roller 82. Thus, the positively electrified foreign material attracted by the electrification roller 82 is returned to the developer tank 72, and is sufficiently agitated and electrified in the developer tank 72. Therefore, the positively electrified left-over toner 61*b* that has been recovered can be reused. Further, it is not necessary to provide the cleaning film in addition to the electrification apparatus 81, thereby simplifying a structure of the printing apparatus.

The electrification gap D to be smaller than a thickness of a transcription material used upon transcription, i.e., a thickness of a sheet P such as recording paper (transcription paper) adhering to the photoreceptor 1, and to be greater than a particle diameter (toner particle diameter) of the toner 61 may be set.

The sheet P used in a printing apparatus of electronic photography type like the present printing apparatus is recording paper for example, and its weight (pound weight) is at least approximately 60 g/m$^2$ and its thickness is approximately 60 to 80 μm. Thus, The electrification gap D may be set to be smaller than the thickness of the sheet P (recording paper), that is, to be not more than 60 μm for example. Thus, when the operator fails to strip the sheet P (recording paper) electrostatically attracted on the photoreceptor 1 by the transcription charge, it is possible to surely strip the sheet P by means of the electrification roller 82. Thus, it is possible to prevent the attracted sheet P (recording paper) from entering the development region 4. (such entry of the sheet P makes it more difficult to solve "jam" (to remove jammed sheets), and makes the operator's hands and clothes dirty by the toner 61).

Further, when the electrification gap D exceeds 60 μm, it tends to bring about the uneven discharge as described in Embodiment 1. Thus, the electrification gap D of not more than 60 μm brings about less uneven discharge, thereby preventing uneven electrification of the photoreceptor 1 that is caused by the uneven discharge.

Further, as described in Embodiment 1, the electrification gap D may be set taking into consideration a case where the electrification gap D deviates from the set value due to a process error and the like. That is, the electrification gap D may be set to not more than 55 μm, so as to reduce the electrification potential deviation. Further, the electrification gap D may be set to not more than 40 μm so as to perform stable electrification.

Further, also in the present embodiment, the electrification gap D is made greater than a particle diameter of the toner 61 adhering to the photoreceptor 1, so that it is possible to prevent the left-over toner, i.e., the toner 61 from being fused to the electrification roller 82. Note that, an ordinary particle diameter of the toner is approximately 7 μm. Thus, the electrification gap D may be set to not less than 7 μm.

Further, also in the present embodiment, it is possible to lower the power source voltage by making the electrification gap D smaller as apparent from "Paschen's experimental formula" indicating a break-down voltage of aerial discharge.

As described above, also the present printing apparatus includes: an image holding body on which an image is formed; an electrification apparatus for electrifying the image holding body by applying a voltage on an electrification member provided around the image holding body so as not to touch a surface of the image holding body; development means for developing a latent image, formed on the surface of the image holding body due to an electrification charge, by developer containing at least toner, so as to form a toner image; and transcription means for transcribing the toner image formed on the image holding body to a transcription member, wherein the electrification apparatus functions as an electrifying and cleaning apparatus which removes a left-over developer component left over on the image holding body after transcription by causing the electrification member to attract the left-over developer component, and electrifies the image holding body, and the electrification member and the image holding body are provided so that facing surfaces thereof move in opposite directions in a place where a distance between the electrification member and the image holding body is shortest.

That is, as shown in Embodiment 1, also the printing method according to the present embodiment uses a printing apparatus including: an image holding body on which an image is formed; an electrification apparatus for electrifying the image holding body by applying a voltage on an electrification member provided around the image holding body so as not to touch a surface of the image holding body; development means for developing a latent image, formed on the surface of the image holding body due to an electrification charge, by a developer containing at least a toner, so as to form a toner image; and transcription means for transcribing the toner image formed on the image holding body to a transcription member, wherein the electrification member and the image holding body are rotated so that facing surfaces thereof move in opposite directions in a place where a distance between the electrification member and the image holding body is shortest, and a left-over developer component left over on the image holding body after transcription is removed by causing the electrification member to attract the left-over developer component, so as to electrify the image holding body.

Specifically, the present printing apparatus is arranged so that a narrowest gap between the electrification member and the image holding body is set to be smaller than a thickness of the transcription member on which the visualized image is transcribed and to be greater than a particle diameter of the toner which is a left-over developer component.

Note that, the present embodiment describes the printing apparatus of the one-component development using the one-component developer, but the present printing apparatus is not limited to this. The printing apparatus is applicable not only to the one-component developer but also to a two-component developer.

More specifically, the present printing apparatus is arranged so that: an electrification apparatus for electrifying a photoreceptor is located close to a surface of the photoreceptor, and the electrification apparatus is provided with an electrification roller having a conductive cylindrical or columnar member and a resistance layer covering its surface, and a latent image formed on the photoreceptor is developed by a developer containing at least toner and a carrier, wherein a direction in which the electrification roller rotates around its rotational axis is the same as a direction in which the photoreceptor rotates around its rotational axis (against rotation), and a narrowest gap (electrification gap) between a discharge surface of the electrification apparatus and the photoreceptor is smaller than a thickness of a recording paper adhering to the photoreceptor and is greater than a particle diameter of the toner adhering to the photoreceptor. In this manner, the electrification member and the image holding body perform against rotation with respect to each other, so that the left-over developer component such as a positively electrified left-over toner left over on the image holding body after transcription is attracted on the electrification member and is removed before passing the electrification gap. Thus, it is possible to prevent the left-over developer component from entering the electrification gap, and it is possible to surely remove and recover the left-over developer component from the surface of the image holding body as one of the function of the electrification member, but not the side effect thereof. Therefore, according to the present embodiment, it is possible to provide a printing apparatus and a printing method by which a small size apparatus and a lower power source voltage can be realized and preferable image quality can be obtained. Further, the against rotation of the electrification member and the image holding body means that: facing surfaces thereof move in opposite directions in a position where a distance between the electrification member and the image holding body is shortest.

Further, each of Embodiments 1 and 2 describes an arrangement in which a voltage (superimposing voltage) prepared by superimposing an alternating current voltage on a direct current voltage is applied to the electrification member, but the present invention is not limited to this. It may be so arranged that a direct current voltage is applied to the electrification member. That is, the printing method (printing apparatus) according to the present invention may be such a method (arrangement) that the direct current voltage or the voltage (superimposing voltage) prepared by superimposing the alternating current voltage on the direct current voltage is applied to the electrification member.

In the case where the foregoing voltage is applied to the electrification member, a surface potential of the image holding body increases to a predetermined voltage, along with the electrification, in the vicinity of an end portion of the electrification region. Thus, when the electrification member and the image holding body perform with rotation in a position where they are closest to each other (a distance between them is shortest), the ability to electrostatically recover the positively electrified left-over toner is largely lowered. On the other hand, in the case where the electrification member and the image holding body perform the against rotation like the present invention, the positively electrified left-over toner is recovered (recovered) and transported in the vicinity of an upstream of the electrification region, where the electrification of the image holding body begins, with respect to a rotation direction of the image holding body. Thus, the direct current component (direct current voltage) of the superimposing voltage effectively contributes to the electrostatic recovery of the positively electrified left-over toner. Therefore, according to the foregoing arrangement, it is possible to electrostatically attract the positively electrified left-over toner with high efficiency. Particularly, the voltage prepared by superimposing the alternating current voltage on the direct current voltage is applied to the electrification member, so that it is possible to excite the foreign material (left-over material) such as the left-over developer component left over on the surface of the image holding body after the transcription, thereby promoting the separation of the foreign material, such as the left-over developer component, from the image holding body. Thus, it is possible to improve the efficiency in removing the positively electrified left-over toner.

In this case, particularly, such an arrangement may be made that the voltage (superimposing voltage) prepared by superimposing the alternating current voltage on the direct current voltage is applied to the electrification member and a magnetic field is formed. In the case where the superimposing voltage is applied to the electrification member, the ability to electrostatically recover the positively electrified left-over toner is largely lowered upon performing the with rotation as described above. On the other hand, in the case where the electrification member and the image holding body perform the against rotation like the present invention, the direct current component (direct current voltage) of the superimposing voltage effectively contributes to the electrostatic recovery of the positively electrified left-over toner, so that it is possible to electrostatically attract the positively electrified left-over toner with high efficiency. At this time, when a mass of the foreign material (left-over material) is too large to be electrostatically attracted like the carrier, the efficiency in recovering the foreign material is lowered. However, according to the foregoing arrangement, a magnetic field is formed on the electrification member, so that it is possible to non-mechanically recover the carrier due to magnetic attraction. Thus, it is possible to improve the efficiency in recovering the foreign material (left-over material) having a large mass like the carrier.

Thus, according to the arrangement, it is possible to prevent the foreign material such as the carrier and the toner from entering the electrification gap, so that it is possible to prevent the image holding body and the electrification member from being damaged, and it is possible to remove the positively electrified left-over toner which causes image quality deterioration such as image fogging.

Further, in an apparatus using a magnetic toner such as a magnetic one-component developer, it is possible to magnetically recover a negatively electrified left-over toner which is difficult to electrostatically recover, or it is possible to magnetically recover a slightly electrified or un-electrified toner (toner that is not electrified).

Further, the present invention is not limited to the aforementioned embodiments, but may be varied in many ways within the scope of the following claims.

For example, it may be so arranged that the left-over developer component attracted on the electrification member is recovered via a developer supplying tank (hopper) to the developer tank.

Further, it may be so arranged that: a development bias prepared by superimposing an alternating voltage to a direct current is applied to the developer supply means, so that an electrostatic force for promoting separation of the left-over developer from the image holding body is provided, thereby promoting the recovery of the left-over developer from the image holding body.

Further, embodiments obtained by combining technical means disclosed in different embodiments as required are included in the technical scope of the present invention.

Further, a conventional printing apparatus such as an electronic photograph copying machine can be described as follows. That is, an example of a known conventional printing apparatus is a printing apparatus which performs corona discharge. The corona discharge is such that: corona discharge means uniformly electrifies a surface of the photoreceptor (electrified member) so as to have specific polarity, and an electrostatic latent image is formed by selectively erasing electric charges on the photoreceptor in accordance with image exposure, and a developer is supplied to the surface of the photoreceptor by a developer supplying member on which a suitable development bias is applied, so that the electrostatic latent image is developed.

As a printing method using the printing apparatus performing the corona discharge, the following method is proposed as an example. The method is a normal development method using a magnetic toner, and uses a developing and cleaning apparatus instead of using a special cleaning apparatus. The method includes the step of causing a conductive brush to agitate the left-over toner, the conductive brush being for agitating the left-over toner that has been left over on the photoreceptor without being transcribed after performing the transcription step. (see Document 1 for example).

According to the normal development process recited in Document 1, the development apparatus and the cleaning apparatus are integrated, so that it is possible to make the printing apparatus smaller. However, an apparatus using the corona discharge means, like the printing apparatus recited in Document 1, is susceptible to environmental influences such as moisture and dusts, and this brings about such problems that: ozone emitted with the corona discharge gives off a bad smell and is harmful to a human body.

Then, as a method for solving the foregoing problems, an electrification method performing a contact electrification process. The contact electrification process is such that: an electrification member (conductive member) on which a voltage prepared by superimposing an alternating current voltage on a direct current voltage is applied is brought into contact with an electrified member, so that a surface of the electrified member is electrified.

However, when a comparatively hard foreign material such as a carrier adheres to a surface of the electrified member or a surface of the electrification member in such contact electrification process, the electrification member is in contact with the surface of the electrified member with the foreign material intervening between the electrification member and the electrified member, so that there occurs such a problem that the surface of the electrification member and the surface of the electrified member are damaged. Further, when the foreign material such as the carrier adheres to the electrification member, there occurs such a problem that uneven electrification occurs in a region of the electrified member which region corresponds to a portion of the electrification member to which portion the foreign material adheres.

Then, in order to solve such problem that the foreign material adhering to the electrified member and the electrification member damages these members and brings about the uneven electrification (this problem is caused by the contact electrification process), and in order to achieve a no-ozone condition which is the most advantageous point realized by the contact electrification process, the following electrification method and printing apparatus using the method are proposed recently. The electrification method uses a close electrification process in which the electrification member is disposed close to (not in contact with) the photoreceptor.

For example, the following printing apparatus is proposed. The printing apparatus is different from the printing apparatus which is provided with the development apparatus using the two-component development process, in that: the narrowest gap between the discharge surface of the electrification member and the photoreceptor which is the electrified member is greater than a carrier particle diameter of the developer (see Document 2 for example).

Further, the following electrification method is proposed. The electrification method is such that: the electrification member is provided opposite to a surface of the electrified member using the close electrification process with an air gap of 120 μm therebetween, and an alternating voltage obtained by superimposing a low-frequency alternating current voltage on a direct current voltage is applied between these members, thereby electrifying the electrified member (see Document 3 for example).

Further, the following electrification method is proposed. The electrification method is such that: the electrification member is provided opposite to the electrified member with an air gap of 30 μm to 240 μm therebetween so that these members are not in contact with each other, and an electrode bias of a direct current component is applied to the electrification member, thereby electrifying the electrified member (see Document 4 for example).

In the printing apparatus recited in Document 2, the narrowest gap between the discharge surface of the electrification member and the photoreceptor is made greater than a carrier particle diameter of the developer, so that this arrangement does not bring about such a problem that the carrier and the toner adhering to the carrier are caught between the photoreceptor and the electrification member. Thus, the carrier does not damage the photoreceptor and the electrification member and does not make them dirty.

However, in the printing apparatus recited in Document 2, the narrowest gap between the discharge surface of the electrification member and the photoreceptor is made greater than the carrier particle diameter of the developer, so that this arrangement brings about such a problem that a large voltage is required in electrifying the photoreceptor. However, a greater gap tends to bring about a less stable condition under which the electrified member is electrified. Thus, the greater gap causes deterioration of the image quality.

Further, in case of making the gap smaller so as to prevent the foregoing problem, specifically, in case of making the gap smaller than a particle diameter of the foreign material such as the carrier of the developer, it is necessary to surely perform cleaning with respect to the electrified member in upstream of the electrification member so as to prevent the electrified member and the electrification member from being damaged and made dirty. This brings about such problems that: load torque of the photoreceptor 1 is increased by cleaning it, and a film of the photoreceptor 1 is worn out (attrition of the film), and the photoreceptor 1 is damaged by the foregoing material entering the electrification gap.

Further, such problems in cleaning are not necessarily unique to the case where the two-component type development is employed. That is, in the case of making the narrowest gap between the discharge surface of the electrification member and the electrified member smaller as disclosed by Documents 3 and 4, there occur such problems that: when the toner passes through the gap, the toner is caught (stuck) in the gap, and the toner adhering to the electrification member causes a region of the electrified member that corresponds to a portion to which the toner adheres in the electrification member to be unevenly electrified, thereby deteriorating the image quality. In order to prevent such deterioration of the image quality, it is necessary to surely clean the electrified member in upstream of the electrification member regardless of what kind of development method is employed.

Further, in the case of employing the close electrification method, the printing apparatus tends to be larger and the power source voltage tends to be larger than the case of employing the contact electrification method. Thus, a printing apparatus and an printing method which can solve the foregoing problems are required.

Further, it can be said that: the feature of the present invention is to provide a printing apparatus and a printing method which can make the apparatus and the power source voltage smaller and can realize preferable image quality.

As the development apparatus 21, Embodiment 1 describes a development apparatus which includes the development roller 23 made of the magnet roller 23*a* and the sleeve 23*b* covering the magnet roller 23*a*. Thus, the development apparatus 21 enables the developer 60 to be magnetically attracted on a surface of the sleeve 23*b* due to a magnetic force generated by the magnetic roller 23*a*. The developer 60 is supplied from the developer tank 22 to the photoreceptor 1, so as to develop an electrostatic latent image on the surface of the photoreceptor 1. In upstream with respect to a rotation direction of the photoreceptor 1, a magnetic brush (not shown) formed on a surface of the sleeve 23*b* brushes an unremoved left-over developer component (post-recovery left-over material, the development region 4 being a region where the distance between the photoreceptor 1 and the development roller 23 is shortest: specifically, the normally electrified toner 61*a* (indicated by the reference symbol "–" shown in FIG. 1), contained in the developer 60 left over on the photoreceptor without being transcribed, which has not been recovered by the electrification member 51) which has been left over on the surface of the photoreceptor 1. Thus, the normally electrified toner 61*a* and the foreign material such as paper powder adhering to the normally electrified toner 61*a* are electrostatically or mechanically removed from the surface of the photoreceptor 1.

That is, in the vicinity of the upstream of the development region 4 with respect to the rotation direction of the photoreceptor 1, the development roller 23 functions as unremoved left-over developer component recovery means (normally electrified toner recovery means) for recovering the foreign material such as the normally electrified toner 61*a* left over on the photoreceptor 1 into the developer tank 22 (development cleaning).

Thus, as a developing and cleaning apparatus, the development apparatus 21 performs the development and the cleaning with respect to the photoreceptor 1 by recovering the foreign material, such as the unremoved normally electrified toner 61*a* left over on the photoreceptor 1 after passing the electrification member 51, in the recovery region. Here, the recovery region is a region in the vicinity of the upstream of the development region 4 with respect to the rotation direction of the photoreceptor 1, for example, in the upstream of a position from which the developer 60 is supplied to the photoreceptor 1 by the development roller 23 with respect to the rotation direction of the photoreceptor 1. In this manner, the printing apparatus of Embodiment 1 which includes the development apparatus 21 functioning as the developing and cleaning apparatus is not limited to the two-component development. Also in the case of performing the one-component development, the printing apparatus can recover the normally electrified toner 61*a* left over on the photoreceptor 1 into the developer tank 22.

With the rotation of the development roller 23, the normally electrified toner 61*a* attracted on the developer roller 23 is returned to the developer tank 22 located further than the development roller 23 in a backside direction of the printing apparatus (the developer tank 22 is located beyond the developer roller 23). Thus, in the developer tank 22, it is possible to sufficiently electrify the recovered normally electrified toner 61*a* with agitating by means of an agitating roller (not shown) provided on the developer tank 22, so that it is possible to reuse the electric charge of the recovered normally electrified toner 61*a* after adjusting an amount of the electric charge to a predetermined amount. As a result, it is possible to prevent the toner image memory, so that it is possible to reuse the recovered normally electrified toner 61*a*.

Further, it can be said that: the transcription apparatus 31 includes a transcription roller 32 as transcription means which is rotated in accordance with the rotation of the photoreceptor 1, and the transcription roller 32 rotates around its rotational axis in a direction opposite to a direction in which the photoreceptor 1 rotates around its rotational axis, so that a transcription material P is transported to a nip section (transcription region) between the photoreceptor 1 and the transcription roller 32. A predetermined transcription bias is applied from the power source 33, functioning as voltage (transcription bias) applying means, to the transcription roller 32, and the transcription roller 32 is brought into contact with (is pressed against) the photoreceptor 1 via the transcription material P, so that the toner image formed on the photoreceptor 1 is transcribed to the transcription material P.

Further, the transcription roller 32 is driven so as to rotate so that a process speed is 130 mm/s while the transcription bias is of +2 kV for example. Thus, the toner 61 negatively (–) electrified in the development region 4 is slightly positively (+) electrified in the transcription region due to the transcription bias (+2 kV).

Further, it can be said that: the electrification apparatus 51 includes an electrification roller (electrification member) 52 which is located around the photoreceptor 11 due to a bias force of the spring 55 functioning as the electrification gap adjusting means so that the electrification roller 52 does not touch the photoreceptor 1 but is close to the photoreceptor. The electrification roller 52 is a magnet roller having the conductive drum 52*a* and the resistance layer 52*b* which covers a surface of the conductive drum 52*a*. A voltage is applied from the power source 53 functioning as the voltage (electrification bias) applying means to the conductive drum 52*a* of the electrification roller 52, so that the surface of the photoreceptor 1 is electrified via the resistance layer 52*b*.

Further, the electrification apparatus 51 functions as an electrifying and cleaning apparatus which removes the left-over developer component left over on the photoreceptor 1 after the transcription. Specifically, the left-over developer component is the oppositely electrified toner 61 (indicated by the reference symbol "+" shown in FIG. 1) and the carrier 62 (indicated by the reference symbol "CA" shown in FIG. 1). The foreign material such as the oppositely electrified toner 61*b* and the normally electrified toner adhering to the carrier 62 and paper powder, for example, the cluster of the toner 61, the carrier 62, the transcription dusts 63 such as paper powder are removed from the surface of the photoreceptor 1 by causing the left-over developer component to be attracted on the surface of the resistance layer 52*b*.

A voltage (superimposing voltage) prepared by superimposing an alternating current voltage on a direct current voltage is applied to the electrification roller 52, and a magnetic field is formed. In the present embodiment, an alternating current voltage whose peak-to-peak voltage is 1.8 KVpp and frequency is 900 Hz is superimposed on a direct current component of −600V, so as to be applied to the electrification roller 52.

A negative (−) direct current voltage is applied to the electrification roller 52 as the electrification bias, so that it is possible to electrostatically attract the oppositely electrified toner 61*b* which has been positively (+) electrified. Particularly, the superimposing voltage (in this case, a superimposing voltage prepared by superimposing an alternating current voltage on a negative (−) direct current component (DC voltage)) is applied, so that it is possible to excite the foreign material left over on the surface of the photoreceptor 1. Thus, it is possible to promote the separation of the foreign material from the photoreceptor 1, and it is possible to electrostatically attract the oppositely electrified toner with high efficiency, thereby increasing the efficiency in removing the oppositely electrified toner 61*b*.

Further, since a mass of the carrier 62 is large, it is difficult for the electrification roller 52 to electrostatically attract the carrier 62. Therefore, it is not efficient to recover the carrier 62 by the electrostatic force. Thus, the electrostatic attraction lowers the efficiency in recovering the carrier 62. However, since a magnetic field is formed on the electrification roller 52, it is possible to improve the efficiency in recovering the carrier 62 by non-mechanically recovering the carrier 62 by using the magnetic attraction force.

Further, as shown in FIGS. 8 and 9 and Table 3, when an electrification gap C exceeds 55 μm, it is difficult to stably electrify the photoreceptor 1. When the surface potential of the photoreceptor 1 drops by 150V due to the development property, the aforementioned image fogging occurs. Thus, fluctuation (change) of the surface potential of the photoreceptor 1 may be set to not more than 150 Vpp, and the fluctuation may be set to not more than 30 Vpp so as to realize a stable halftone. Thus, when transcription paper is used as the transcription material P for example, black portions may occur in a white background of the transcription paper. Therefore, by setting the electrification gap C to not more than 55 μm, specifically, not more than 40 μm as described above, it is possible to further reduce the occurrence of uneven discharge. As a result, it is possible to prevent the uneven discharge from causing photoreceptor 1 to be unevenly electrified.

Further, in case of catching (capturing) the oppositely electrified toner 61*b* by means of the electrification roller 52 so as to clean the oppositely electrified toner 61*b* and the carrier 62, the electrification gap C is set to be greater than a particle diameter of the toner 61 adhering to the photoreceptor 1. Thus, it is possible to prevent the left-over toner, i.e., the toner 61 from being fused to and adhering (bonded) to the electrification roller 52. Note that, since an ordinary toner diameter is approximately 7 μm, the electrification gap C may be set to not less than 7 μm.

Further, as shown in FIG. 14 (or FIG. 1), the present printing apparatus includes the foreign material agitating apparatus 41, as the foreign material agitating means, provided in upstream of the electrification apparatus 51 with respect to a rotation direction of the photoreceptor 1, more specifically, in upstream of the electrification region 5 of the photoreceptor 1 which electrification region 5 is closest to the electrification roller 52, and the foreign material on the photoreceptor 1 may be agitated, for example, the toner 61 (left-over toner) left over on the photoreceptor 1 may be agitated without being transcribed to the transcription material P, and the left-over developer component (left-over material) such as the carrier 62, and paper or the like adhering to the surface of the photoreceptor 1, after performing the transcription step.

The foreign material agitating apparatus 41 includes the conductive brush 42 provided in upstream of the electrification region 5 of the photoreceptor 1 which electrification region 5 is close to the electrification roller 52 so that the conductive brush 42 touches the photoreceptor 1, and the conductive brush 42 agitates the foreign material on the photoreceptor 1.

It may be so arranged that a direct current voltage is applied to the conductive brush 42. In this case, the power source 43 which functions as the voltage (brush bias) applying means applies a bias in accordance with whether a normal development or a reversal development is performed. When the reversal development is performed, a bias having opposite polarity (+) to main electrification polarity (−) of the toner 61, or a bias having the same polarity (+) as a transcription bias (+) is applied. When the normal development is performed, a bias having the same polarity (+) as the main electrification polarity (+) of the toner 61 or a bias having opposite polarity (+) to a transcription bias (−) is applied. Thus, the foreign material agitating apparatus 41 applies the following biases via the conductive brush 42 to the foreign material on the photoreceptor 1, specifically, to the toner 61 (left-over toner) left over on the photoreceptor 1 after the transcription. When the reversal development is performed, a bias having opposite polarity (+) to main electrification polarity (−) of the toner 61, or a bias having the same polarity (+) as a transcription bias (+) is applied. When the normal development is performed, a bias having the same polarity (+) as the main electrification polarity (+) of the toner 61 or a bias having opposite polarity (+) to a transcription bias (−) is applied.

A brush is used as the foreign material agitating means as described above, so that the foreign material such as the left-over developer component passes through slits of the brush. Thus, it is possible to agitate the foreign material while preventing deposition (accumulation) of the foreign material, and it is possible to prevent the surface of the photoreceptor 1 from being damaged.

In this manner, the foreign material agitating means is provided in upstream of the electrification region 5, and the foreign material is crumbled by agitating (stirring) the foreign material such as the left-over developer component that has been left over on the surface of the photoreceptor 1 without being transcribed, so that it is possible to improve the efficiency in recovering the foreign material on the electrification roller 52.

Further, a bias is applied to the conductive brush 42 as described above, so that it is possible to adjust the electric charge of the left-over developer component which is the foreign material on the photoreceptor 1. That is, in the case of performing the reversal development, the toner 61 negatively (−) electrified in the development region 4 is slightly positively (+) electrified in the transcription region due to the transcription bias (+2 kV). When a voltage of +500 kV is applied by means of the conductive brush 42 for example, the electrification of the toner 61 is reversed as one of the function of the electrification member, but not the side effect thereof. That is, the toner 61 is positively (+) electrified, so that it is possible to efficiently remove the toner 61, i.e., the oppositely electrified toner 61*b* by means of the electrification roller 52. That is, the conductive brush 42 itself functions as both the foreign material agitating means and the electric charge adjusting means for adjusting the electric charge of the left-over developer component.

According to the foregoing arrangement, the foregoing bias is applied to the conductive brush 42, so that it is possible to remove the initial electric charge of the left-over developer component (for example, the left-over toner), thereby preventing the toner image memory and flattening the left-over potential left over on the photoreceptor 1. Thus, it is possible to adjust the potential of the photoreceptor 1 and the voltage of the left-over developer component.

Note that, the bias voltage (brush bias) applied to the conductive brush 42 prevents the foreign material such as the left-over developer component from adhering to the conductive brush 42, so that it is possible to prevent the following disadvantage: deposition of the foreign material adhering to the conductive brush 42 lowers the efficiency in agitating the left-over developer components.

Further, the printing process of the present printing apparatus can be expressed as follows. That is, as shown in FIG. 14 (or FIG. 1), first, the surface of the photoreceptor 1 is evenly electrified by the electrification apparatus 51. Next, a laser beam 12 modulated on the basis of image information of an image to be formed is emitted from a laser beam light source 11*a* of the LSU 11 onto the evenly electrified surface of the photoreceptor 1, and the surface of the photoreceptor 1 is sequentially exposed by every line, so that an electrostatic latent image is formed on the photoreceptor 1.

Next, when the electrostatic latent image passes the development apparatus 21, the toner 61 is supplied from the development roller 23 to the development region 4 of the photoreceptor 1, so that the toner 61 is electrostatically attracted on the electrostatic latent image formed on the photoreceptor 1, thereby visualizing the electrostatic latent image as a toner image (making a toner image).

When the toner image formed on the photoreceptor 1 passes the nip section (transcription section) between the photoreceptor 1 and the transcription apparatus 31, the toner image is transcribed to the transcription material P fed from sheet feeding means (not shown). Thereafter, the transcription material P is transported to a fixing apparatus (not shown), and the toner image is fixed on the sheet (transcription material) P, thereby permanently visualizing the toner image. Then, the transcription material P on which the toner image has been visualized is delivered to a delivery tray (not shown) or the like by delivering means (not shown).

The left-over developer that has been left over on the photoreceptor 1 without being transcribed to the transcription material P by the transcription section is crumbled by agitating (stirring) the left-over developer by means of the conductive brush 42. At the same time, the conductive brush 42 applies a bias having opposite polarity (+) to the main electrification polarity (−) of the toner 61, or a bias having the same polarity (+) as the transcription bias (+) to the left-over developer when the reversal development is performed, and the conductive brush 42 applies a bias having the same polarity (+) as the main electrification bias (+) of the toner 61, or a bias having opposite polarity (+) to the transcription bias (−) to the left-over developer when the normal development is performed, thereby adjusting the electric charge of the left-over developer.

Thereafter, the left-over developer component left over on the photoreceptor 1, specifically, the oppositely electrified toner 61*b* and the carrier 62, are magnetically or electrostatically attracted and cleaned in upstream of the electrification gap C with respect to a rotation direction of the photoreceptor 1 by means of the electrification roller 52. The left-over developer component attracted on the electrification roller 52 is removed from the electrification roller 52 by means of the cleaning film 54, and is returned into the developer tank 22. The photoreceptor 1 from which the left-over developer component has been removed is evenly electrified again by the electrification roller 52, and the exposure, the development, the transcription, and the cleaning are repeated until transcriptions of a predetermined number of sheets are completed.

Further, upon passing the development apparatus 21, the unremoved left-over developer component (normally electrified toner 61*a*) left over on the photoreceptor 1 after passing the electrification roller 52 is electrostatically or mechanically recovered, due to the friction of the magnetic brush (not shown) provided on the development roller 23, in upstream of the development region 4 with respect to the rotation direction of the photoreceptor 1, and is returned into the developer tank 22.

Further, the present embodiment describes the photoreceptor drum as the photoreceptor 1, but the present invention is not limited to this. Instead of the photoreceptor drum, it is possible to use a photoreceptor belt, made of an endless conductive belt, which is stretched (engaged) between supporting rollers provided rotatably with a gap therebetween. Likewise, the present embodiment describes the transcription apparatus 31 having the transcription roller as the transcription means, but it is possible to use a photoreceptor belt, made of an endless conductive belt, which is stretched between supporting rollers provided rotatably with a gap therebetween.

Further, in the present embodiment, it is so arranged that: the electrification apparatus 51 includes the cleaning film 54 as the foreign materials recovering means, and the cleaning film 54 scratches off the foreign material attracted on the electrification roller 52 so as to recover the foreign material into the developer tank 22. However, the present invention is not limited to this. For example, it may be so arranged that: instead of using the cleaning film 54, it is possible to use a cleaning blade so as to scratch off the foreign material, and the scratched foreign material is recovered into a recovery container, so that the scratched foreign material is recovered or removed without being returned into the developer tank 22. However, as described above, the printing apparatus includes the cleaning film 54 as the foreign material recovery means, or the development roller 23 as the unremoved left-over developer component recovery means, so that the carrier 62, and the oppositely electrified toner 61*b* whose electrification condition was largely varied, or the normally electrified toner 61*a* is returned into the developer tank 22 provided further than the development roller 23 in a backside direction, thereby sufficiently agitating and electrifying the left-over developer component.

Further, it can be said that: the present invention relates to a printing apparatus, and specifically to a apparatus which does not have cleaning means for removing a left-over toner from a surface of a photoreceptor.

Further, a conventional printing apparatus includes a photoreceptor and an electrification apparatus, provided close to a surface of the photoreceptor, which electrifies the photoreceptor, wherein an electrostatic latent image formed by performing electrification and exposure of the photoreceptor is developed by developer containing a toner and a carrier. In this printing apparatus, when the toner image is transcribed to a transcription material, the toner image is not completely transcribed to the transcription material, so that a toner is left over on the photoreceptor.

Further, in order to inhibit occurrence of image fogging, the printing apparatus of Document 5 employs a technique in which the left-over toner on the photoreceptor is removed by using a fur brush so as to prevent the toner from adhering to the electrification roller. Note that, in the printing apparatus disclosed in Document 5, the more toner adheres to the fur brush as the printing apparatus is more frequently used. Thus, the toner adhering to the fur brush is removed by using a toner removal roller which is in contact with the fur brush so as to prevent electrification failure, exposure failure, and deterioration of image quality. Further, in the printing apparatus disclosed in Document 5, the left-over toner is removed from the photoreceptor by using the fur brush, so that it is necessary to use the toner removal roller upon removing the toner adhering to the fur brush.

Further, it can be said that: the feature of the present invention is to provide a printing apparatus which does not bring about the electrification failure, the exposure failure, and the deterioration of the image quality, even when the printing apparatus does not include cleaning means such as the fur brush for removing the left-over toner.

Further, in the present printing apparatus, the electrification apparatus 51 for electrifying the photoreceptor 1 is disposed close to a surface of the photoreceptor 1 as shown in FIG. 1. It can be said that: the electrification apparatus 51 includes the electrification roller 52 which has a conductive cylindrical or columnar material and a resistance layer for covering the conductive material.

Further, since the electrification roller 52 is set so as to rotate in the same direction as a rotation direction of the photoreceptor 1 (against rotation), the foreign material is scratched while preventing the foreign material from being involved in a gap between the electrification roller 52 and the photoreceptor 1. Further, an electrification surface of the electrification roller 52 which surface has been refreshed by the cleaning film (scraper) 54 moves from the upstream of the photoreceptor, so that the electrification property of the photoreceptor 1 is improved. Further, the electrification surface moves from the upstream of the photoreceptor 1, so that it is possible to reduce influence exerted by charge-up of the electrification roller 52.

Further, it can be said that: as shown in FIG. 1, the present printing apparatus includes the conductive brush 42 (foreign material agitating means) provided in the upstream of the electrification region 5, positioned on the surface of the photoreceptor 1, which is close to the electrification roller 52. It can be said that: the conductive brush 42 enables the electrification roller 52 to recover the foreign material with higher efficiency by agitating the foreign material (carrier, paper, cluster of the toner) that has been left over on the surface of the photoreceptor 1 without being transcribed.

Further, it can be said that: FIG. 5 is a graph showing a relationship between a voltage applied by the electric charge adjusting means (conductive brush 42) and a corresponding electrification amount of the toner. As apparent from FIG. 5, after the development, the negative left-over toner 61*a* is influenced by the transcription, so that the polarity of the toner is reversed after the transcription. Thus, it can be said that: a direct current voltage of +500V may be applied to the positively electrified left-over toner 61*b* so as to prevent the positively electrified left-over toner 61*b* after the transcription from adhering to the conductive brush 42 in the image region, and so as to remove the positively electrified left-over toner 61*b* that adheres to the conductive brush 42.

Further, it can be said that: in the present removing system, the toner adhering to the conductive brush 42 may be removed by applying a bias, having the same polarity as a bias applied to the transcriber, to the conductive brush 42. For example, in case where the normally electrified toner is negatively electrified, when the bias applied to the conductive brush has negative polarity, the conductive brush 42 attracts the positively electrified toner emitted from the transcriber, but when the bias having the same polarity as the bias applied to the transcriber is applied, it is possible to surely remove the toner adhering to the conductive brush 42 without attracting the toner emitted from the transcriber.

Further, the present removing system may be arranged so that a bias of a voltage (break-down voltage) exceeding a voltage at which the discharge begins between the conductive brush 42 and the photoreceptor 1 is applied to the image region of the photoreceptor 1. Thus, it is possible to cause the electrification roller 52 to recover the reverse electrification toner (positive left-over toner 61*b*) by adjusting the electric charge of the toner to has the opposite polarity (positive polarity).

If the conductive brush 42 is further oscillated by the electrostatic force, it is possible to more efficiently remove the toner adhering to the conductive brush 42, thereby improving the cleaning performance. At this time, if the conductive brush 42 is oscillated at a frequency close to its characteristic frequency, it is possible to more efficiently oscillate the conductive brush 42.

Further, it can be said that: when the bias applied to the conductive brush 42 is an AC-superimposed-DC bias prepared by superimposing an AC bias on a DC bias, it is possible to surely clean both the normally electrified toner adhering to the conductive brush 42 and the oppositely electrified toner with oscillation by switching the polarity of the DC bias.

Further, a shape of the conductive brush 42 is not particularly limited. However, although a movable brush (one kind of the fur brush) which mechanically oscillates can prevent the toner from adhering to the brush by the movement of the brush, a fixed brush cannot realize the foregoing operation. Thus, it can be said that the present invention is particularly effective for the fixed conductive brush.

Further, it can be said that: the movable brush is a brush which mechanically rotates or moves, or a brush which mechanically reciprocates at a distance not less than several mm or at a distance longer than a contact width (main scanning direction: a direction in which the photoreceptor 1 extends), and has a roller shape or a belt shape.

Further, it can be said that: the fixed brush like the agitating voltage power source 43 of the present removing system is fixed with respect to the photoreceptor 1, or reciprocates at a oscillation width of not more than several mm.

Further, it can be said that the transcription roller 32 of the transcription apparatus 31 may be floated above the non-image region where the toner adhering to the conductive brush is removed. According to the arrangement, it is possible to prevent (a) occurrence of unnecessary toner adhering to the transcription roller 32 and (b) electrification of the toner and the photoreceptor 1 which are brought about in case where a single member removes the toner adhering to the conductive brush 42.

Further, it can be said that: the features of the present invention are to agitate the left-over toner and to remove the material adhering to the foreign material agitating means which adjusts the electric charge (electrification amount).

Further, it can be said that: in the present printing apparatus, electrification amounts of the toner remaining on the photoreceptor 1 after the transcription are broadly distributed, and the toner is positively electrified (oppositely electrified) as a whole (average value), and a DC bias voltage having the same polarity (+) as the positively electrified left-over toner 61*b* is applied to the conductive brush 42 so as to prevent the positively electrified left-over toner 61*b* from adhering to the conductive brush 42.

Further, in the present printing apparatus, the electrification amounts of the toner remaining after the transcription are broadly distributed, so that the average value thereof is positive (oppositely electrified). However, there is the toner having a small amount of electric charge and small electrostatic repulsion, or there is the toner which has no electric charge and adheres to the conductive brush 42 due to an intermolecular force between the toner and the brush, or there is a small amount of toner which is negatively electrified, even when it is positively electrified. It is guessed that This is because the toner has a small amount of electric charge and adheres to the conductive brush 42 due to the synergy effect of the intermolecular force and the electrostatic attraction.

Further, it can be said that: the non-image region of the present printing apparatus is a region which covers pre-rotation, a paper-to-paper area, and post-rotation. In this case, the pre-rotation can be regarded as a series of operations: in response to a print-execution order, prior to printing one or a plurality of sheets, the fixing apparatus is warmed up, and the electrification of developer 60 in the developer tank 22 and the electrification of the photoreceptor 1 are started up. Further, the paper-to-paper (sheet-to-sheet) area can be regarded as the non-image region sandwiched by the image regions in case where there is no space above one of the sheets that are sequentially printed. Further, the post-rotation can be regarded as a series of operations: the sheet is transported after passing the last image region on the basis of the print-execution order, and the electrification is stopped, so as to stop the apparatus (photoreceptor surface standard).

Further, in the present removing system, when a voltage applied to the agitating voltage power source 43 is converted into a voltage having negative polarity so as to electrically remove the left-over toner adhering to the agitating voltage power source 43, the electrification amount of the left-over toner left over on the photoreceptor 1 shifts to the negative polarity, so that the efficiency at which the electrification roller 52 recovers the toner is lowered. Then, the toner which has not been recovered by the electrification roller 52 is transported via the exposure region to the development region 4. However, although the transported toner is oppositely electrified (normally electrified), the electrification amount is so reduced (or reversed to the negative polarity) that it is difficult to electrostatically recover the toner. Thus, in the development region, the toner is mechanically (or electrostatically) recovered into the developer tank by the magnetic brush which performs against rotation.

Further, it can be said that: the brush (conductive brush 42) is an elastic member, and is used as a brace. When an AC superimposing bias (superimposing voltage) is applied to the brush, an electrostatic force having twice as many frequency components as AC components or having as many frequency components as AC components of the applied bias acts and is excited between the brush 42 and the photoreceptor 1, so that its oscillation grows at an oscillation frequency close to a characteristic oscillation frequency (equimultiple of or a half of the frequency of the applied bias) of the brush 42, thereby obtaining a mechanically large oscillation frequency. In this case, a fiber of the brush is used as a single brace, and a point contacting the photoreceptor is used as a supporting end, and the point is used as a fixing end in case where its root is fixed by resin or the like, and the point is used as a second supporting end in case where the fiber is transplanted.

Further, the present invention can be expressed as the following first to ninth printing apparatuses. That is, the first printing apparatus includes: a photoreceptor; and an electrification apparatus, provided close to a surface of the photoreceptor, which electrifies the photoreceptor, wherein an electrostatic latent image formed by electrifying and exposing the photoreceptor is developed by a developer containing at least toner and a carrier. The printing apparatus further includes foreign material agitating means for agitating a foreign material that has been left over on the surface of the photoreceptor without being transcribed to a transcription material, wherein the photoreceptor and the electrification roller rotate in the same direction, and an electric field applied to the foreign material agitating means is switched so as to remove the toner adhering to the foreign material agitating means in the non-image region.

In the first printing apparatus, the electric field is switched so as to remove (clean) the toner adhering to the foreign material agitating means (contact brush) in the non-image region. When the toner adhering to the foreign material agitating means is removed in the image region, an area shaded by the toner is insufficiently electrified and exposed, so that the image quality is deteriorated. However, the toner is removed in the non-image region, so that it is possible to remove the toner adhering to the foreign material agitating means without bringing about the foregoing problems. Further, the electrification roller rotates in the same direction as a rotation direction of the photoreceptor (against rotation), so that a distance traveled by the electrification surface is enlarged (a surface area of the electrification roller opposite to the photoreceptor can be enlarged). Thus, the electrification surface is refreshed from a downstream of the photoreceptor, thereby improving the electrification property of the photoreceptor. Further, it is possible to reduce the influence exerted by the charge-up of the electrification roller. Further, it is possible to prevent the foreign material from entering the electrification gap (narrowest gap between the discharge surface of the electrification apparatus and the photoreceptor). (It is possible to prevent the foreign material from being involved in the gap).

Further, the second printing apparatus is different from the first printing apparatus in that an alternating electric field is applied to the foreign material agitating means so as to remove the toner adhering to the foreign material agitating means in the non-image region. The toner adhering to the foreign material agitating means is removed by the alternating electric field, so that it is possible to remove both the normally electrified toner and the oppositely electrified toner.

Further, the third printing apparatus is different from the first printing apparatus in that a bias having the same polarity as a bias applied to a transcriber is applied to the foreign material agitating means so as to remove the toner adhering to the foreign material agitating means. The bias having the same polarity as the bias applied to the transcriber is applied to the foreign material agitating means, so that it is possible to surely remove the oppositely electrified toner adhering to the foreign material agitating means without attracting the toner emitted from the transcriber.

Further, the fourth printing apparatus is different from the first printing apparatus in that a bias having a voltage exceeding a voltage (break-down voltage) at which the discharge begins between the foreign material agitating means and the photoreceptor is applied in the image region of the photoreceptor. In the image region, a bias not less than a break-down voltage is applied so as to adjust the electric charge of the toner to the negative polarity, so that it is possible to cause the electrification roller to recover the oppositely electrified toner with higher efficiency.

Further, the fifth printing apparatus is different from the first printing apparatus in that the foreign material agitating means is mechanically oscillated by an electrostatic force. The foreign material agitating means is mechanically oscillated by the electrostatic force, so that it is possible to more efficiently remove the toner adhering to the foreign material agitating means.

Further, the sixth printing apparatus is different from the first printing apparatus in that the mechanical oscillation is performed at a frequency close to a characteristic frequency of the foreign material agitating means. Thus, it is possible to more efficiently oscillate the foreign material agitating means.

Further, the seventh printing apparatus is different from the first printing apparatus in that the toner adhering to the foreign material agitating means is removed by applying an AC-superimposed-DC bias prepared by superimposing an AC bias on a DC bias to the foreign material agitating means. By switching the polarity of the DC bias, it is possible to remove both the normally electrified toner and the oppositely electrified toner from the foreign material agitating means.

Further, the eighth printing apparatus is different from the first printing apparatus in that the foreign material agitating means is contained in a housing. Even when the toner adhering to the foreign material agitating means spatters, the toner exists in the housing, so that it is possible to prevent an inside of the printing apparatus from being made dirty by the spattering toner, and it is possible to prevent the transcription material (printed sheet) from being made dirty.

Further, the ninth printing apparatus is different from the first printing apparatus in that the transcription roller is floated above the non-image region where the toner adhering to the foreign material agitating means is removed. Thus, it is possible to prevent (a) occurrence of unnecessary toner adhering to the foreign material agitating means and (b) electrification of the toner and the photoreceptor which are brought about in case where a single member removes the toner adhering to the foreign material agitating means.

Further, it can be said that: the present invention relates to a printing apparatus, and particularly to a printing apparatus including an electrification apparatus which electrifies a surface of a photoreceptor by applying a voltage to an electrification roller which is not in contact with the photoreceptor.

Further, a conventional printing apparatus includes a photoreceptor and an electrification apparatus, provided close to a surface of the photoreceptor, which electrifies the photoreceptor, wherein an electrostatic latent image formed by performing electrification and exposure of the photoreceptor is developed by a developer containing at least toner and a carrier. In this printing apparatus, when the toner image is transcribed to a transcription material, the toner image is not completely transcribed to the transcription material, so that toner is left over on the photoreceptor. Thus, the left-over toner has a bad influence on the image, so that the toner is scratched off and removed conventionally by a cleaning blade which is in contact with the photoreceptor as the cleaning means.

However, even when the toner is removed by the cleaning means, a small amount of toner is left over. The left-over toner is deposited on the electrification roller of the electrification apparatus little by little. Thus, the more often the printing apparatus is used, the more toner is deposited on the electrification roller.

Further, it can be said that: the feature of the present invention is to provide a printing apparatus in which the toner is removed from the surface of the photoreceptor by using simple means, without making the foreign material involved in a gap between the electrification roller and the photoreceptor, so as to prevent the electrification failure (uneven discharge) of the photoreceptor, the image quality deterioration, and agitating of the toner which brings about the image quality deterioration.

Further, the electrification roller may be constituted of a conductive cylindrical or columnar member and a resistance layer which covers the conductive member.

Further, it may be so arranged that: the cleaning film 54 is in contact with the electrification roller 52, and the toner (for example, the oppositely electrified toner) deposited on the surface of the electrification roller 52 is scratched by the cleaning film 54, so that the surface of the electrification roller 52 is cleaned.

Further, the gap (electrification gap) C between the electrification apparatus 51 and the photoreceptor 1 is set to not more than the carrier diameter, so that it is possible to prevent the carrier from being involved in (entering) the electrification gap C, thereby surely scratching the carrier which is large in terms of the mass and is difficult to electrostatically attract.

Further, it can be said that: a voltage prepared by superimposing an alternating current voltage on a direct current voltage is applied to the electrification roller 52 (an AC voltage whose peak-to-peak voltage is 1.8 kV and frequency is 900 Hz is applied to a direct current component of −600V), and a magnetic field is formed, so that it is possible to electrostatically attract the toner, thereby improving the efficiency in removing the oppositely electrified toner. Further, it can be said that: since the carrier is too large in terms of the mass to be electrostatically attracted, the efficiency in recovering the carrier is low, but the magnetic field is formed in the electrification roller 52, so that it is possible to improve the efficiency in recovering the carrier by non-mechanically recovering the carrier by the magnetic attraction force.

Further, it can be said that: the present printing apparatus includes the foreign material agitating apparatus 41, provided in upstream of the electrification region 5 of the photoreceptor 1 with it close to the electrification roller 52, which agitates the foreign material on the photoreceptor 1, so that the foreign material (carrier, paper, cluster of the toner) that has been left over on the surface of the photoreceptor 1 without being transcribed is agitated, thereby causing the electrification roller 52 to recover the foreign material with higher efficiency.

Further, it can be said that: it is possible to remove the initial electric charge that the toner bares upon developing an image (it is possible to prevent the toner image memory) by means of the foreign material agitating apparatus 41 (electric charge adjusting means), and it is possible to flatten the potential left over on the photoreceptor 1, so that it is possible to adjust the potential of the photoreceptor 1 and the voltage of the left-over material.

Figure 13:
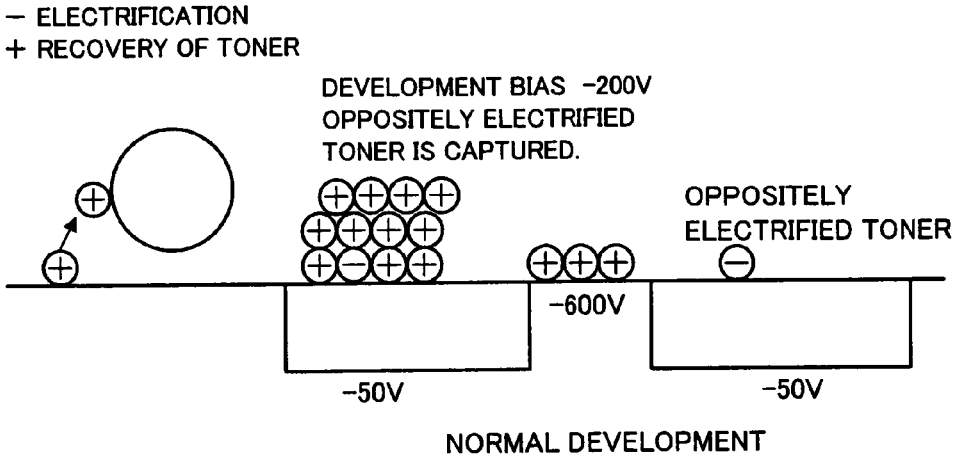
FIGS. 13(*a*) and 13(*b*) are explanatory views showing that a foreign material removing system of the printing apparatus shown in FIG. 1 is more effective in a printing apparatus of reversal development than in a printing apparatus of normal development.
Figure 13:
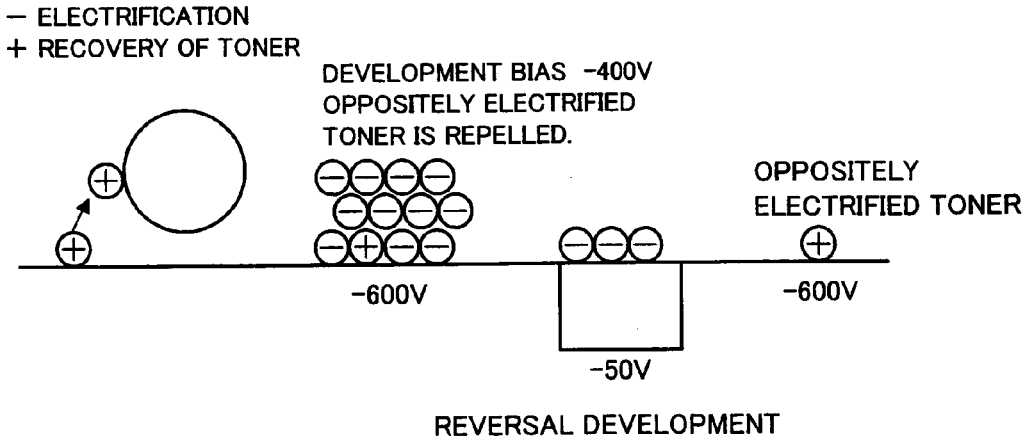

Further, the following description shows that the present printing apparatus is more effective in performing the reversal development than in performing the normal development, with reference to FIG. 13. FIG. 13(*a*) illustrates a relationship between the toner and the photoreceptor in the printing apparatus performing the normal development. FIG. 13(*b*) illustrates a relationship between the toner and the photoreceptor in the printing apparatus performing the reversal development. In the case of the normal development, as shown in FIG. 13(*a*), the normally electrified toner (toner having the main electrification polarity) is positively (+) electrified. When, in the development region, a voltage of −200V is applied to the development bias for example, the negatively electrified toner which is the oppositely electrified toner (toner having opposite polarity to the normal electrification toner) passes the electrification region without being recovered, and is caught by the positively electrified toner (at this time, an exposed portion of the photoreceptor which portion will be a white background has a voltage of −50V, and an unexposed portion of the photoreceptor which portion will be an image has a voltage of −600V). Further, the positively electrified toner that has not been recovered by the electrification roller is the normally electrified toner, so that the positively electrified toner is caught by the development bias. In the case of the normal development performed in this manner, the oppositely electrified toner and the photoreceptor are identical with each other in terms of the polarity, so that the oppositely electrified toner hardly remains on the white background region on the photoreceptor due to its resilience.

On the other hand, in the case of the reversal development, as shown in FIG. 13(*b*), the normally electrified toner is negatively (−) electrified. When, in the development region, a voltage of the development bias −400V is applied to the normally electrified toner that has been negatively electrified without being recovered by the electrification roller, the normally electrified toner is caught by the development bias (at this time, an exposed portion of the photoreceptor which portion will be an image has a voltage of −50V, and an unexposed portion of the photoreceptor which portion will be a white background has a voltage of −600V). However, in the case of the reversal development, the positively electrified toner that has not been recovered by the electrification roller, i.e., the oppositely electrified toner receives a strong electrostatic force since the oppositely electrified toner has opposite polarity to polarity of the unexposed portion of the photoreceptor which portion will be a white background, so that the oppositely electrified toner tends to remain on the photoreceptor. Further, since the development bias has negative polarity, also the normally electrified toner is attracted by the remaining oppositely electrified toner, so that the normally electrified toner adheres to the oppositely electrified toner. Thus, it can be said that: the present printing apparatus is more effective in the printing apparatus using the reversal development in which the oppositely electrified toner causes the toner to remain on a portion of the photoreceptor which portion will be a white background.

Further, the foreign material agitating apparatus 41 may be arranged so that: a bias having opposite polarity (+) to the main electrification polarity (−) of the toner 61 is applied to the conductive brush 42, or a bias having the same polarity (+) as the transcription bias (+) is applied to the conductive brush 42, in the case of the reversal development, and a bias having the same polarity (+) as the main electrification polarity (+) of the toner 61 is applied to the conductive brush 42, or a bias having opposite polarity (+) to the transcription bias (−) is applied to the conductive brush 42, in the case of the normal development, thereby adjusting the electric charge of the left-over developer component which is the foreign material on the photoreceptor.

Further, the against rotation of the development roller 23 and the photoreceptor 1 means that: the development roller 23 and the photoreceptor 1 rotate so that facing (opposite) surfaces of the development roller 23 and the photoreceptor 1 move in opposite directions in a place where a distance between the development roller 23 and the photoreceptor 1 is shortest. Further, the against rotation also means that: the development roller 23 is rotated by a driving system different from a driving system of the photoreceptor 1 so that a direction in which the development roller 23 rotates around its rotational axis is the same as a direction in which the photoreceptor rotates around its rotational axis.

Further, the with rotation of the development roller 23 and the photoreceptor 1 means that: the development roller 23 and the photoreceptor rotate so that a direction in which the development roller 23 rotates around its rotational axis is opposite to a direction in which the photoreceptor 1 rotates around its rotational axis, so that the surface of the development roller 23 and the surface of the photoreceptor 1 move in the same direction in a place where the distance between them is shortest.

Further, it can be said that: according to the present printing apparatus, the electrification roller 52 causes the carrier 62 to positively scratch off the positively electrified left-over toner 61*b*, thereby improving the efficiency in recovering the negatively electrified left-over toner 61*a*.

Further, the electrification roller 52 performs the against rotation with respect to the photoreceptor 1, so that a relative travel distance between the electrification surface of the electrification roller 52 and the electrification surface of the photoreceptor is enlarged in a place where a distance between the electrification roller 52 and the photoreceptor 1 is shortest. Thus, electrification fluctuation caused by a local change in a resistance value of the electrification roller is uniformed, so that the electrification property of the photoreceptor 1 is improved and a surface which should be the electrification surface of the electrification roller 52 (electrified surface) is close to the electrification region 5, specifically, enters the electrification gap C from a downstream of the photoreceptor 1, that is, from an end side of the electrification (from the downstream of the electrification region 5). This reduces such an influence that the electrification roller 52 itself is electrified. Further, the effect is particularly exerted when the resistance value of the resistance layer 52*b* is high.

Further, the sheet P used in the printing apparatus of electronic photography type is a recording paper for example, and its weight is at least approximately 60 g/m$^2$, and its thickness ranges from approximately 60 to 80 μm. Thus, in the case of using the one-component developer, the electrification gap C is set to be smaller than the sheet P (recording paper), that is, the electrification gap C is set to not more than 60 μm for example, so that it is possible to prevent the operator from failing to strip the sheet P (recording paper) that is electrostatically attracted on the photoreceptor 1 due to the transcription charge. Thus, it is possible to prevent the attracted sheet P (recording paper) from entering the development region 4. The entry of the sheet P makes it more difficult to solve "jam" (to remove jammed sheets), and makes the operator's hands and clothes dirty by the toner 61. That is, it is possible to surely strip the sheet P (recording paper) attracted on the transcription region of the photoreceptor 1 by the electrification roller 52, thereby preventing the sheet P (recording paper) from entering the development region 4.

Further, in the present printing apparatus, the electrification member (electrification roller 52) and the image holding body (photoreceptor 1) rotate so that facing surfaces thereof move in opposite directions in a place where a distance between the electrification member and the image holding body is shortest (against rotation), so that the left-over developer component such as the oppositely electrified toner left over on the image holding body without being transcribed is attracted on the electrification member and is removed before passing the electrification gap in the place where the discharge surface of the electrification member and the image holding body are closest to each other. Thus, it is possible to prevent the left-over developer component such as the oppositely electrified toner from entering the electrification gap, and it is possible to surely and remove and recover the left-over developer component from the surface of the image holding body as one of the function of the electrification member, but not the side effect thereof. Further, upon removing and recovering the left-over developer component, the electrification member can simultaneously remove and recover the foreign material (left-over material) such as the transcription dust adhering to the left-over developer component from the image holding body.

Thus, it is not necessary to provide a special cleaning apparatus for removing the foreign material such as the left-over developer component left over on the image holding body unlike a background art, and it is possible to make the apparatus smaller, and it is possible to reduce the power source voltage. Further, this arrangement prevents a film of the image holding body from being worn out by cleaning, and prevents a trail caused by cleaning, and decreases load torque of the image holding body.

Further, it is possible to inhibit the left-over developer component from entering the electrification gap, so that it is possible to inhibit occurrence of the left-over developer component which prevents a portion from being electrified by shading it while passing through the electrification gap, thereby improving the electrification property of the image holding body.

Moreover, the electrification member performs the against rotation with respect to the image holding body, so that the relative travel distance between the electrification surface of the electrification member and the electrification surface of the image holding body is enlarged in the place where the distance between the electrification member and the image holding body is shortest. Thus, it is possible to prevent the uneven electrification caused by local (partial) fluctuation of the resistance value of the electrification member, and it is possible to uniformly electrify the image holding body. Besides, it is possible to lessen such an influence that: the electrification member itself is electrified because a surface which should be the electrification surface of the electrification member (electrified surface) comes close to the electrification region, specifically, enters the electrification gap from a downstream of the image holding body, that is, from an end side of the electrification (from the downstream of the electrification region). In addition, the electrified surface of the electrification member, which surface has been refreshed after removing the developer component and the like from the electrification member, enters the electrification gap, so that it is possible to prevent the recovered material from influencing the electrification, thereby improving the electrification property of the image holding body.

Further, the present printing apparatus may be arranged so that the cleaning film 54 is constituted of a conductive material and the electric charge remaining in the cleaning film 54 is removed. This arrangement prevents the cleaning performance realized by the electrification of the cleaning film 54 itself from deteriorating with time. Note that, this age-related deterioration (deterioration with age) indicates that: when the cleaning film 54 is negatively electrified by the electrification roller 52 fretting against the positive left-over toner 61*b*, the electrostatic attraction force acts as a binding force of the positively electrified left-over toner 61*b* (positively electrified foreign material), and the positively electrified left-over toner 61*b* is deposited on the cleaning film 54, and a toner hump is formed in an end contact portion of the cleaning film 54, and an amount of the toner passing through the cleaning film 54 due to the toner lump increases as the toner hump grows.

Further, in the present printing apparatus, a superimposing voltage containing an alternating current voltage is applied to the electrification roller 52 as an electrification bias. That is, by superimposing an alternating current voltage, an alternating electrostatic force acts on the toner in the periphery of a portion from which the toner on the photoreceptor enters the electrification region, so that the separation of the toner is promoted. The separated toner becomes cloudy so that the adsorptive recovery of the electrification roller is promoted. In a micro view, a timing at which the repulsive force acts is a problem, but in a macro view, it is possible to more efficiently recover the oppositely electrified toner because the DC bias acts. Further, the development roller 73 is provided so as not to touch the photoreceptor, and the development roller 73 rotates so that a surface of the development roller 73 which surface faces (is opposite to) the photoreceptor 1 and a surface of the photoreceptor 1 which surface faces (is opposite to) the development roller 73 move in opposite directions (against rotation). That is, the development roller 73 is rotated by a driving system different from a driving system of the photoreceptor 1 so that a direction in which the development roller 73 rotates around its rotational axis is the same as a direction in which the photoreceptor 1 rotates around its rotational axis. Thus, it is possible to further improve the efficiency in recovering the unremoved left-over developer component (normally electrified toner 61*a*). Further, it can be said that: the against rotation means that two members rotate so that facing surfaces thereof move in opposite directions. Further, it can be said that: the positively electrified foreign material is a foreign material such as the negatively electrified left-over toner and paper that adhere to the positively electrified toner, for example, a cluster of the toner 61 and transcription dusts such as paper.

Further, it is possible to express the present invention as the tenth to nineteenth printing apparatuses. That is, the tenth printing apparatus includes: a photoreceptor; and an electrification apparatus, provided close to a surface of the photoreceptor, which has an electrification roller for electrifying the photoreceptor, and develops an electrostatic latent image formed by electrification and exposure of the photoreceptor by using a developer containing at least toner and a carrier, wherein the printing apparatus further includes cleaning means for cleaning a surface of the electrification roller, and the electrification roller and the photoreceptor rotate in the same direction.

In the tenth printing apparatus, the cleaning means cleans the surface of the electrification roller, so that it is possible to stabilize the electrification property of the electrification roller. Further, the electrification roller rotates in the same direction as a rotation direction of the photoreceptor (against rotation), so that it is possible to prevent the foreign material from entering the electrification gap (narrowest gap between the discharge surface of the electrification apparatus and the photoreceptor) (it is possible to prevent the foreign material from being involved in the gap). Further, a distance traveled by the electrification surface is enlarged by the against rotation (a surface area of the electrification roller which surface is opposite to the photoreceptor can be made larger), so that the electrification surface is refreshed from a downstream of the photoreceptor, thereby improving the electrification property of the photoreceptor. Further, it is possible to reduce the influence of the electrification of the electrification roller itself.

Further, the eleventh printing apparatus is different from the tenth printing apparatus in that the narrowest gap (electrification gap) between the discharge surface of the electrification apparatus and the photoreceptor is not more than the carrier diameter. By setting the electrification gap to not more than the carrier diameter in this manner, it is possible to prevent the carrier from being involved in (entering) the electrification gap, thereby causing the electrification roller to surely recover the carrier which is large in terms of the mass and is hard to electrostatically attract.

Further, the twelfth printing apparatus is different from the tenth printing apparatus in that the cleaning means is constituted of a plate or a film. The cleaning means is constituted of a plate or a film, so that it is possible to constitute simple cleaning means.

Further, the thirteenth printing apparatus is different from the tenth printing apparatus in that the cleaning means has conductivity. By eliminating the electric charge caused by performing frictional electrification, it is possible to prevent deterioration-with-time of the cleaning performance that is caused by the electrification of the cleaning means itself.

Further, the fourteenth printing apparatus is different from the tenth printing apparatus in that the surface of the electrification roller has a mold-lubricant property. As the surface of the electrification roller, a conductive fluorine resin having the mold-lubricant property is used for example, thereby further improving the cleaning property of the cleaning means.

Further, the fifteenth printing apparatus is different from the tenth printing apparatus in that a magnetic field is formed in the electrification roller. By magnetically attract the carrier in a non-mechanical manner, it is possible to improve the efficiency in recovering the carrier.

Further, the sixteenth printing apparatus is different from the tenth printing apparatus in that the printing apparatus includes electric charge adjusting means, provided in upstream of the electrification region, which adjusts an electrification amount of the toner on the photoreceptor to a reversal electrification side. Thus, by shifting the electrification amount of the toner to the reversal electrification side before entering the electrification region, it is possible to more efficiently catch the toner by means of the electrifying means.

Further, the seventeenth printing apparatus is different from the tenth printing apparatus in that the printing apparatus further includes recovering means for recovering the toner cleaned by the cleaning means into the developer tank. The toner cleaned by the cleaning means is recovered into the developer tank, so that it is possible to prevent the toner from returning to the photoreceptor.

Further, the eighteenth printing apparatus is different from the tenth printing apparatus in that the printing apparatus is constituted as a reversal development printing apparatus. By constituting the printing apparatus as the reversal development printing apparatus, it is possible to make the arrangement of the tenth printing apparatus more effective.

Further, the nineteenth printing apparatus is different from the eighteenth printing apparatus in that the foreign material to be removed is oppositely electrified toner. The deterioration of the image quality in the case where the electrification roller is not cleaned is mainly caused by the oppositely electrified toner, so that such an arrangement is extremely effective.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A foreign material removing system for removing foreign material left over on an image holding body of an electronic photography type printing apparatus, the foreign material removing system comprising:

a power source;

an agitating member for agitating the foreign material that is on the image holding body; and an attracting section for attracting the agitated foreign material by an attraction bias, the agitating member being electrified in accordance with a voltage applied thereon from the power source, and the power source alternately switching polarity of the electrified agitating member, wherein polarity of the electrification of the agitating member is alternately switched over when the agitating member touches a non-image region of the image holding body.

2. The foreign material removing system as set forth in claim 1, comprising:

a transcription section for transcribing the image that is formed on the image holding body, onto a sheet by a transcription bias, the transcription section preventing the transcription bias from being applied onto the non-image region.

3. The foreign material removing system as set forth in claim 1, wherein:

the power source causes a direct current voltage of a superimposing voltage to be equimultiple of or higher than a break-down voltage.

4. The foreign material removing system as set forth in claim 1, wherein:

the printing apparatus includes a transcription section for transcribing an image that is formed on the image holding body, onto a sheet by a transcription bias, and the power source causes a direct current voltage of a superimposing voltage to have the same polarity as the transcription bias.

5. The foreign material removing system as set forth in claim 1, wherein:

the power source causes an alternating current voltage of a superimposing voltage to have a frequency that is approximately equimultiple to or approximately a half of a character frequency of the agitating member.

6. A foreign material removing system for removing foreign material left over on an image holding body of an electronic photography type printing apparatus, the foreign material removing system comprising:

an electrification roller for (i) performing against rotation with respect to the image holding body, (ii) electrifying the image holding body by an electrification bias, and (iii) attracting the foreign material that is on the image holding body; and a cleaning section for cleaning a surface of the electrification roller by removing the foreign material thus attracted onto the electrification roller, wherein:

the cleaning section is made of a plate or a film, which touches the surface of the electrification roller, and wherein the surface of the electrification roller is made of a raw material having a mold-lubricant property.

7. The foreign material removing system as set forth in claim 6, wherein:

the cleaning section is conductive, and includes an earth system for discharging, from the cleaning section, an electric charge that is generated in the cleaning section.

8. The foreign material removing system as set forth in claim 6, wherein:

the electrification bias is a superimposing voltage prepared by superimposing an alternating current voltage on a direct current voltage.

9. The foreign material removing system as set forth in claim 6, wherein:

a magnetic field is formed on the electrification roller.

10. The foreign material removing system as set forth in claim 6, comprising:

an electrification adjusting member for electrifying an amount of electrification of the foreign material that is on the image holding body, so as to render the foreign material to have opposite polarity to the electrification bias.

11. The foreign material removing system as set forth in claim 6, comprising:

a development roller for developing an electrostatic latent image formed on the image holding body, and for attracting the foreign material left over on the image holding body.

12. The foreign material removing system as set forth in claim 6, wherein:

a narrowest gap between the electrification roller and the image holding body is less than a thickness of a sheet used in the printing apparatus, and greater than a particle diameter of a toner contained in a developer.

13. The foreign material removing system as set forth in claim 6, wherein:

a developer used in the printing apparatus is a two-component developer containing a toner and a carrier, and a narrowest gap between the electrification roller and the image holding body is less than a particle diameter of the carrier, and greater than a particle diameter of the toner.

14. A method of removing foreign material left over on an image holding body of an electronic photography type printing apparatus, the method comprising the steps of:

electrifying and removing the foreign material on the image holding body, by rendering an electrification roller of the printing apparatus to perform against rotation with respect to the image holding body, electrifying the image holding body by an electrification bias, and attracting, onto the electrification roller, the foreign material that is on the image holding body;

cleaning a surface of the electrification roller by removing the foreign material thus attracted onto the electrification roller; and developing and attracting, the developing being performed by using a development roller of the printing apparatus, so as to develop an electrostatic latent image that is formed on the image holding body, and the attracting being performed so as to attract the foreign material left over on the image holding body.

15. A printing apparatus comprising (a) an image holding body for holding, on a surface thereof, a latent image, (b) an electrification apparatus for electrifying the image holding body by applying a voltage onto an electrification member, which is so located around the image holding body that the electrification member does not touch the surface of the image holding body, (c) a development means for developing, by using a developer containing at least toner, a latent image that is formed on the surface of the image holding body by electrification charge, so as to convert the latent image into a toner image, (d) foreign material agitating means, in upstream of the electrification member with respect to a direction of rotation of the image holding body, for agitating foreign material that is on the image holding body, and (e) transcription means for transcribing, onto a transcription material, the toner image thus formed on the image holding body, wherein the electrification apparatus is an apparatus for electrifying and cleaning, the apparatus (a) causing the electrification member to attract a left-over developer component that is left over on the image holding body after the transcription, so as to remove the left-over developer component from the image holding body, and (b) electrifying the image holding body, and the electrification member and the image holding body rotating in such a manner that, in a place where a distance between the electrification member and the image holding body is shortest, facing surfaces thereof move in opposite directions.

16. The printing apparatus as set forth in claim 15, wherein:

a narrowest gap between the facing surfaces is less than a thickness of the transcription materials, and greater than a particle diameter of a toner that is the left-over developer component.

17. The printing apparatus as set forth in claim 15, the printing apparatus being of two-component development type in which a two-component developer containing toner and a carrier is used, a narrowest gap between the facing surfaces being less than a thickness of the carrier that is the left-over developer component, and greater than a particle diameter of the toner that is the left-over developer component.

18. The printing apparatus as set forth in claim 15, wherein:

a voltage prepared by superimposing an alternating voltage on a direct current voltage, is applied on the electrification member.

19. The printing apparatus as set forth in claim 15, wherein:

a magnetic field is formed on the electrification member.

20. The printing apparatus as set forth in claim 15, wherein:

the foreign material agitating means includes electric charge adjusting means for adjusting an electric charge of the left-over developer component, (a) in case of reversal development, by applying a bias that has opposite polarity to main electrification polarity of the toner, or that has the same polarity as a transcription bias, and (b) in case of normal development, by applying a bias that has the same polarity as the main electrification polarity of the toner, or that has opposite polarity to the transcription bias.

21. The printing apparatus as set forth in claim 15, wherein:

the foreign material agitating means includes a conductive brush.

22. The printing apparatus as set forth in claim 15 wherein:

the development means is an apparatus for developing and cleaning, the apparatus including unremoved left-over developer component recovery means for recovering the left-over developer component that is left over on and has not removed from the image holding body after passing the electrification apparatus.

23. The printing apparatus as set forth in claim 15, wherein:

the image holding body has a peripheral velocity that is in a ratio with a peripheral velocity of developer supplying means.

24. The printing apparatus as set forth in claim 15, wherein:

a developer supplying means is so located that the developer supplying means rotates in such a manner that, in a place where a distance between the developer supplying means and the image holding body is shortest, facing surface thereof move in opposite directions.

25. A printing method using a printing apparatus including (a) an image holding body for holding, on a surface thereof, a latent image, (b) an electrification apparatus for electrifying the image holding body by applying a voltage onto an electrification member, which is so located around the image holding body that the electrification member does not touch the surface of the image holding body, (c) development means for developing, by using a developer containing at least toner, a latent image that is formed on the surface of the image holding body by electrification charge, so as to convert the latent image into a toner image, and (d) transcription means for transcribing, onto a transcription material, the toner image thus formed on the image holding body, the printing method comprising the steps of:

rotating the electrification member and the image holding body respectively in such a manner that, in a place where a distance between the electrification member and the image holding body is shortest, facing surfaces thereof move in opposite directions; and attracting and electrifying, the attracting being performed so as to attract a left-over developer component that is left over on the image holding body after transcription, so as to remove the left-over developer component from the image holding body, and the electrifying being performed to electrify the image holding body.

26. The printing method as set forth in claim 25, wherein:

a narrowest gap between the electrification member and the image holding body is less than a thickness of the transcription material, and is greater than a particle diameter of the toner that is the left-over developer component.

27. The printing method as set forth in claim 25, wherein:

in case where a two-component developer containing the toner and a carrier is used as the developer, a narrowest gap between the electrification member and the image holding body is less than a particle diameter of the carrier that is the left-over developer component, and greater than a particle diameter of the toner that is the left-over developer component.

28. The printing method as set forth in claim 25, wherein:

a voltage prepared by superimposing an alternating current voltage on a direct current voltage is applied on the electrification member.

29. The printing method as set forth in claim 25, wherein:

a magnetic field is formed on the electrification member.

30. The printing method as set forth in claim 25, comprising the step of:

before the left-over developer component is attracted onto the electrification member and removed, adjusting an electric charge of the left-over developer component in advance, (a) in case of reversal development, by applying a bias that has opposite polarity to main electrification polarity of the toner, or that has the same polarity as a transcription bias, and (b) in case of normal development, by applying a bias that has the same polarity as the main electrification polarity of the toner, or that has opposite polarity to the transcription bias.

31. The printing method as set forth in claim 25, comprising the step of:

recovering, by using the development means, the unremoved left-over developer component that is left over on and has not removed from the image holding body after passing the electrification apparatus.

* * * * *